US009121079B2

(12) United States Patent
Takahashi et al.

(10) Patent No.: US 9,121,079 B2
(45) Date of Patent: Sep. 1, 2015

(54) HIGH-STRENGTH HOT-ROLLED STEEL SHEET AND METHOD OF MANUFACTURING THE SAME

(75) Inventors: Yuzo Takahashi, Tokyo (JP); Junji Haji, Tokyo (JP); Osamu Kawano, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 421 days.

(21) Appl. No.: 13/583,537

(22) PCT Filed: Mar. 9, 2011

(86) PCT No.: PCT/JP2011/055556

§ 371 (c)(1),
(2), (4) Date: Sep. 7, 2012

(87) PCT Pub. No.: WO2011/111758

PCT Pub. Date: Sep. 15, 2011

(65) Prior Publication Data

US 2013/0000791 A1 Jan. 3, 2013

(30) Foreign Application Priority Data

Mar. 10, 2010 (JP) ..... 2010-053774
Mar. 10, 2010 (JP) ..... 2010-053787

(51) Int. Cl.
*C21D 8/02* (2006.01)
*C22C 38/02* (2006.01)
(Continued)

(52) U.S. Cl.
CPC ..... *C21D 8/0226* (2013.01); *B21B 3/00* (2013.01); *C21D 9/46* (2013.01); *C22C 38/001* (2013.01);
(Continued)

(58) Field of Classification Search
CPC ..... B21B 3/00; C21D 8/0226; C21D 9/46; C22C 38/001; C22C 38/005; C22C 38/06; C22C 38/14
USPC ..... 148/328, 330, 331, 332, 333, 336, 337, 148/507
See application file for complete search history.

(56) References Cited

U.S. PATENT DOCUMENTS 6,663,725 B2 * 12/2003 Inoue et al. ..... 148/333
7,347,902 B2 * 3/2008 Mega et al. ..... 148/320
(Continued)

FOREIGN PATENT DOCUMENTS

EP 1 143 022 A1 10/2001
EP 1 681 362 A1 7/2006
(Continued)

OTHER PUBLICATIONS

English translation of JP 2010/090476; Apr. 2010.*
(Continued)

*Primary Examiner* — Helene Klemanski
(74) *Attorney, Agent, or Firm* — Birch, Stewart, Kolasch & Birch, LLP

(57) ABSTRACT

On a cross section with a sheet width direction of a high-strength hot-rolled steel sheet set as a normal line, with regard to an inclusion having a major diameter of 3.0 μm or more, a maximum of a major diameter/minor diameter ratio expressed by (a major diameter of the inclusion)/(a minor diameter of the inclusion) is 8.0 or less, and a sum total of a rolling direction length per 1 $mm^2$ cross section of a predetermined inclusion group composed of plural inclusions each having a major diameter of 3.0 μm or more and a predetermined extended inclusion having a length in a rolling direction of 30 μm or more is 0.25 mm or less. The plural inclusions composing the predetermined inclusion group congregate in both the rolling direction and a direction perpendicular to the rolling direction 50 μm or less apart from each other. The predetermined extended inclusion is spaced over 50 μm apart from all the inclusions each having a major diameter of 3.0 μm or more in at least either the rolling direction or the direction perpendicular to the rolling direction.

15 Claims, 19 Drawing Sheets

(51) Int. Cl.

| | |
|---|---|
| ***C22C 38/04*** | (2006.01) |
| ***C22C 38/06*** | (2006.01) |
| ***C22C 38/12*** | (2006.01) |
| ***C22C 38/14*** | (2006.01) |
| ***B21B 3/00*** | (2006.01) |
| ***C21D 9/46*** | (2006.01) |
| ***C22C 38/00*** | (2006.01) |

(52) U.S. Cl.

CPC ..... *C22C 38/005* (2013.01); *C22C 38/06* (2013.01); *C22C 38/14* (2013.01); *C21D 2211/002* (2013.01); *C21D 2211/003* (2013.01); *C21D 2211/005* (2013.01)

(56) References Cited

U.S. PATENT DOCUMENTS

| | | | | |
|---|---|---|---|---|
| 7,527,700 | B2 | 5/2009 | Kariya et al. | |
| 7,662,243 | B2 * | 2/2010 | Yokoi et al. | 148/333 |
| 7,780,797 | B2 * | 8/2010 | Okamoto et al. | 148/331 |
| 8,182,740 | B2 * | 5/2012 | Okamoto et al. | 420/84 |
| 8,192,683 | B2 * | 6/2012 | Okamoto et al. | 420/103 |
| 2006/0096678 | A1 | 5/2006 | Kariya | |

FOREIGN PATENT DOCUMENTS

| | | | |
|---|---|---|---|
| JP | 2001-192761 | A | 7/2001 |
| JP | 2004-339606 | A | 12/2004 |
| JP | 2006-161111 | A | 6/2006 |
| JP | 2007-92126 | A | 4/2007 |
| JP | 2007-254828 | A | 10/2007 |
| JP | 2007-270197 | A | 10/2007 |
| JP | 2007-277661 | A | 10/2007 |
| JP | 2010-90476 | A | 4/2010 |

OTHER PUBLICATIONS

International Preliminary Report on Patentability and English translation of the Written Opinion of the International Searching Authority, (Forms PCT/IB/338, PCT/IB/373, and PCT/ISA/237) dated Oct. 11, 2012 for International Application No. PCT/JP2011/055556.

Canadian Office Action dated Mar. 5, 2014, issued in corresponding Canadian Patent Application No. 2,792,535.

PCT/ISA/210—International Search Report mailed on Jun. 14, 2011, issued in PCT/JP2011/055556.

PCT/ISA/237—Written Opinion of the International Searching Authority mailed on Jun. 14, 2011, issued in PCT/JP2011 /055556.

* cited by examiner

HIGH-STRENGTH HOT-ROLLED STEEL SHEET AND METHOD OF MANUFACTURING THE SAME

TECHNICAL FIELD

The present invention relates to a high-strength hot-rolled steel sheet that achieves improvement of formability and a fracture property and a method of manufacturing the same.

This application is based upon and claims the benefit of priority of the prior Japanese Patent Application No. 2010-053787 filed on Mar. 10, 2010, and the prior Japanese Patent Application No. 2010-053774 filed on Mar. 10, 2010, the entire contents of which are incorporated herein by reference.

BACKGROUND ART

Conventionally, with the aim of reduction in weight of a steel sheet, an attempt to increase strength of a steel sheet has been promoted. Generally, the increase in strength of a steel sheet causes deterioration of formability such as bore expandability. Therefore, it is important how a steel sheet excellent in balance between tensile strength and bore expandability is obtained.

For example, in Patent Literature 1, there has been disclosed a technique aiming to obtain a steel sheet excellent in balance between tensile strength and bore expandability by optimizing a fraction of microstructure such as ferrite and bainite in steel and precipitates in a ferrite structure. In Patent Literature 1, it has been described that the tensile strength of 780 MPa or more and a bore expansion ratio of 60% or more are obtained.

However, in recent years, a steel sheet more excellent in the balance between the tensile strength and the bore expandability has been required. For example, a steel sheet used for an underbody member of an automobile or the like has been required to have the tensile strength of 780 MPa or more and the bore expansion ratio of 70% or more.

Further, the bore expansion ratio is likely to vary relatively. Therefore, for improving the bore expandability, it is important to decrease not only an average $\lambda ave$ of the bore expansion ratio but also a standard deviation $\sigma$ of the bore expansion ratio being an index indicating the variations. Then, in the steel sheet used for an underbody member of an automobile or the like as described above, the average $\lambda ave$ of the bore expansion ratio has been required to be 80% or more, and the standard deviation $\sigma$ has been required to be 15% or less and has been further required to be 10% or less.

However, conventionally, it has been difficult to satisfy these requirements.

Further, in a case when an automobile drives over a curb or the like to thereby apply a strong impact load to its underbody part, ductile fracture is likely to occur starting from a punched face of the underbody part. Particularly, as a steel sheet has higher strength, its notch sensitivity is higher, and thus the fracture from a punched edge face is more strongly concerned. Thus, as a steel sheet has higher strength, it is important to prevent the ductile fracture as described above. Therefore, in the steel sheet used as a structure member such as the underbody part as above, it is also important to improve the fracture property.

CITATION LIST

Patent Literature

Patent Literature 1: Japanese Laid-open Patent Publication No. 2004-339606

Patent Literature 2: Japanese Laid-open Patent Publication No. 2010-90476

Patent Literature 3: Japanese Laid-open Patent Publication No. 2007-277661

SUMMARY OF INVENTION

Technical Problem

The present invention has an object to provide a high-strength hot-rolled steel sheet allowing bore expandability and a fracture property to be improved and a method of manufacturing the same.

Solution to Problem

The gist of the present invention is as follows.

According to a first aspect of the present invention, a high-strength hot-rolled steel sheet contains:

in mass %,

C, 0.02% to 0.1%;

Si: 0.001% to 3.0%;

Mn: 0.5% to 3.0%;

P: 0.1% or less;

S: 0.01% or less;

Al: 0.001% to 2.0%;

N: 0.02% or less;

Ti: 0.03% to 0.3%; and

Nb: 0.001% to 0.06%, the steel sheet further containing at least one element selected from the group consisting of:

Cu: 0.001 to 1.0%;

Cr: 0.001 to 1.0%;

Mo: 0.001 to 1.0%;

Ni: 0.001 to 1.0%; and

V: 0.01 to 0.2%, the balance being composed of Fe and inevitable impurities, a parameter Q expressed by Mathematical expression 1 below being 30.0 or more, a microstructure being made of a ferrite structure, a bainite structure, or a structure mixed with the ferrite structure and the bainite structure, an average grain size of grains included in the microstructure being 6 μm or less, an X-ray random intensity ratio of {211} plane on a rolled surface being 2.4 or less, and on a cross section with a sheet width direction set as a normal line, with regard to inclusions having a major diameter of 3.0 μm or more, a maximum of a major diameter/minor diameter ratio expressed by (a major diameter of the inclusion)/(a minor diameter of the inclusion) being 8.0 or less, a sum total of a rolling direction length per 1 $mm^2$ cross section of a predetermined inclusion group composed of plural inclusions each having a major diameter of 3.0 μm or more and a predetermined extended inclusion having a length in a rolling direction of 30 μm or more being 0.25 mm or less, the plural inclusions composing the predetermined inclusion group congregating in both the rolling direction and a direction perpendicular to the rolling direction 50 μm or less apart from each other, and the predetermined extended inclusion being spaced over 50 μm apart from all the inclusions each having a major diameter of 3.0 μm or more in at least either the rolling direction or the direction perpendicular to the rolling direction.

[Mathematical expression 1]

$$Q = \frac{[Ti]}{48} \Big/ \frac{[S]}{32} \quad \text{(Mathematical expression 1)}$$

([Ti] indicates the Ti content (mass %) and [S] indicates the S content (mass %).)

According to a second aspect of the present invention, a high-strength hot-rolled steel sheet contains:

in mass %,

C: 0.02% to 0.1%;

Si: 0.001% to 3.0%;

Mn: 0.5% to 3.0%;

P: 0.1% or less;

S: 0.01% or less;

Al: 0.001% to 2.0%

N: 0.02% or less;

Ti: 0.03% to 0.3%;

Nb: 0.001% to 0.06%;

REM: 0.0001% to 0.02%; and

Ca: 0.0001% to 0.02%, the steel sheet further containing at least one element selected from the group consisting of:

Cu: 0.001 to 1.0%;

Cr: 0.001 to 1.0%;

Mo: 0.001 to 1.0%;

Ni: 0.001 to 1.0%; and

V: 0.01 to 0.2%, and the balance being composed of Fe and inevitable impurities, a parameter Q' expressed by Mathematical expression 1' below being 30.0 or more, a microstructure being made of a ferrite structure, a bainite structure, or a structure mixed with the ferrite structure and the bainite structure, an average grain size of grains included in the microstructure being 6 μm or less, an X-ray random intensity ratio of {211} plane on a rolled surface being 2.4 or less, and on a cross section with a sheet width direction set as a normal line, with regard to an inclusion having a major diameter of 3.0 μm or more, a maximum of a major diameter/minor diameter ratio expressed by (a major diameter of the inclusion)/(a minor diameter of the inclusion) being 8.0 or less, a sum total of a rolling direction length per 1 $mm^2$ cross section of a predetermined inclusion group composed of plural inclusions each having a major diameter of 3.0 μm or more and a predetermined extended inclusion having a length in a rolling direction of 30 μm or more being 0.25 mm or less, the plural inclusions composing the predetermined inclusion group congregating in both the rolling direction and a direction perpendicular to the rolling direction 50 μm or less apart from each other, and the predetermined extended inclusion being spaced over 50 μm apart from all the inclusions each having a major diameter of 3.0 μm or more in at least either the rolling direction or the direction perpendicular to the rolling direction.

[Mathematical expression 2]

$$Q' = \frac{[Ti]}{48} \Big/ \frac{[S]}{32} + \left\{ \frac{[Ca]}{40} \Big/ \frac{[S]}{32} + \frac{[REM]}{140} \Big/ \frac{[S]}{32} \right\} \times 15.0 \quad \text{(Mathematical expression 1')}$$

([Ti] indicates the Ti content (mass %), [S] indicates the S content (mass %), [Ca] indicates the Ca content (mass %), and [REM] indicates the REM content (mass %).)

According to a third aspect of the present invention, in the high-strength hot-rolled steel sheet according to the second aspect, Mathematical expression 2 below is satisfied, and the maximum of the major diameter/minor diameter ratio is 3.0 or less, $$0.3 \leq ([REM]/140)/([Ca]/40) \quad \text{(Mathematical expression 2).}$$

According to a fourth aspect of the present invention, the high-strength hot-rolled steel sheet according to any one of the first to third aspects, further contains, in mass %, B: 0.0001% to 0.005%.

According to a fifth aspect of the present invention, in the high-strength hot-rolled steel sheet according to the fourth aspect, a total grain boundary number density of solid solution C and solid solution B exceeds 4.5/$nm^2$ and is 12/$nm^2$ or less, and a size of cementite precipitated in grain boundaries is 2 μm or less.

According to a sixth aspect of the present invention, a method of manufacturing a high-strength hot-rolled steel sheet includes:

rough-rolling a steel slab after heating the steel slab, the steel slab containing:

in mass %,

C: 0.02% to 0.1%;

Si: 0.001% to 3.0%;

Mn: 0.5% to 3.0%;

P: 0.1% or less;

S: 0.01% or less;

Al: 0.001% to 2.0%;

N: 0.02% or less;

Ti: 0.03% to 0.3%; and

Nb: 0.001% to 0.06%, the steel slab further containing at least one element selected from the group consisting of:

Cu: 0.001 to 1.0%;

Cr: 0.001 to 1.0%;

Mo: 0.001 to 1.0%;

Ni: 0.001 to 1.0%; and

V: 0.01 to 0.2%, the balance being composed of Fe and inevitable impurities, the parameter Q expressed by the Mathematical expression 1 being 30.0 or more, and the rough-rolling being performed under a condition in which an accumulated reduction ratio in a temperature zone exceeding 1150° C. becomes 70% or less and an accumulated reduction ratio in a temperature zone of 1150° C. or lower becomes not less than 10% nor more than 25%;

subsequently, finish-rolling the steel slab under a condition in which a beginning temperature is 1050° C. or higher and a finishing temperature is not lower than Ar3+130° C. nor higher than Ar3+230° C.;

subsequently, cooling the steel slab at a cooling rate of 15° C./sec or more; and subsequently, coiling the steel slab at 640° C. or lower.

According to a seventh aspect of the present invention, a method of manufacturing a high-strength hot-rolled steel sheet includes:

rough-rolling a steel slab after heating the steel slab, the steel slab containing:

in mass %,

C: 0.02% to 0.1%;

Si: 0.001% to 3.0%;

Mn: 0.5% to 3.0%;

P: 0.1% or less;

S: 0.01% or less;

Al: 0.001% to 2.0%;

N: 0.02% or less;

Ti: 0.03% to 0.3%;

Nb: 0.001% to 0.06%;

REM: 0.0001% to 0.02%; and

Ca: 0.0001% to 0.02%, and further the steel slab further containing at least one element selected from the group consisting of:

Cu: 0.001 to 1.0%;

Cr: 0.001 to 1.0%;

Mo: 0.001 to 1.0%;

Ni: 0.001 to 1.0%, and

V: 0.01 to 0.2%; and the balance being composed of Fe and inevitable impurities, the parameter Q' expressed by the Mathematical expression 1' being 30.0 or more, and the rough-rolling being performed under a condition in which an accumulated reduction ratio in a temperature zone exceeding 1150° C. becomes 70% or less and an accumulated reduction ratio in a temperature zone of 1150° C. or lower becomes not less than 10% nor more than 25%;

subsequently, finish-rolling the steel slab under a condition in which a beginning temperature is 1050° C. or higher and a finishing temperature is not lower than Ar3+130° C. nor higher than Ar3+230° C.;

subsequently, cooling the steel slab at a cooling rate of 15° C./sec or more; and subsequently, coiling the steel slab at 640° C. or lower.

According to an eighth aspect of the present invention, in the method of manufacturing a high-strength hot-rolled steel sheet according to the seventh aspect, the steel slab satisfies the Mathematical expression 2.

According to a ninth aspect of the present invention, in the method of manufacturing a high-strength hot-rolled steel sheet according to any one of the sixth to eighth aspects, the steel slab further contains, in mass %, B: 0.0001% to 0.005%.

Advantageous Effects of Invention

According to the present invention, the composition, the microstructure, and so on are appropriate, so that it is possible to improve the bore expandability and the fracture property.

DESCRIPTION OF EMBODIMENTS

Hereinafter, embodiments of the present invention will be explained.

First, fundamental research leading to the completion of the present invention will be explained.

The present inventors conducted the following investigations in order to examine predominant causes with respect to a bore expandability and a fracture property of a steel sheet having a ferrite structure and a bainite structure as a main phase.

The present inventors performed hot rolling, cooling, coiling, and so on under the conditions as listed in Table 5 and Table 9 that will be described later, on sample steels of steel compositions 1A1 to 1W3 and 2A1 to 2W3 as listed in Table 4 and Table 8 that will be described later to thereby manufacture hot-rolled steel sheets each having a thickness of 2.9 mm.

Then, a tensile strength, a bore expandability such as an average λave and a standard deviation σ of a bore expansion ratio, and a fracture property were measured on the obtained hot-rolled steel sheets. Further, a microstructure, a texture, and inclusions were examined on the obtained hot-rolled steel sheets.

Figure 1A:
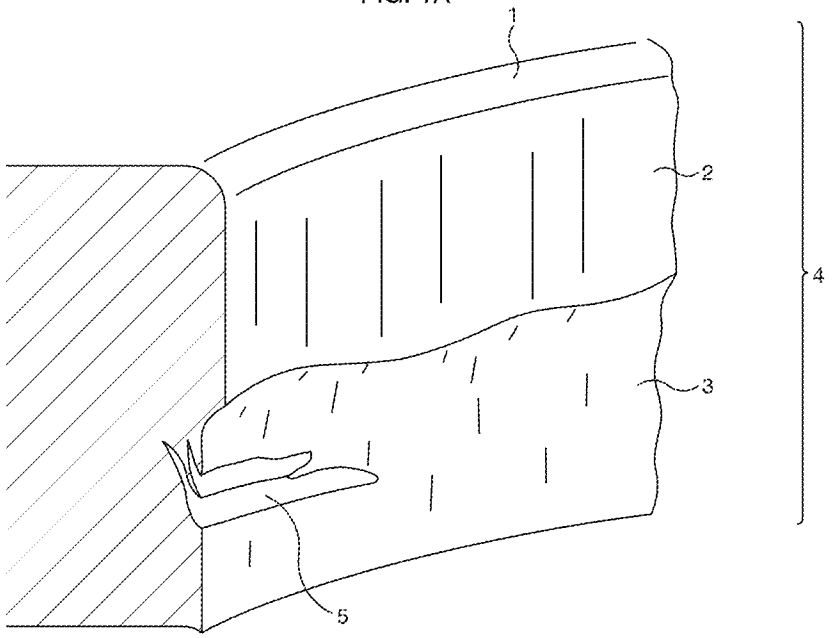
FIG. 1A is a schematic view depicting peeling.
Figure 1B:
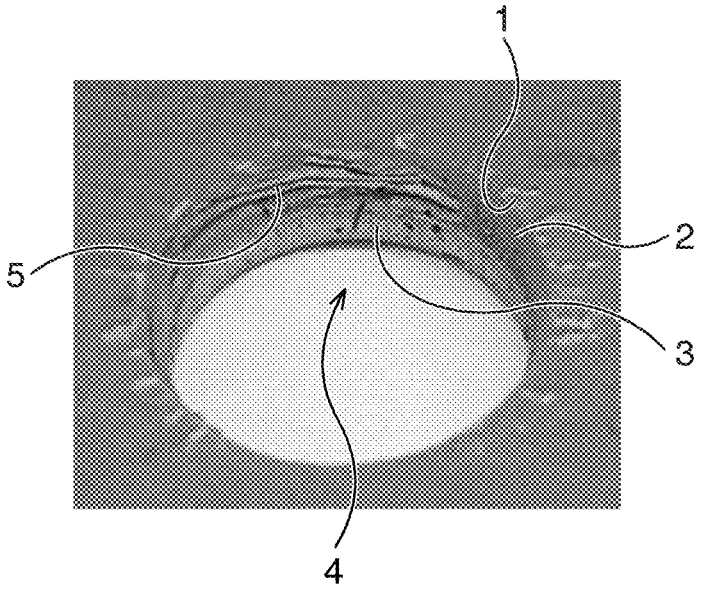
FIG. 1B is a view showing a photograph of peeling.
Figure 1C:
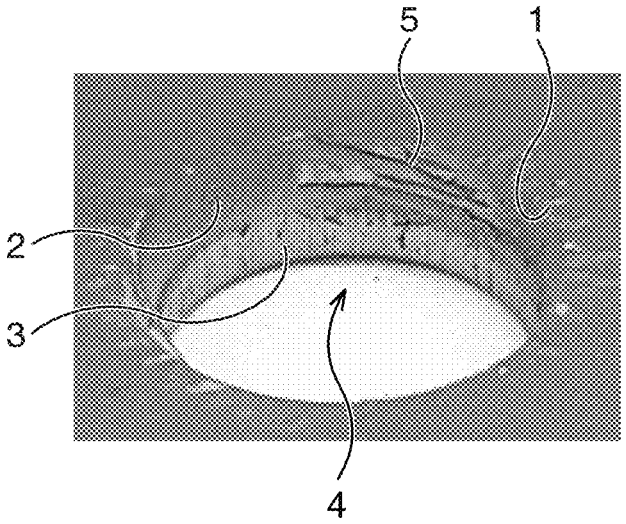
FIG. 1C is a view showing a photograph of peeling similarly.

Further, an n value (a work hardening coefficient) and resistance to peeling were also examined on the obtained hot-rolled steel sheets. Here, the peeling will be explained. When punching of the steel sheet is performed, as depicted in Fig. 1A to FIG. 1C, a punched edge face 4 including a shear face 2 and a fractured face 3, and a shear droop 1 occur. Further, on the shear face 2 and/or the fractured face 3, a flaw or minute crack 5 is sometimes formed. Such a flaw or minute crack 5 occurs so as to get into the inside of the steel sheet from the edge face in parallel with the surface of the steel sheet. Further, the plurality of the flaw or minute crack 5 is sometimes formed in the sheet thickness direction. Here, the flaw and minute crack is generically called peeling. The peeling tends to occur regardless of whether the bore expandability is good or bad, and when the peeling exists, there is sometimes a case that the crack extends starting from the peeling to cause a fatigue failure.

In the evaluation of the tensile strength, from a ½ sheet width portion of each of the sample steels, a No. 5 test piece described in JIS Z 2201 was made so as to make the longitudinal direction of the test piece parallel with the sheet width direction. Then, a tensile test was performed based on the method described in JIS Z 2241 to measure the tensile strength from each of the obtained test pieces. Further, based on each of measured values by the tensile test, a true stress and a true strain were calculated, and based on the calculated true stress and true strain, the n value (work hardening coefficient) was obtained.

In the evaluation of the bore expandability, a test piece having a length in the rolling direction of 150 mm and a length in the sheet width direction of 150 mm was made from a ½ sheet width portion of each of the sample steels. Then, based on the method described in JFS T 1001-1996 of the Japan Iron and Steel Federation Standard, a bore expansion test was performed to measure the bore expansion ratio of each of the test pieces. In the evaluation of the bore expandability, the plural test pieces, for example, the 20 test pieces were made from the single sample steel, and the bore expansion ratios of the respective test pieces were arithmetically averaged to calculate the average λave of the bore expansion ratio and to calculate also the standard deviation σ of the bore expansion ratio. When N pieces of the test pieces are made from the single sample steel, the standard deviation σ is expressed by Mathematical expression 3 below.

[Mathematical expression 3]

$$\sigma^2 = \frac{1}{n}\sum_{i=1}^{n}(\lambda i - \lambda ave)^2 \qquad \text{(Mathematical expression 3)}$$

(λi indicates the bore expansion ratio of the i-th piece out of the plurality of test pieces.)

In the bore expansion test, a punching punch having a diameter of 10 mm was used. Further, a punching clearance obtained by dividing a clearance between the punching punch and a die bore by the thickness of the test piece was set to 12.5%, and a punched bore having an initial bore diameter (D0) of 10 mm was provided in the test piece. Then, a conical punch having a vertex angle of 60° was pressed into the punched bore from the same direction as that of the punching, and an inside diameter of the bore Df at the time when a crack formed on a punched edge face penetrated in the sheet thickness direction was measured. The bore expansion ratio was obtained by Mathematical expression 4 below. Here, the penetration, of the crack, in the sheet thickness direction was confirmed visually.

$$\lambda(\%)=[(Df-D0)/D0]\times 100 \qquad \text{Mathematical expression 4}$$

In the evaluation of the resistance to the peeling, based on the above-described method described in JFS T 1001-1996 of the Japan Iron and Steel Federation Standard, punching was performed with respect to a single test piece to visually observe a punched edge face of the test piece. The clearance in performing the punching was set to 25% in consideration of variation of the punching condition. Further, the diameter of a punched bore was set to 10 mm. When an area where the peeling occurred on the circumference of the edge face ranged for 20 degrees or more when seen from the center of the circle in terms of an angle, "occurrence" was set, and when the area ranged from over 0 degree to less than 20 degrees in terms of an angle, "slight occurrence" was set, and when no peeling occurred, "none" was set. Here, the "occurrence" practically becomes a problem, but the "slight occurrence" is within an allowable range practically.

The fracture property was evaluated by a crack occurrence resistance value Jc ($J/m^2$) and a crack propagation resistance value T. M. (tearing modulus) ($J/m^3$) obtained by a notched three-point bending test, and a fracture appearance transition temperature (° C.) and Charpy absorbed energy (J) obtained by a Charpy impact test. The crack occurrence resistance value Jc indicates resistance to occurrence of a crack from a steel sheet forming a structure member when an impact load is applied thereto (start of fracture), and the crack propagation resistance value T. M. indicates resistance to large-scale fracture of a steel sheet forming a structure member. It is important to improve the above values so as not to jeopardize the safety of the structure member when an impact load is applied thereto. However, there has not been proposed a technique aiming at improving the crack occurrence resistance value Jc and the crack propagation resistance value T. M. conventionally.

Figure 2A:
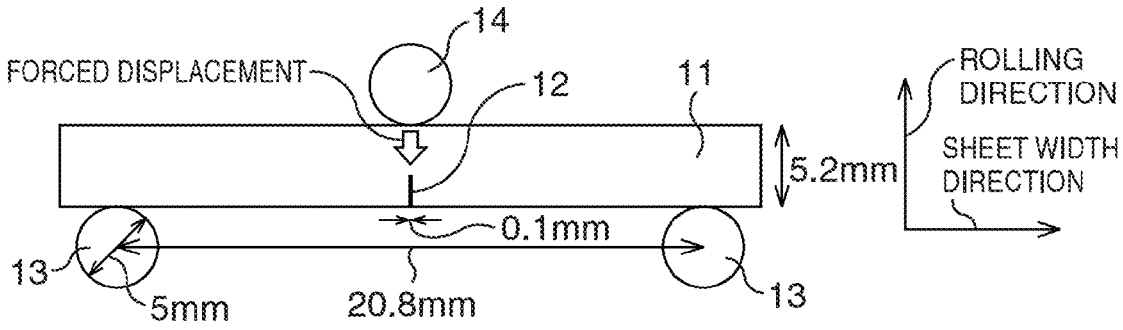
FIG. 2A is a view depicting a method of a notched three-point bending test.
Figure 2B:
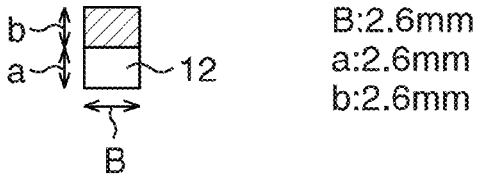
FIG. 2B is a view depicting a notched test piece.
Figure 2C:
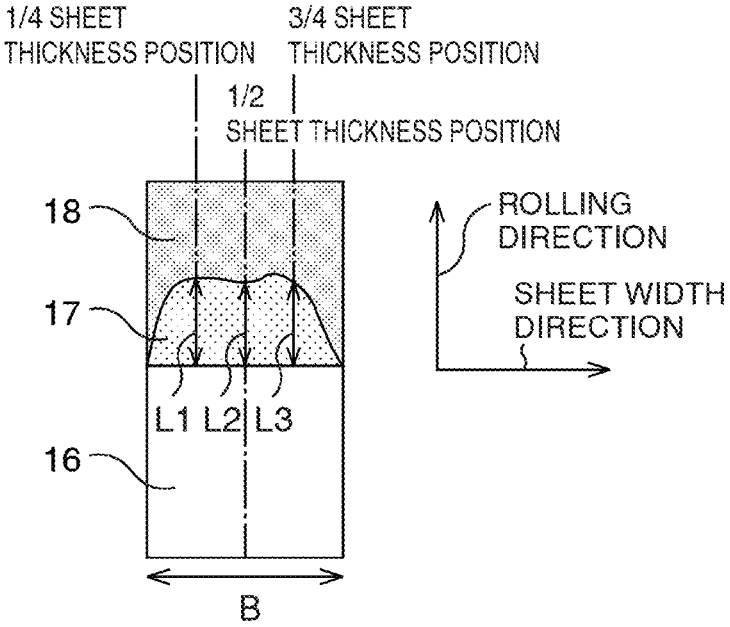
FIG. 2C is a view depicting a notched test piece after being forcedly fractured.

In the notched three-point bending test, five or more notched test pieces 11 each having a notch 12 provided therein as depicted in FIG. 2A and FIG. 2B were made from the single sample steel so as to make the longitudinal direction of the test piece parallel with the sheet width direction. Here, a depth a of the notch 12 was set to 2.6 mm and a width of the notch 12 was set to 0.1 mm. Further, a dimension, of the notched test piece 11, in the rolling direction was set to 5.2 mm and a thickness B was set to 2.6 mm. Then, as depicted in FIG. 2A, both end portions, of the notched test piece 11, in the longitudinal direction were each set to a supporting point 13, and a middle portion of the notched test piece 11 was set to a loading point 14, and under the condition that a displacement amount of the loading point (stroke) was changed variously, the notched three-point bending test was performed with respect to the notched test piece 11. The diameter of the supporting point 13 was set to 5 mm and a spacing between the supporting points 13 was set to 20.8 mm. Thereafter, a heat treatment in which the notched test piece 11 was maintained at 250° C. for 30 minutes in the atmosphere and then was air-cooled was performed with respect to the notched test piece 11 having had the notched three-point bending test performed thereon, and thereby on a fracture 16 formed by the notched three-point bending test, oxidation coloring was performed. Subsequently, the notched test piece 11 was cooled down to a liquid nitrogen temperature with liquid nitrogen, and then at the temperature, the notched test piece 11 was forcedly fractured so that a crack might extend in the notch depth direction from the notch 12 in the notched test piece 11. As depicted in FIG. 2C, a fracture 17 formed by the notched three-point bending test was made clearly visible by the oxidation coloring and was positioned between a notch surface 16 and a fracture 18 formed by the forced fracture. Then, the fracture 17 formed by the notched three-point bending test was observed after the forced fracture, and based on Mathematical expression 5 below, a crack extension Δa (m) was obtained.

$$\Delta a=(L1+L2+L3)/3 \qquad \text{Mathematical expression 5}$$

Figure 3A:
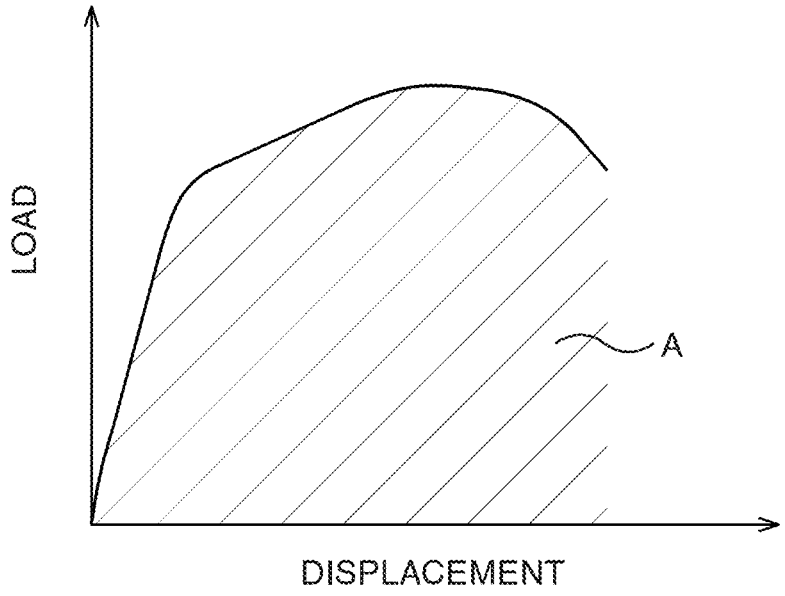
FIG. 3A is a view depicting a load displacement curve.

FIG. 3A is a load displacement curve obtained by a notched three-point bending test performed under a predetermined stroke condition. A work energy A (J) corresponding to the energy applied to the test piece on the test was obtained based on the load displacement curve, and a parameter J ($J/m^2$) was obtained based on Mathematical expression 6 below with the work energy A, the thickness B (m) of the test piece, and a ligament b (m). The ligament b here means the length in the notch depth direction of the portion other than the notch in the cross section including the notch 12 in the notched test piece 11.

$$J=2\times\text{the work energy } A/\{\text{the thickness } B\times\text{the ligament } b\} \qquad \text{Mathematical expression 6}$$

Figure 3B:
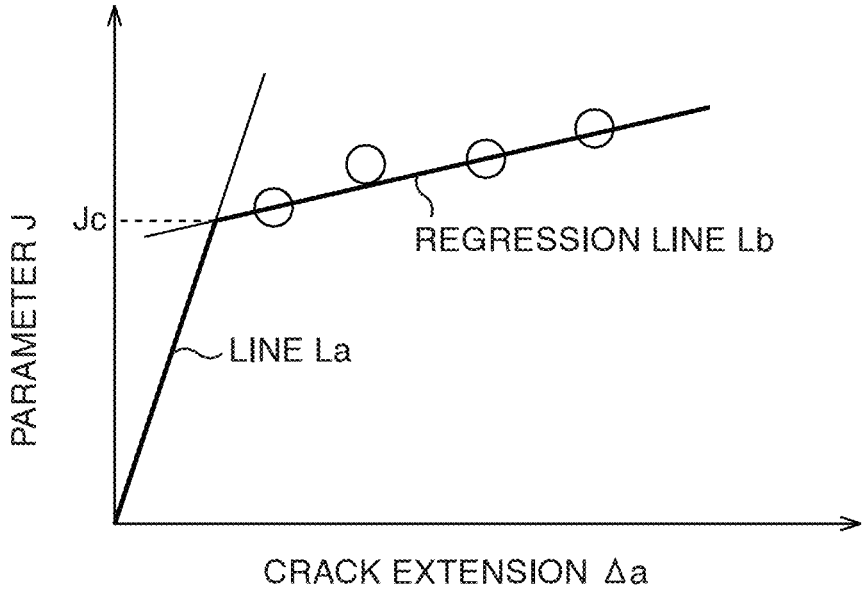
FIG. 3B is a view indicating a crack occurrence resistance value Jc and a crack propagation resistance value T. M.

Further, as depicted in FIG. 3B, the relationship between the crack extension Δa (m) of the notched test piece 11 and the parameter J ($J/m^2$) was expressed in a graph. Then, a vertical axis value (the value of the parameter J) of an intersection point of a line La having an inclination of "3×(YP+TS)/2" and passing through the origin and a primary regression line Lb with respect to the crack extension Δa and the parameter J was obtained, and the value was set to be the crack occurrence resistance value Jc ($J/m^2$) being a value indicating the resistance to the crack occurrence of the sample steel. Further, the inclination of the primary regression line Lb was also obtained and was set to be the crack propagation resistance value T. M. ($J/m^3$) indicating the resistance to the crack propagation of the sample steel. The crack occurrence resistance value Jc is a value corresponding to the work energy per unit area necessary for making a crack occur, and indicates resistance to occurrence of a crack from a steel sheet forming a structure member when an impact load is applied thereto (start of fracture). The crack propagation resistance value T. M. is a value to be an index indicating the degree of the work energy necessary for extending the crack, and indicates resistance to large-scale fracture of a steel sheet forming a structure member.

In the Charpy impact test, a V-notch test piece described in JIS Z2242 was made from each of the sample steels so as to make the longitudinal direction of the test piece parallel with the sheet width direction. Then, the test was performed with respect to the V-notch test piece based on the method described in JIS Z2242. The test piece was set to be a subsize test piece having a thickness of 2.5 mm. The fracture appearance transition temperature and the Charpy absorbed energy were obtained based on JIS Z2242. Then, the fracture appearance transition temperature at which the percentage ductile fracture becomes 50%, and the Charpy absorbed energy obtained at a test temperature set to room temperature (23° C.±5° C.) were used for the evaluation.

In the examination of the microstructure and inclusions, a ¼ sheet width position of each of the steel sheets was observed. In the observation, a sample was cut out so that a cross section with the sheet width direction set as a normal line, (which will be called an L cross section, hereinafter), might be exposed, and the cross section was polished and thereafter the cross section was corroded with a nital reagent. Then, by using an optical microscope, the observation was performed at 200-fold to 500-fold magnification. Further, in the examination of the microstructure, by a method similar to the above method, corrosion was performed with a correction repeller solution, and island-shaped martensite was observed.

In the examination of the texture, an X-ray random intensity ratio was measured. The X-ray random intensity ratio here means a numerical value obtained in a manner that X-ray diffraction intensity of a standard sample having no integration in a particular orientation and having random orientation distribution and X-ray diffraction intensity of the sample steel to be measured are measured by X-ray diffraction measurement, and the obtained X-ray diffraction intensity of the sample steel is divided by the X-ray diffraction intensity of the standard sample. It means that as the X-ray random intensity ratio in a particular orientation is larger, the amount of the texture having a crystal plane in the particular orientation is large in the steel sheet.

The X-ray diffraction measurement was performed by using a diffractometer method using an appropriate X-ray tube, or the like. In making a sample for the X-ray diffraction measurement, a test piece was cut out from a ½ sheet width position of the steel sheet in size of 20 mm in the sheet width direction and 20 mm in the rolling direction, and by mechanical polishing, the sample was polished to a ½ sheet thickness position in the sheet thickness direction, and then strain was removed by electrolytic polishing or the like. Then, the X-ray diffraction measurement of the ½ sheet thickness position of the obtained sample was performed.

It has been known that an average grain size of the microstructure has an effect on the fracture appearance transition temperature. Thus, when examining the microstructure, the average grain size of the microstructure was measured. In the measurement of the average grain size, first, in a portion of the middle of the sheet thickness of the L cross section at the ¼ sheet width position of the steel sheet to be measured, being 500 μm in the sheet thickness direction and 500 μm in the rolling direction, crystal orientation distribution of the portion was examined with a step of 2 μm by an EBSD method. Next, points having an orientation difference of 15° or more were connected by a line segment, and the line segment was regarded as a grain boundary. Then, a number average of circle equivalent diameters of grains surrounded by the grain boundary was obtained to be set as the average grain size.

Further, in the examination of the inclusions, based on the following idea, a sum total M of a rolling direction length of the inclusion ($mm/mm^2$) to be defined as will be described later was measured.

The inclusion forms voids in the steel during deformation of the steel sheet and promotes the ductile fracture to cause the deterioration of the bore expandability. Further, as the shape of the inclusion is a shape extended longer in the rolling direction, stress concentration in the vicinity of the inclusion is increased, and in accordance with the phenomenon, the effect of which the inclusion deteriorates the bore expandability is increased. Conventionally, it has been known that the larger the rolling direction length of the single inclusion is, the greater the bore expandability is deteriorated.

The present inventors found that similarly to the single extended inclusion, an inclusion group made of an inclusion group composed in a manner that the extended inclusion and the spherical inclusion are distributed in the rolling direction being the crack propagation direction within a predetermined spacing range also affects the deterioration of the bore expandability. This is conceivably because by the synergistic effect of strain to be introduced into the vicinity of each of the inclusions composing the inclusion group during deformation of the steel sheet, the large stress concentration occurs in the vicinity of the inclusion group. It was found that quantitatively, the inclusion group made of a group of the inclusions aligned 50 μm or less apart from the adjacent different inclusion on a line in the rolling direction affects the bore expandability equally to the single inclusion extended to the length nearly equal to the rolling direction length of the inclusion group. The line in the rolling direction here means a virtual line extended in the rolling direction.

Thus, in order to evaluate the bore expandability, the inclusion having a shape as explained below and positioned as explained below was set to an object to be measured.

First, the inclusion to be measured was limited only to ones each having a major diameter of 3.0 μm or more. This is conceivably because the effect of the inclusion having a major diameter of less than 3.0 μm on the deterioration of the bore expandability is small. Further, the major diameter here means the longest diameter in a cross sectional shape of the inclusion to be observed, and is a diameter in the rolling direction in many cases.

Figure 4A:
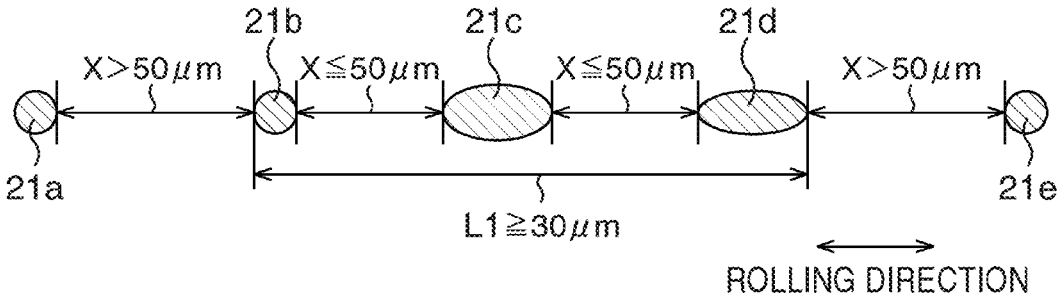
FIG. 4A is a view depicting an example of an inclusion group.

Then, a group of the inclusions aligned 50 μm or less apart from the adjacent different inclusion on the line in the rolling direction was regarded as a single inclusion group and a rolling direction length L1 of the inclusion group was measured, and the inclusion group having the rolling direction length L1 of 30 μm or more was set to an object to be evaluated. That is, in the case when the plural inclusions are aligned on the line in the rolling direction, if the two inclusions 50 μm or less apart from each other in the rolling direction exist, these are set to be contained in the single inclusion group, and further, if the different inclusion 50 μm or less apart from at least one of these two inclusions exits, this inclusion is also set to be contained in the inclusion group. Then, in the present invention, the inclusion group is defined by repetition of the positional relationship between such inclusions with each other. The number of inclusions contained in the inclusion group is only necessary to be two or more. For example, as depicted in FIG. 4A, it is set that five inclusions 21*a* to 21*e* each having a major diameter of 3.0 μm or more are aligned on the line in the rolling direction. Further, it is set that a spacing X between the inclusion 21*a* and the inclusion 21*b* exceeds 50 μm, the spacing X between the inclusion 21*b* and the inclusion 21*c* is 50 μm or less, the spacing X between the inclusion 21*c* and the inclusion 21*d* is 50 μm or less, and the spacing X between the inclusion 21*d* and the inclusion 21*e* exceeds 50 μm. In this case, a group of the inclusions 21*b* to 21*d* is regarded as one inclusion group, and if the rolling direction length Ll of the inclusion group is 30 μm or more, the inclusion group is set to an object to be evaluated.

Figure 4B:
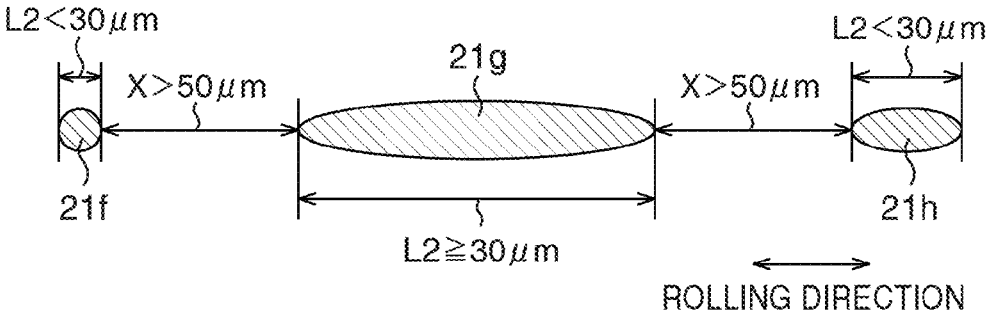
FIG. 4B is a view depicting an example of an extended inclusion.

Further, even though an inclusion spaced over 50 μm apart from the adjacent different inclusion on the line in the rolling direction existed, a rolling direction length L2 of the inclusion was measured and the inclusion having the rolling direction length L2 of 30 μm or more was set to an object to be evaluated. For example, as depicted in FIG. 4B, it is set that three inclusions 21*f* to 21*h* each having a major diameter of 3.0 μm or more are aligned on the line in the rolling direction. Further, it is set that the spacing X between the inclusion 21*f* and the inclusion 21*g* exceeds 50 μm, and the spacing X between the inclusion 21*g* and the inclusion 21*h* exceeds 50 μm. Further, it is set that the rolling direction length L2 of each of the inclusion 21*f* and the inclusion 21*h* is less than 30 μm, and the rolling direction length L2 of the inclusion 21*g* is 30 μm or more. In this case, the inclusion 21*g* is set to an object to be evaluated. It should be noted that, in a case when another inclusion exists 50 μm or less apart in the direction perpendicular to the rolling direction as will be described later, it is set that with the another inclusion, the inclusion group is composed.

Incidentally, the reason why the object to be measured was limited to the inclusion group having the rolling direction length L1 of 30 μm or more and the inclusion having the rolling direction length L2 of 30 μm or more is conceivably because the effect of the inclusion group having the rolling direction length L1 of less than 30 μm and the inclusion having the rolling direction length L2 of less than 30 μm on the deterioration of the bore expandability is small.

Figure 4C:
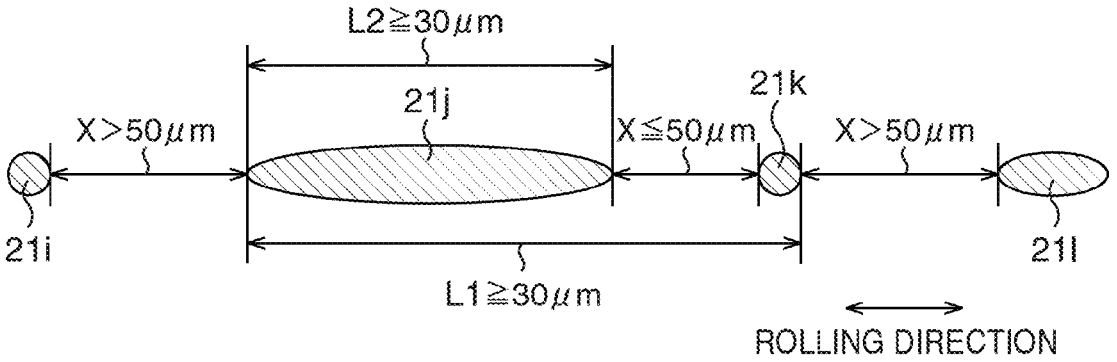
FIG. 4C is a view depicting another example of the inclusion group.

As is clear from the above-described explanation, even though the inclusion having the rolling direction length of 30 μm or more exists, if the inclusion exists 50 μm or less apart from the adjacent different inclusion on the line in the rolling direction, the inclusion is part of an inclusion group. For example, as depicted in FIG. 4C, it is set that four inclusions 21*i* to 21*l* each having a major diameter of 3.0 μm or more are aligned on the line in the rolling direction. Further, it is set that the spacing X between the inclusion 21*i* and the inclusion 21*j* exceeds 50 μm, the spacing X between the inclusion 21*j* and the inclusion 21*k* is 50 μm or less, and the spacing X between the inclusion 21*k* and the inclusion 21l exceeds 50 μm. Further, it is set that the rolling direction length L2 of each of the inclusions 21*i*, 21*k*, and 21*l* is less than 30 μm, and the rolling direction length L2 of the inclusion 21*j* is 30 μm or more. In this case, a group of the inclusions 21*j* and 21*k* is regarded as one inclusion group, and this inclusion group is set to an object to be evaluated. Hereinafter, the inclusion that is not contained in any one of the inclusion groups and has the rolling direction length L2 of 30 μm or more is sometimes called the "extended inclusion."

Further, even if between the two inclusions that do not exist on a line in the rolling direction strictly and each have a major diameter of 3.0 μm or more, a spacing in the direction perpendicular to the rolling direction is 50 μm or less, the large stress concentration sometimes occurs in the vicinity of these inclusions. Thus, even though a group of the plural inclusions that are not aligned on the line in the rolling direction exists, if a spacing in the rolling direction between the inclusions and a spacing in the direction perpendicular to the rolling direction between the inclusions are each 50 μm or less, the inclusions are regarded to compose one inclusion group.

Figure 4D:
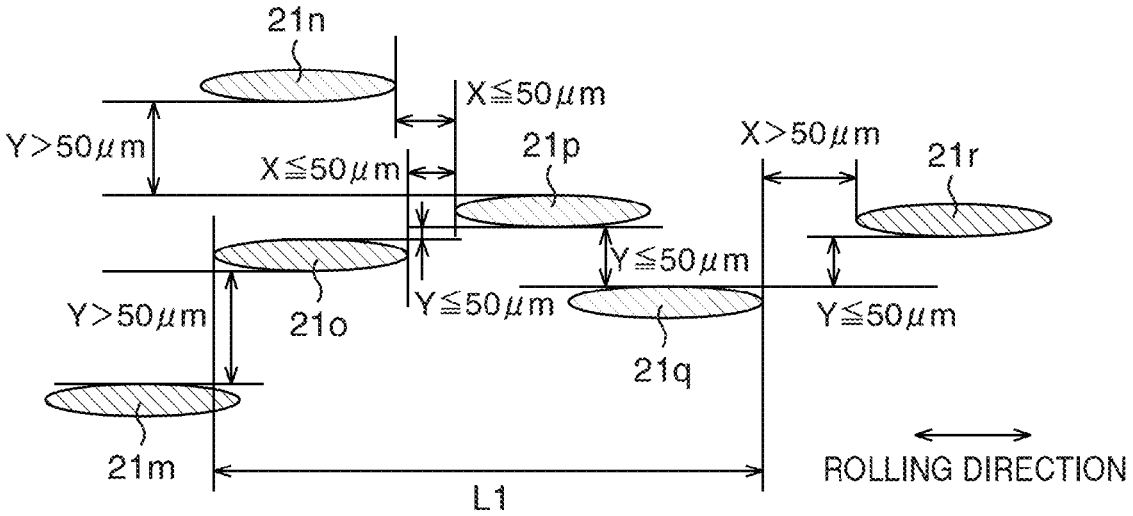
FIG. 4D is a view depicting still another example of the inclusion group.

For example, as depicted in FIG. 4D, it is set that six inclusions 21*m* to 21*r* each having a major diameter of 3.0 μm or more are dispersed in the steel sheet. Further, it is set that the spacing X in the rolling direction between the inclusion 21*o* and the inclusion 21*p* and a spacing Y in the direction perpendicular to the rolling direction between the inclusion 21*o* and the inclusion 21*p* are each 50 μm or less, and the spacing X in the rolling direction between the inclusion 21*p* and the inclusion 21*q* and the spacing Y in the direction perpendicular to the rolling direction between the inclusion 21*p* and the inclusion 21*q* are each 50 μm or less. Further, it is set that the spacing Y in the direction perpendicular to the rolling direction between the inclusion 21*m* and the inclusion 210 exceeds 50 μm, the spacing Y in the direction perpendicular to the rolling direction between the inclusion 21*n* and the inclusion 21*p* exceeds 50 μm, and the spacing X in the rolling direction between the inclusion 21*q* and the inclusion 21*r* exceeds 50 μm. In this case, a group of the inclusions 21*o* to 21*q* is regarded as one inclusion group, and if the rolling direction length L1 of this inclusion group is 30 μm or more, this inclusion group is set to an object to be evaluated.

Figure 4E:
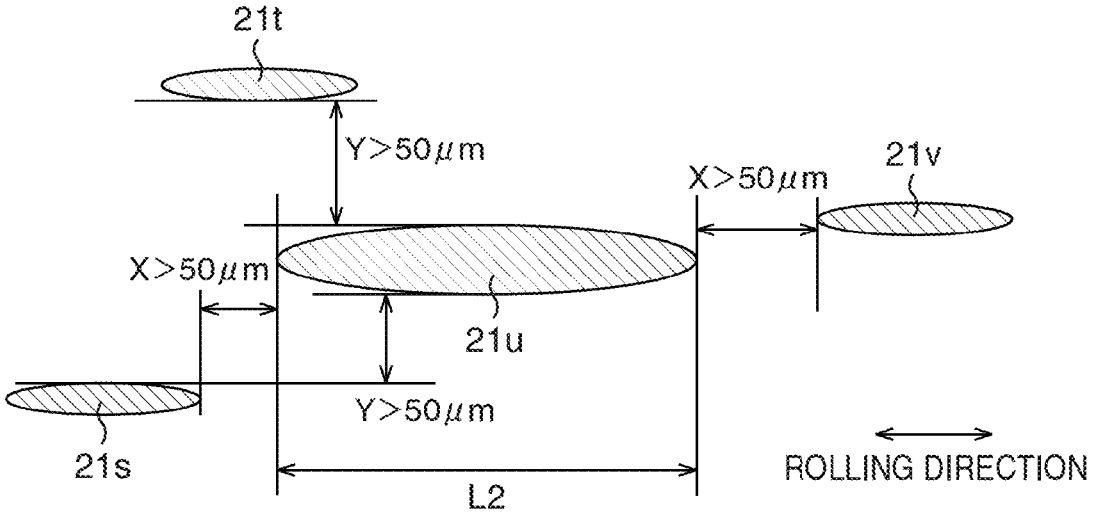
FIG. 4E is a view depicting another example of the extended inclusion.

Further, for example, as depicted in FIG. 4E, it is set that four inclusions 21*s* to 21*v* each having a major diameter of 3.0 μm or more are dispersed in the steel sheet. Further, it is set that the spacing X in the rolling direction between the inclusion 21*s* and the inclusion 21*u* and the spacing Y in the direction perpendicular to the rolling direction between the inclusion 21*s* and the inclusion 21*u* each exceed 50 μm, the spacing Y in the direction perpendicular to the rolling direction between the inclusion 21*t* and the inclusion 21*u* exceeds 50 μm, and the spacing X in the rolling direction between the inclusion 21*v* and the inclusion 21*u* exceeds 50 μm. Further, it is set that the rolling direction length L2 of the inclusion 21*u* is 30 μm or more. In this case, the inclusion 21*u* is regarded as one extended inclusion to be set to an object to be evaluated. However, if the spacing X in the rolling direction between the inclusion 21*t* and the inclusion 21*u* and the spacing Y in the direction perpendicular to the rolling direction between the inclusion 21*t* and the inclusion 21*u* are each 50 μm or less, even in a case when they are not aligned on the line in the rolling direction, a group of the inclusion 21*t* and the inclusion 21*u* is regarded as one inclusion group.

In the evaluation of the bore expandability, first, the rolling direction length L1 of all the inclusion groups observed in a single visual field, and the rolling direction length L2 of all the extended inclusions observed in the same visual field were measured and a sum total L (mm) of the rolling direction lengths L1 and L2 was obtained. Next, a numerical value M ($mm/mm^2$) was obtained with the obtained sum total L based on Mathematical expression 7 below, and the obtained numerical value M was defined as the sum total M of the rolling direction length of the inclusion group and the extended inclusion per unit area (1 $mm^2$) (hereinafter, the sum total M of the rolling direction length of the inclusion group and the extended inclusion is sometimes called the "the sum total M of the rolling direction length of the inclusion."). Then, the relation between this sum total M and the bore expandability was examined. Note that S in Mathematical expression 7 is an area of the observed visual field ($mm^2$).

$$M=L/S \qquad \text{Mathematical expression 7}$$

Here, the reason why from the sum total L of the rolling direction length of the inclusion group and the extended inclusion, not the average of the rolling direction length but the sum total M per unit area was obtained is because of the following reason.

It is conceivable that during deformation of a steel sheet, when the number of inclusion groups and extended inclusions (inclusion group and so on) is small, the crack propagates in a manner that voids generated around these inclusion group and so on are not connected, but when the number of inclusion group and so on is large, voids around the inclusion group and so on are connected continuously to form a long continuous void, and thereby the ductile fracture is promoted. Such an effect of the number of the inclusion group and so on cannot be indicated by the average of the rolling direction length of the inclusion group and so on, but can be indicated by the sum total M per unit area. From such a point of view, the sum total M per unit area of the rolling direction length of the inclusion group and so on was obtained.

Then, details will be described later, but according to the test conducted by the present inventors, with regard to the inclusion group and the extended inclusion each having the length in the rolling direction of 30 μm or more, a clear correlation existed between the sum total M of the rolling direction length of the inclusion and the average λave of the bore expansion ratio. On the other hand, with regard to the inclusion group and the extended inclusion each having the length in the rolling direction of 30 μm or more, a significant correlation was not seen between the average of the rolling direction length of the inclusion group and so on and the average λave of the bore expansion ratio. That is, it turned out that it is difficult to indicate the degree of the bore expandability by the average of the rolling direction length of the inclusion group and so on.

Further, during deformation of a steel sheet, in a portion of the stress being concentrated by the deformation, the crack occurs and propagation of the crack occurs starting from the inclusion group and the extended inclusion. In a case when the sum total M of the rolling direction length of the inclusion is large, in particular, the above tendency becomes strong, and thus the crack occurrence resistance value Jc and the crack propagation resistance value T. M. are decreased. Further, the Charpy absorbed energy being the energy required for the fracture of the test piece in a temperature zone where the ductile fracture occurs is an index affected by both of the crack occurrence resistance value Jc and the crack propagation resistance value T. M. Therefore, in a case when the sum total M of the rolling direction length of the inclusion is large, the crack occurrence resistance value Jc and the crack propagation resistance value T. M. are decreased, and the Charpy absorbed energy is also decreased.

From such a point of view, in the fundamental research, the bore expandability and the fracture property were evaluated by using the sum total M of the rolling direction length of the inclusion, the average λave of the bore expansion ratio, the crack occurrence resistance value Jc, the crack propagation resistance value T. M., the Charpy absorbed energy, and so on.

Further, in the examination of an inclusion, as for each of the inclusions in a visual field, a major diameter/minor diameter ratio of the inclusion expressed by a major diameter of the inclusion/a minor diameter of the inclusion was measured, and the maximum out of the major diameter/minor diameter ratios of the inclusions in the visual field was identified. This is because even in a case of the sum total M of the rolling direction length of the inclusion being equal, when the shape of each of the inclusions is circle and the major diameter/minor diameter ratio is small, the stress concentration in the vicinity of the inclusion is decreased during deformation of the steel sheet, and the average λave of the bore expansion ratio, the crack occurrence resistance value Jc, and the Charpy absorbed energy are made better. Further, by the experiment, it was found that a correlation exists between the maximum of the major diameter/minor diameter ratio of the inclusion and the standard deviation σ of the bore expansion ratio, and thus also from the point of view of evaluating the standard deviation σ of the bore expansion ratio, the maximum of the major diameter/minor diameter ratio of the inclusion was measured.

The steel sheet obtained under the hot rolling conditions as described above was one of which the tensile strength is distributed in a range of 780 to 830 MPa and the microstructure is the ferrite structure or the bainite structure as a main phase.

Figure 5A:
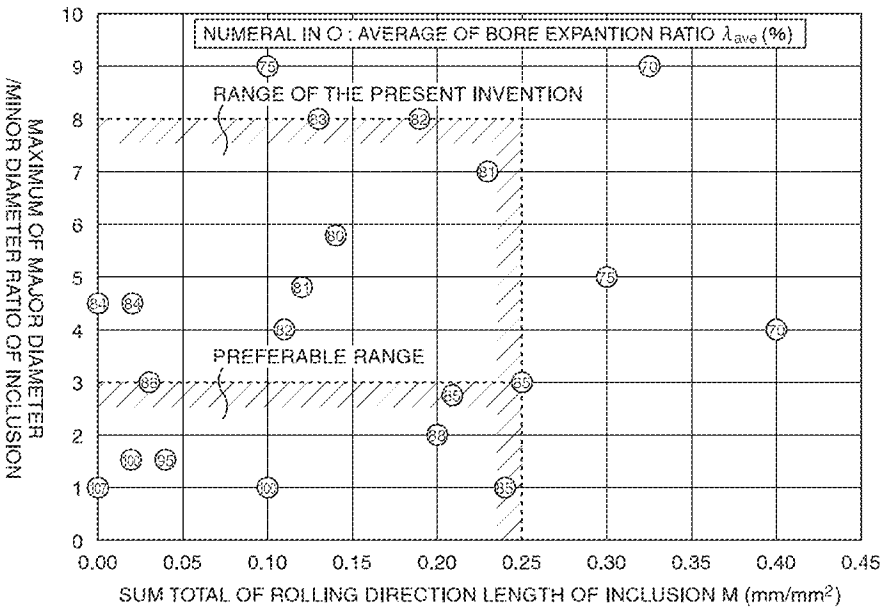
FIG. 5A is a view depicting a relationship between a sum total M of a rolling direction length of an inclusion, a maximum of a major diameter/minor diameter ratio of an inclusion, and an average λave of a bore expansion ratio.
Figure 5B:
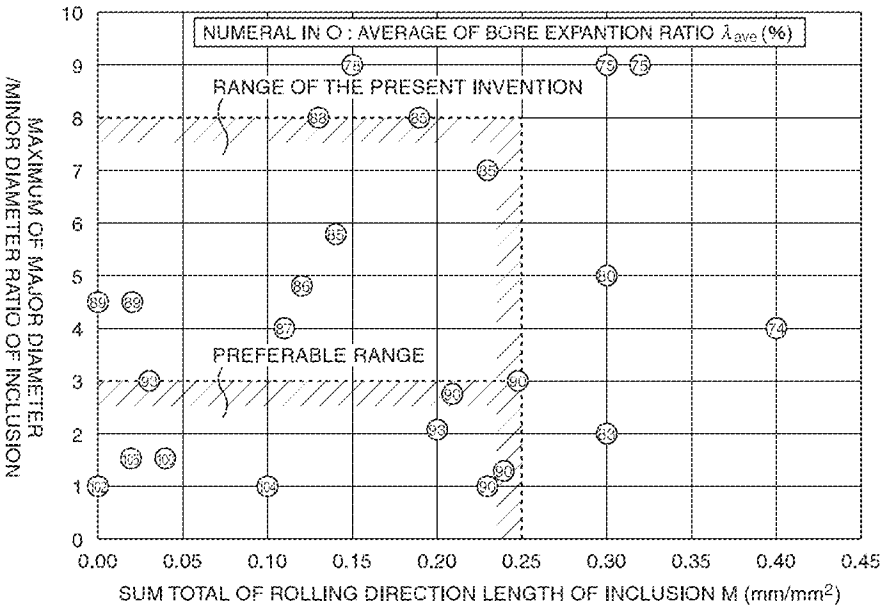
FIG. 5B is a view depicting the relationship between a sum total M of a rolling direction length of an inclusion, a maximum of a major diameter/minor diameter ratio of an inclusion, and an average λave of a bore expansion ratio similarly.
Figure 6A:
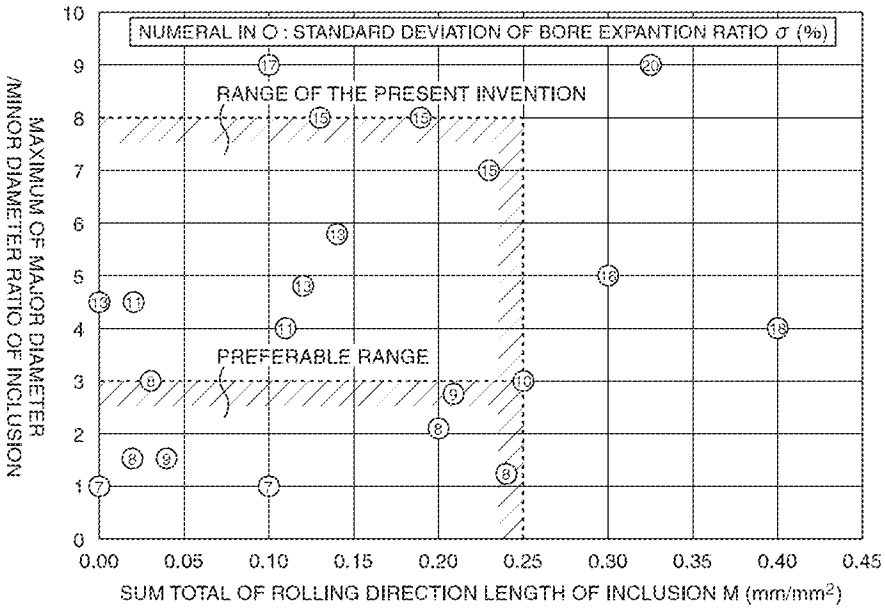
FIG. 6A is a view depicting a relationship between a sum total M of a rolling direction length of an inclusion, a maximum of a major diameter/minor diameter ratio of an inclusion, and a standard deviation σ of a bore expansion ratio.
Figure 6B:
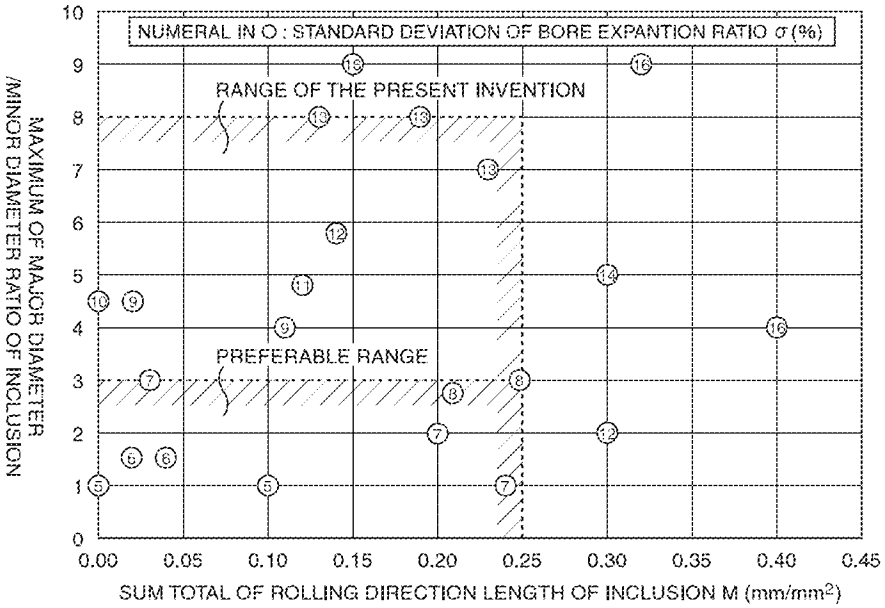
FIG. 6B is a view depicting the relationship between a sum total M of a rolling direction length of an inclusion, a maximum of a major diameter/minor diameter ratio of an inclusion, and a standard deviation σ of a bore expansion ratio similarly.
Figure 7:
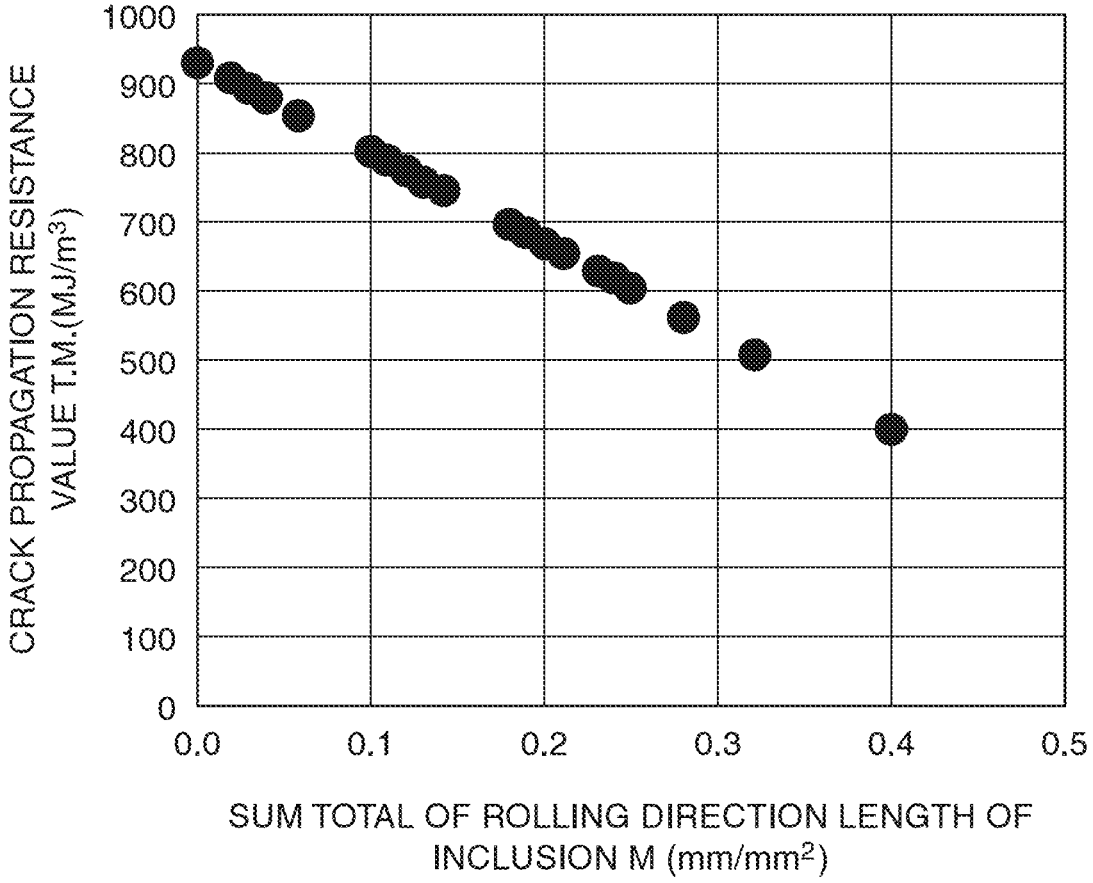
FIG. 7 is a view depicting a relationship between a sum total M of a rolling direction length of an inclusion and a crack propagation resistance value T. M.

FIG. 5A and FIG. 5B are views each depicting the relationship between the sum total M of the rolling direction length of the inclusion, the maximum of the major diameter/minor diameter ratio of the inclusion, and the average λave of the bore expansion ratio. FIG. 6A and FIG. 6B are views each depicting the relationship between the sum total M of the rolling direction length of the inclusion, the maximum of the major diameter/minor diameter ratio of the inclusion, and the standard deviation σ of the bore expansion ratio. FIG. 7 is a view depicting the relationship between the sum total M of the rolling direction length of the inclusion and the crack propagation resistance value T. M. FIG. 5A and FIG. 6A each depict the relationship of the case of using the steel compositions 1A1 to 1W3 listed in Table 4, and FIG. 5B and FIG. 6B each depict the relationship of the case of using the steel compositions 2A1 to 2W3 listed in Table 8. FIG. 7 depicts the relationship in the case of using a steel containing, in mass %, C, 0.03% to 0.04%, Si: 0.01% to 1.05%, Mn: 0.7% to 1.9%, P: 0.0008% to 0.01%, S: 0.001% to 0.005%, Al: 0.02% to 0.04%, Ti: 0.12% to 0.18%, REM: 0% to 0.004%, Ca: 0% to 0.004%, Nb: 0% to 0.04%, and V: 0% to 0.02%, and the balance being composed of Fe and inevitable impurities.

It is found that as depicted in FIG. 5A and FIG. 5B, the average λave of the bore expansion ratio of the steel sheet is better as the sum total M of the rolling direction length of the inclusion is smaller and the maximum of the major diameter/minor diameter ratio is smaller. Further, it is found that as depicted in FIG. 6A and FIG. 6B, the standard deviation σ of the bore expansion ratio is better as the maximum of the major diameter/minor diameter ratio of the inclusion is smaller. Incidentally, the experimental results depicted in FIG. 5A, FIG. 5B, FIG. 6A, and FIG. 6B satisfy the conditions of the hot-rolled steel sheet according to the present invention in terms of the X-ray random intensity ratio of the {211} plane (which is also called the {211} plane intensity, hereinafter), and so on, except the condition regarding the sum total M of the rolling direction length of the inclusion and the condition regarding the maximum of the major diameter/minor diameter ratio.

It is found from FIG. 5A, FIG. 5B, FIG. 6A, and FIG. 6B that, when the sum total M of the rolling direction length of the inclusion is 0.25 mm/mm$^2$ or less and the maximum of the major diameter/minor diameter ratio is 8.0 or less, the average λave of the bore expansion ratio can be 80% or more and the standard deviation σ can be 15% or less. Further, it is also found that, when the maximum of the major diameter/minor diameter ratio is 3.0 or less, the average λave of the bore expansion ratio can be 85% or more and the standard deviation σ can be 10% or less. Thus, in the present invention, as for the inclusions each having a major diameter of 3.0 μm or more, the sum total M of the rolling direction length of the inclusion is set to 0.25 mm/mm$^2$ or less and the maximum of the major diameter/minor diameter ratio of the inclusion is set to 8.0 or less. Further, the maximum of the major diameter/minor diameter ratio of the inclusion is preferably set to 3.0 or less.

Further, it is important to improve the crack propagation resistance value T. M. in order to prevent fracture of a steel sheet composing a structure member. The crack propagation resistance value T. M., as depicted in FIG. 7, relays on the sum total M of the rolling direction length of the inclusion, and it turned out that as the sum total M of the rolling direction length of the inclusion is increased, the crack propagation resistance value T. M. is decreased.

Further, the present inventors found that the inclusion group and the extended inclusion are MnS extended by the rolling and a residue of a desulfurization material applied for desulfurization at a steelmaking stage. As described above, the inclusion group and the extended inclusion increase the sum total M of the rolling direction length and the maximum of the major diameter/minor diameter ratio of the inclusion to cause the deterioration of the bore expandability, the crack propagation resistance value T. M., and so on. The present inventors found that in a case of REM and Ca being added, the shapes of precipitates such as CaS which precipitates in a manner not to use oxide or sulfide of REM as a nucleus and calcium aluminate being a mixture of CaO and alumina are also extended in the rolling direction slightly. The present inventors found that these inclusions also increase the sum total M of the rolling direction length and the maximum of the major diameter/minor diameter ratio of the inclusion to cause the deterioration of the bore expandability and so on.

Then, as a result of investigating a manufacturing method for suppressing these inclusions in order to achieve the improvement of the bore expandability, the crack propagation resistance value T. M., and so on, it turned out that the following conditions are important.

First, for suppressing MnS, it is important to decrease the content of S which bonds to Mn. Therefore, in the present invention, the S content is set to 0.01% or less. Further, in the Ti-added steel, TiS is formed at a temperature higher than a temperature zone where MnS is formed, so that it is possible to decrease the content of S which bonds to Mn. Even in the steel having REM and Ca added thereto, similarly it is possible to decrease the content of S which bonds to Mn by precipitating sulfides of REM and Ca. Thus, for suppressing MnS, it is important to contain Ti, REM, and Ca in a larger proportion than the total content of S stoichiometrically.

Figure 8:
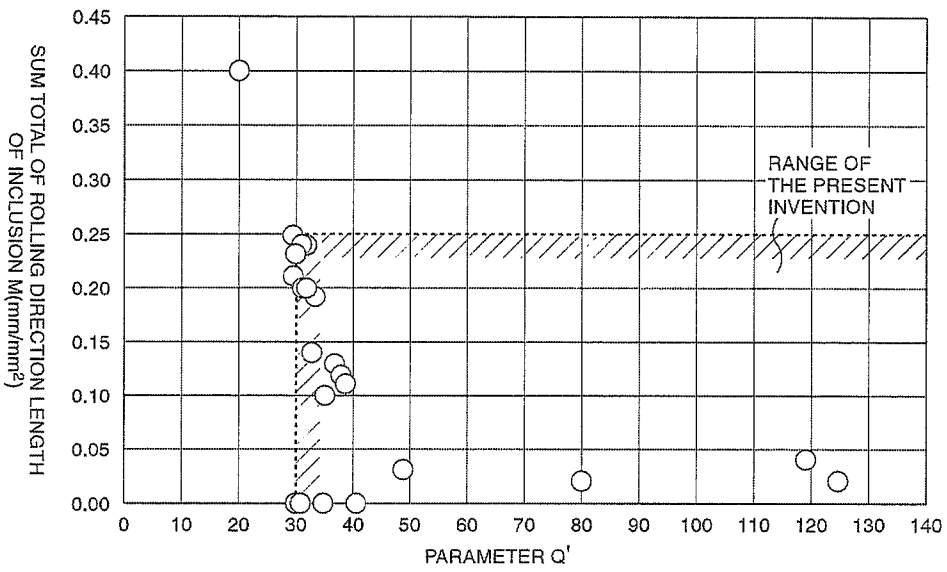
FIG. 8 is a view depicting a relationship between a numerical value of a parameter Q' and a sum total M of a rolling direction length of an inclusion.

As a result of examining the relationship between the numerical value of the parameter Q' expressed by the Mathematical expression 1' and the sum total M of the rolling direction length of the inclusion based on such an idea, it turned out that as depicted in FIG. 8, when the numerical value of the parameter Q' is 30.0 or more, the sum total M of 0.25 mm/mm$^2$ or less, which is required in the present invention, can be obtained. FIG. 8 depicts the relationship in the case of using a steel similar to that in FIG. 7. Further, it also turned out that, when the numerical value of the parameter Q' is 30.0 or more, the maximum of the major diameter/minor diameter ratio of the inclusion of 8.0 or less, which is required in the present invention, can be obtained, though not illustrated. Then, in the present invention, the value of the parameter Q' is set to 30.0 or more. Incidentally, in the case when REM and Ca are not contained in the steel, the parameter Q expressed by the Mathematical expression 1 may be used in place of the parameter Q'. Here, it is also conceivable to simply decrease the S content in order to suppress the content of MnS, but in this case, a manufacturing load in a desulfurization process is increased and additionally the desulfurization material used in the desulfurization process may remain, and consequently, the content of the extended inclusions is increased. Therefore, it is particularly effective to set the numerical value of the parameter Q' to 30.0 so that the content of MnS may be suppressed not by decreasing the S content but by increasing the contents of Ca and REM.

[Mathematical expression 4]

(Mathematical expression 1)

$$Q = \frac{[\mathrm{Ti}]}{48} \Big/ \frac{[\mathrm{S}]}{32}$$

(Mathematical expression 1')

$$Q' = \frac{[\mathrm{Ti}]}{48} \Big/ \frac{[\mathrm{S}]}{32} + \left\{ \frac{[\mathrm{Ca}]}{40} \Big/ \frac{[\mathrm{S}]}{32} + \frac{[REM]}{140} \Big/ \frac{[\mathrm{S}]}{32} \right\} \times 15.0$$

Further, the present inventors examined the relationship between the numerical value of ([REM]/140)/([Ca]/40) and the maximum of the major diameter/minor diameter ratio of the inclusion in terms of decreasing precipitates such as CaS which precipitates in a manner not to use oxide or sulfide of REM as a nucleus. As a result, it turned out that, when the numerical value of ([REM]/140)/([Ca]/40) is 0.3 or more, the maximum of the major diameter/minor diameter ratio of 3.0 or less, which is the preferable condition of the present invention, can be obtained, though not illustrated. Thus, as the condition of setting the maximum of the major diameter/minor diameter ratio of the inclusion to 3.0 or less, Mathematical expression 8 below is preferably satisfied.

$$0.3 \leq ([\mathrm{REM}]/140)/([\mathrm{Ca}]/40) \qquad \text{(Mathematical expression 8)}$$

The reason why, when the numerical value of ([REM]/140)/([Ca]/40) is 0.3 or more, 3.0 or less of the maximum of the major diameter/minor diameter ratio can be obtained is conceivably because of the following reason. In a case when a much larger amount of REM than Ca is added, CaS and so on crystallize or precipitate in a manner to use spherical oxide or sulfide of REM as a nucleus, and generally spherical precipitates precipitate. On the other hand, when the proportion of REM to Ca is decreased, oxide or sulfide of REM to be a nucleus is decreased, and thus a lot of extended-shaped precipitates such as CaS precipitate in a manner not to use oxide or sulfide of REM as a nucleus. Then, as a result, it is conceivable that the major diameter/minor diameter ratio of the inclusion is affected.

Further, in the present invention, for decreasing calcium aluminate, the Ca content is set to 0.02% or less.

Figure 9A:
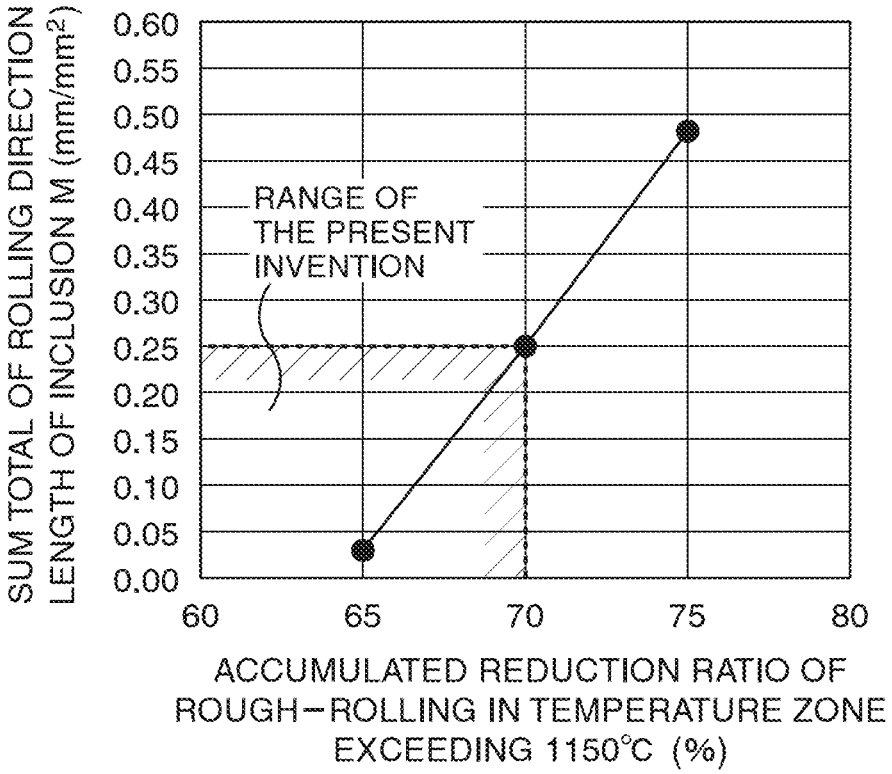
FIG. 9A is a view depicting an example of a relationship of a sum total M of a rolling direction length of an inclusion with respect to an accumulated reduction ratio of rough-rolling in a temperature zone exceeding 1150° C.
Figure 9B:
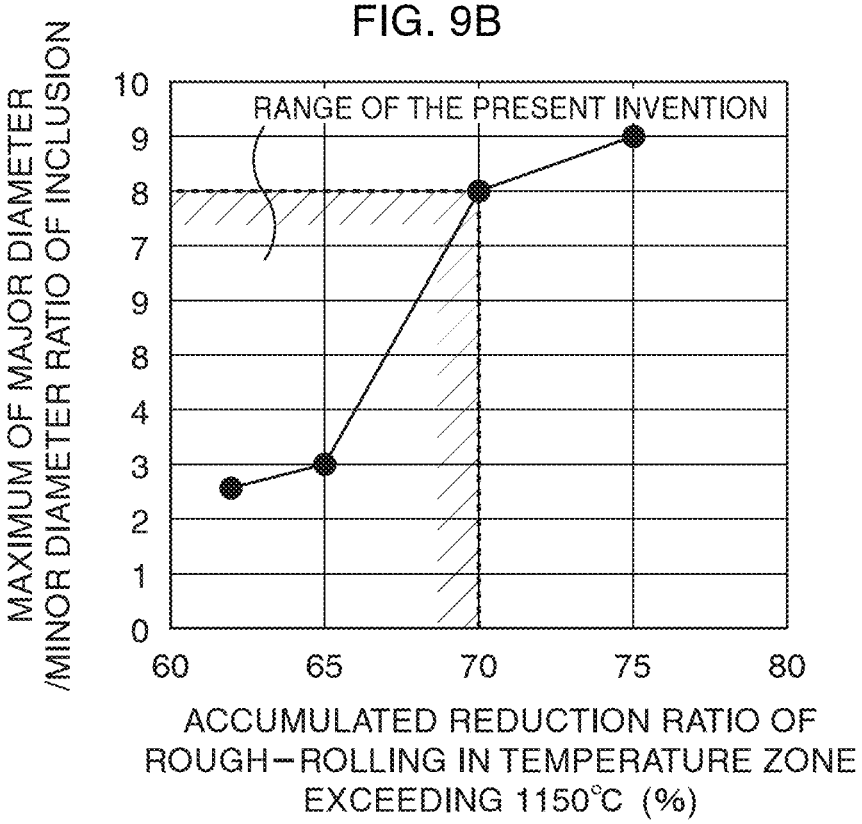
FIG. 9B is a view depicting an example of a relationship of a maximum of a major diameter/minor diameter ratio of an inclusion with respect to an accumulated reduction ratio of rough-rolling in a temperature zone exceeding 1150° C.
Figure 9C:
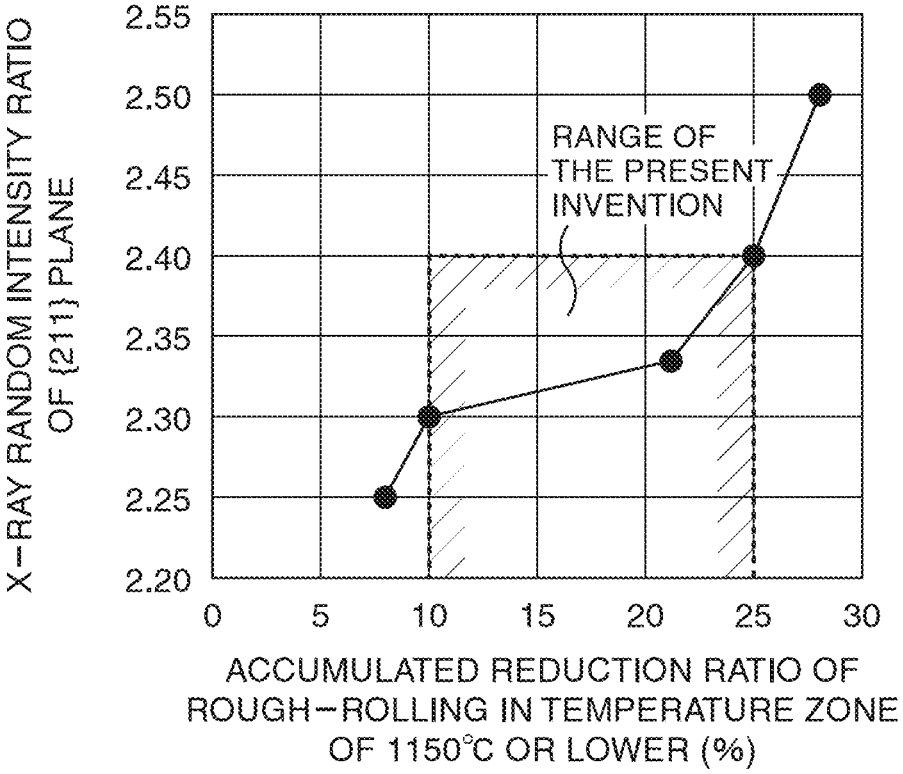
FIG. 9C is a view depicting an example of a relationship of a {211} plane intensity with respect to an accumulated reduction ratio in a temperature zone of 1150° C. or lower.
Figure 9D:
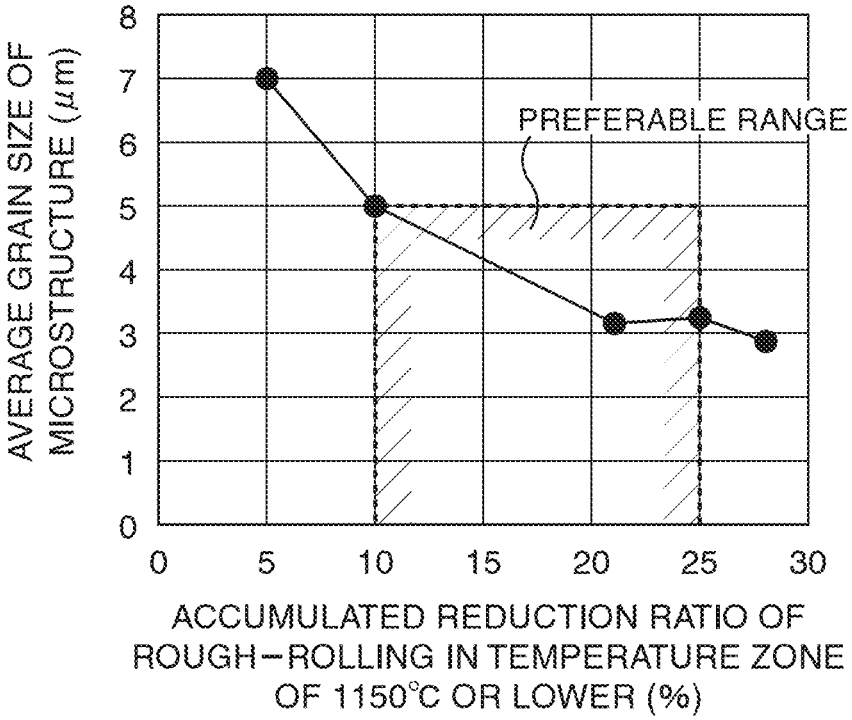
FIG. 9D is a view depicting an example of a relationship of an average grain size of a microstructure with respect to an accumulated reduction ratio in a temperature zone of 1150° C. or lower.
Figure 10A:
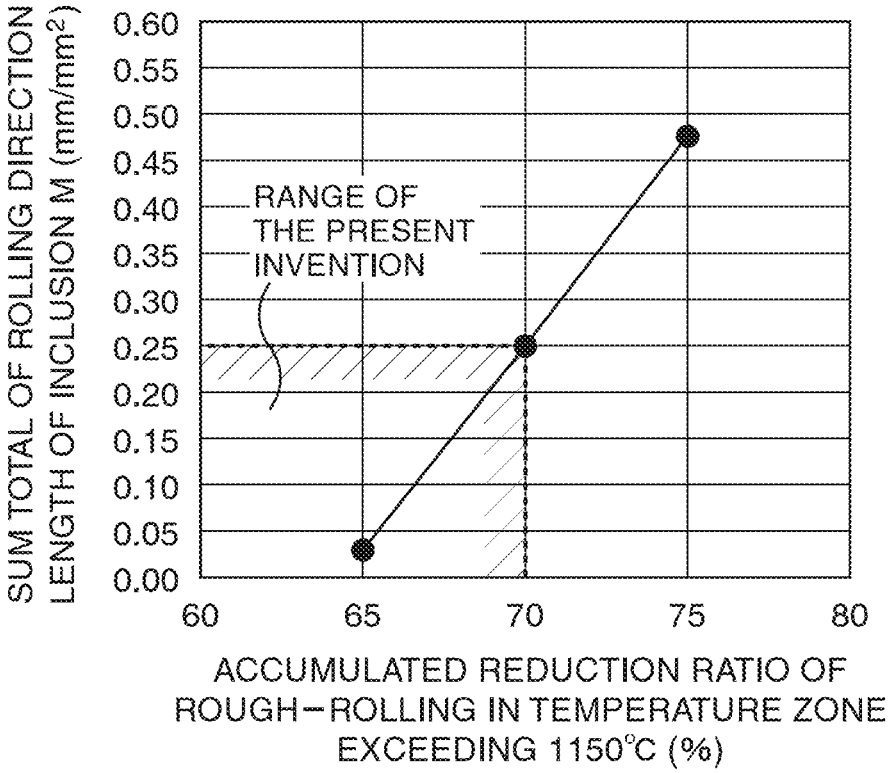
FIG. 10A is a view depicting another example of the relationship of a sum total M of a rolling direction length of an inclusion with respect to an accumulated reduction ratio of rough-rolling in a temperature zone exceeding 1150° C.
Figure 10B:
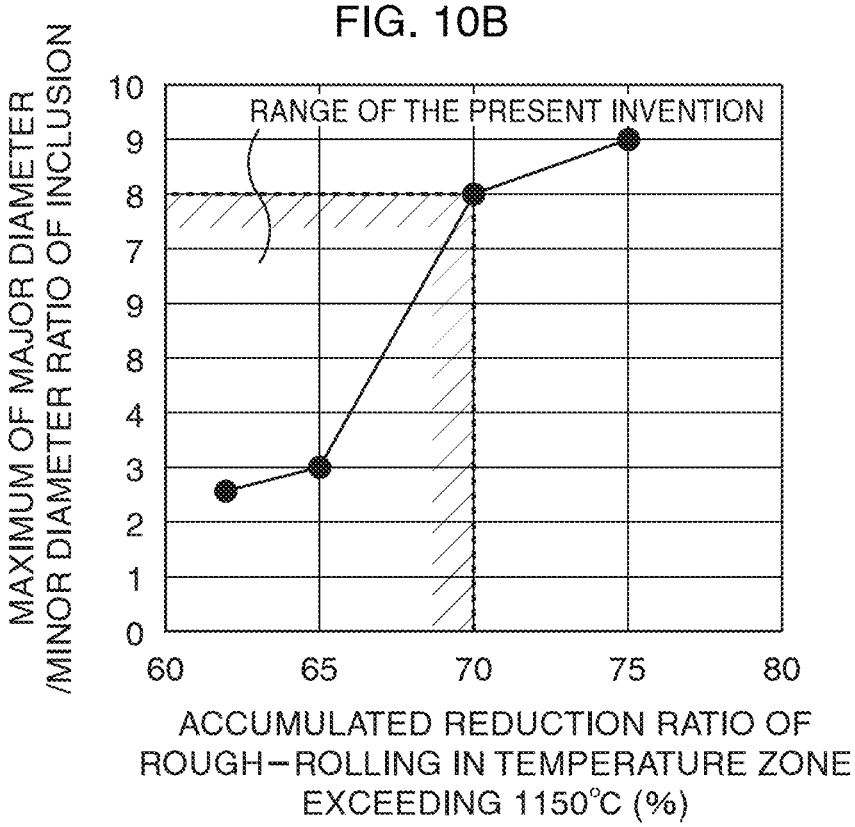
FIG. 10B is a view depicting another example of the relationship of a maximum of a major diameter/minor diameter ratio of an inclusion with respect to an accumulated reduction ratio of rough-rolling in a temperature zone exceeding 1150° C.
Figure 10C:
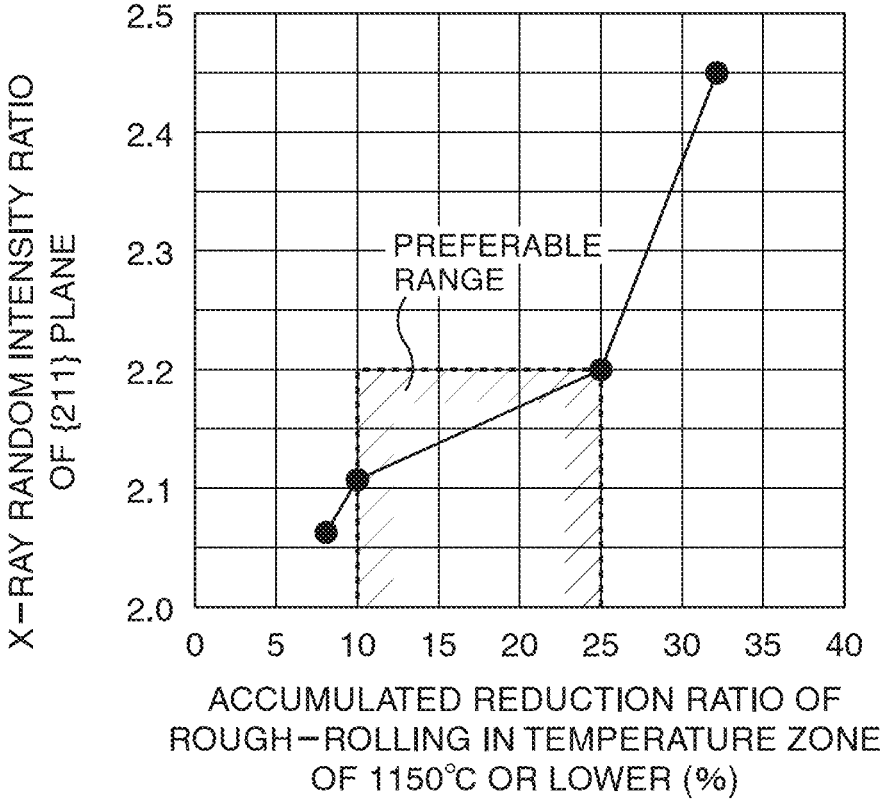
FIG. 10C is a view depicting another example of the relationship of a {211} plane intensity with respect to an accumulated reduction ratio in a temperature zone of 1150° C. or lower.
Figure 10D:
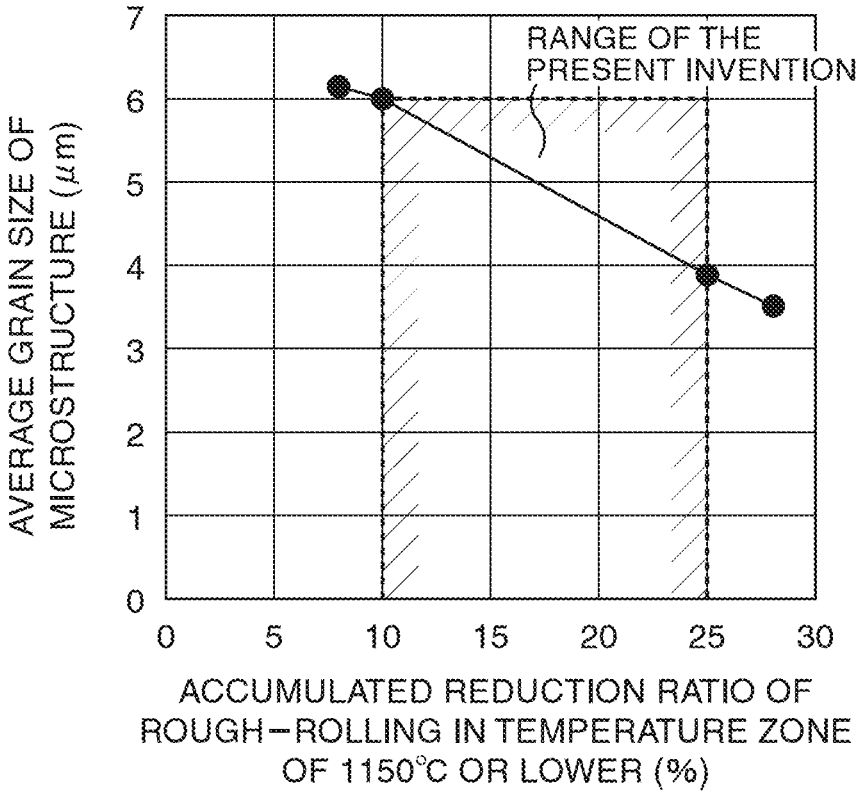
FIG. 10D is a view depicting another example of the relationship of an average grain size of a microstructure with respect to an accumulated reduction ratio in a temperature zone of 1150° C. or lower.

FIG. 9A depicts the relationship of the sum total M of the rolling direction length of the inclusion with respect to an accumulated reduction ratio of rough-rolling in a temperature zone exceeding 1150° C. in a sample steel made of a steel composition a listed in Table 1 below, and FIG. 9B depicts the relationship of the maximum of the major diameter/minor diameter ratio with respect to the accumulated reduction ratio of the rough-rolling in the temperature zone exceeding 1150° C. in the sample steel made of the steel composition a listed in Table 1 below. FIG. 9C depicts the relationship of the {211} plane intensity with respect to an accumulated reduction ratio in a temperature zone of 1150° C. or lower, and FIG. 9D depicts the relationship of the average grain size of the microstructure with respect to the accumulated reduction ratio in the temperature zone of 1150° C. or lower. Further, FIG. 10A depicts the relationship of the sum total M of the rolling direction length of the inclusion with respect to the accumulated reduction ratio of the rough-rolling in the temperature zone exceeding 1150° C. in a sample steel made of a steel composition b listed in Table 2 below, and FIG. 10B depicts the relationship of the maximum of the major diameter/minor diameter ratio with respect to the accumulated reduction ratio of the rough-rolling in the temperature zone exceeding 1150° C. in the sample steel made of the steel composition b listed in Table 2 below. FIG. 10C depicts the relationship of the {211} plane intensity with respect to the accumulated reduction ratio in the temperature zone of 1150° C. or lower, and FIG. 10D depicts the relationship of the average grain size of the microstructure with respect to the accumulated reduction ratio in the temperature zone of 1150° C. or lower. The accumulated reduction ratio of the rough-rolling here means the ratio of which a steel slab is reduced in each temperature zone based on the thickness of the steel slab before the rough-rolling. An accumulated reduction ratio R1 (%) of the rough-rolling in the temperature zone exceeding 1150° C. is defined by Mathematical expression 9 below. Further, an accumulated reduction ratio R2 (%) of the rough-rolling in the temperature zone of 1150° C. or lower is defined by Mathematical expression 10 below. Further, here a beginning temperature of finish-rolling was 1075° C., a fmishing temperature of the finish-rolling was set to 940° C., a cooling rate on a run-out-table (ROT: run-out-table) was 30° C./second, and a coiling temperature was 480° C.

[Mathematical expression 5]

$$R1 = \frac{t_{a1} - t_{b1}}{t_0} \times 100 \qquad \text{(Mathematical expression 9)}$$

$$R2 = \frac{t_{a2} - t_{b2}}{t_0} \times 100 \qquad \text{(Mathematical expression 10)}$$

($t_0$ indicates the thickness of the steel slab before the rough-rolling, $t_{a1}$ indicates the thickness of the steel slab before the first reduction in the temperature zone exceeding 1150° C., $t_{b1}$ indicates the thickness of the steel slab before the final reduction in the temperature zone exceeding 1150° C., $t_{a2}$ indicates the thickness of the steel slab before the first reduction in the temperature zone of 1150° C. or lower, and $t_{b2}$ indicates the thickness of the steel slab before the final reduction in the temperature zone of 1150° C. or lower.)

TABLE 1

| STEEL | CHEMICAL COMPONENT (MASS %) | | | | | | | | | | |
|---|---|---|---|---|---|---|---|---|---|---|---|
| COMPOSITION | C | Si | Mn | P | S | Al | N | Nb | Ti | REM | Ca |
| a | 0.037 | 0.95 | 1.29 | 0.006 | 0.001 | 0.027 | 0.0039 | 0.04 | 0.138 | 0.0010 | 0.0015 |

TABLE 2

| STEEL | CHEMICAL COMPOSITION (MASS %) | | | | | | | | | | | |
|---|---|---|---|---|---|---|---|---|---|---|---|---|
| COMPOSITION | C | Si | Mn | P | S | Al | N | V | Nb | Ti | REM | Ca |
| b | 0.037 | 0.95 | 1.29 | 0.006 | 0.001 | 0.027 | 0.0039 | 0.05 | — | 0.138 | 0.0010 | 0.0015 |

The symbol "—" means that the element is not added and that the content of the element is as low as inevitable impurities.

From the above, it is found that in a case of the accumulated reduction ratio in the temperature zone exceeding 1150° C. being in excess of 70%, the sum total M of the rolling direction length and the maximum of the major diameter/minor diameter ratio of the inclusion are both increased, thus making it impossible to obtain the sum total M of 0.25 mm/mm$^2$ or less and the maximum of the major diameter/minor diameter ratio of the inclusion of 8.0 or less. This is conceivably because as the accumulated reduction ratio of the rough-rolling performed in a high temperature zone such as the temperature zone exceeding 1150° C. is increased, the inclusions are more likely to be extended by the rolling.

Further, it is found that in a case of the accumulated reduction ratio in the temperature zone of 1150° C. or lower being less than 10%, the average grain size of the microstructure is increased to exceed 6 μm. This is conceivably because as the accumulated reduction ratio of the rough-rolling performed in a low temperature zone such as the temperature zone of 1150° C. or lower is decreased, the grain size of austenite after recrystallization is increased, and thus the average grain size of the microstructure in a final product is also increased.

Further, it is found that in a case of the accumulated reduction ratio in the temperature zone of 1150° C. or lower being in excess of 25%, the {211} plane intensity is increased to exceed 2.4. This is conceivably because when the accumulated reduction ratio of the rough-rolling performed in a relatively low temperature zone such as the temperature zone of 1150° C. or lower is too large, the recrystallization does not progress substantially completely after the rough-rolling, and a non-recrystallized structure to be the cause of increasing the {211} plane intensity remains even after the finish-rolling, and consequently the {211} plane intensity in a final product is increased.

Next, another fundamental research leading to the completion of the present invention will be explained.

The present inventors made steel slabs through melting and casting with compositions listed in Table 3 to manufacture hot-rolled steel sheets with the changing finishing temperature of the finish-rolling and the coiling temperature, which have a great effect on the materials of the hot-rolled steel sheet among the manufacturing processes of the hot-rolled steel sheet. Specifically, hot rolling was performed on the steel slabs under the condition of a heating temperature set to 1260° C. and the finishing temperature of the finish-rolling set to 750° C. to 1000° C., and then the steel slabs were cooled at an average cooling rate of about 40° C./sec and coiled at a temperature of 0° C. to 750° C. Thus, the hot-rolled steel sheets each having a thickness of 2.9 mm were manufactured. Then, various examinations were performed. In the following examinations, unless otherwise mentioned, samples each cut out from a ¼ position of the steel sheet width (a ¼ sheet width portion) or a ¾ position of the steel sheet width (a ¾ sheet width portion) were used.

TABLE 3

| STEEL | CHEMICAL COMPONENT (UNIT: MASS %) | | | | | | | | | |
|---|---|---|---|---|---|---|---|---|---|---|
| COMPOSITION | C | Si | Mn | P | S | Al | N | Nb | Ti | B |
| c | 0.083 | 0.31 | 1.89 | 0.011 | 0.004 | 0.038 | 0.0041 | 0.000 | 0.000 | 0.0000 |
| d | 0.040 | 1.01 | 1.22 | 0.012 | 0.004 | 0.037 | 0.0038 | 0.045 | 0.142 | 0.0000 |
| e | 0.042 | 0.97 | 1.24 | 0.011 | 0.005 | 0.041 | 0.0035 | 0.009 | 0.140 | 0.0007 |
| f | 0.047 | 0.89 | 1.33 | 0.013 | 0.005 | 0.029 | 0.0028 | 0.001 | 0.118 | 0.0011 |

In Table 3, Ti, Nb, and B are not contained in a steel composition c, and Ti and Nb are contained but B is not contained in a steel composition d. Further, Ti, Nb, and B are contained in a steel composition e, and Ti, B and a minute amount of Nb are contained in a steel composition f.

The present inventors investigated the condition of suppressing the peeling. By the research of the present inventors, it has been clarified that grain boundary number densities of solid solution C and solid solution B affect the occurrence of the peeling. Further, it has been found that the coiling temperature affects the grain boundary number densities of solid solution C and solid solution B.

Then, with respect to the obtained hot-rolled steel sheets, the existence or absence of cracking of a fractured face in the relationship between the coiling temperature and a grain boundary segregation density of solid solution C and solid solution B was examined. In this examination, the evaluation of the peeling and the measurement of the grain boundary number densities of solid solution C and solid solution B were performed in accordance with methods described below.

In the evaluation of the peeling, through a method similar to that described in JFS T 1001-1996 of the Japan Iron and Steel Federation Standard, punching was performed with the clearance set to 20%, and the existence or absence of peeling of the punched face was confirmed visually.

In the measurement of the grain boundary number densities of solid solution C and solid solution B, a three-dimensional atom probe method was used. A position sensitive atom probe (PoSAP: position sensitive atom probe) invented by A. Cerezo et al. at Oxford University in 1988 is an apparatus in which a position sensitive detector (position sensitive detector) is incorporated in a detector of the atom probe and that in analysis, is capable of simultaneously measuring time of flight and a position of an atom that has reached the detector without using an aperture. If the apparatus is used, it is possible to display all the constituent elements in alloy existing in the surface of the sample as a two-dimensional map with atomic-level spatial resolution. Further, an atomic layer is evaporated one by one from the surface of the sample through using an electric field evaporation phenomenon, and thereby the two-dimensional map can also be expanded in the depth direction to be displayed and analyzed as a three-dimensional map. For the observation of a grain boundary, an FB2000A manufactured by Hitachi, Ltd. was used as a focused ion beam (FIB) apparatus, and a grain boundary portion was made to be brought into an acicular tip portion with an arbitrary-shaped scanning beam in order to form the cut sample into an acicular shape by electrolytic polishing. In this manner, acicular samples for PoSAP each containing the grain boundary portion were made. Then, each of the acicular samples for PoSAP was observed to identify the grain boundary with the fact that grains different in orientation exhibit a contrast by a channeling phenomenon of a scanning ion microscope (SIM), and was cut with the ion beam. The apparatus used as a three-dimensional atom probe was an OTAP manufactured by CAMECA, and as the measurement condition, the temperature of a sample position was set to about 70 K, a probe total voltage was set to 10 kV to 15 kV, and a pulse ratio was set to 25%. Then, the grain boundary and grain interior of each of the samples were measured three times respectively, and an average of the measurement was set as a representative value. In this manner, solid solution C and solid solution B existing in the grain boundary and in the grain interior were measured.

The value obtained by eliminating background noise and the like from the measured value was defined as an atom density per unit area of grain boundary to be set as the grain boundary number density ($/nm^2$). Thus, solid solution C existing in the grain boundary is exactly a C atom existing in the grain boundary, and solid solution B existing in the grain boundary is exactly a B atom existing in the grain boundary. The grain boundary number density is also the grain boundary segregation density.

The total grain boundary number density of solid solution C and solid solution B in the present invention is the total density per unit area of grain boundary of solid solution C and solid solution B existing in the grain boundary. This value is a value obtained by adding the measured values of solid solution C and solid solution B.

The distribution of atoms is found on an atom map three-dimensionally, so that it can be confirmed that a large number of C atoms and B atoms are at the position of the grain boundary.

Figure 11A:
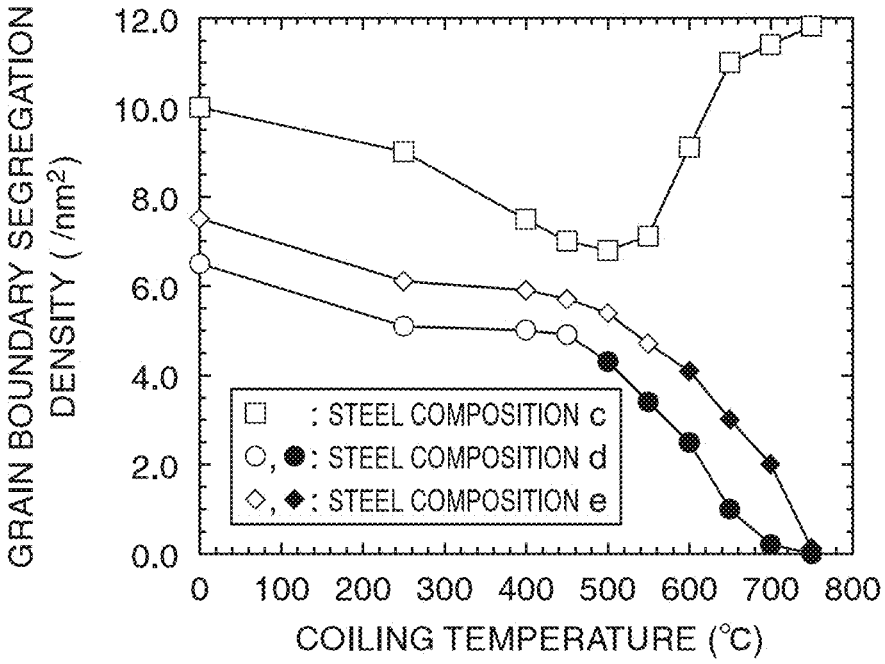
FIG. 11A is a view depicting an example of the existence or absence of peeling in a relationship between a total grain boundary number density of solid solution C and solid solution B and a coiling temperature.
Figure 11B:
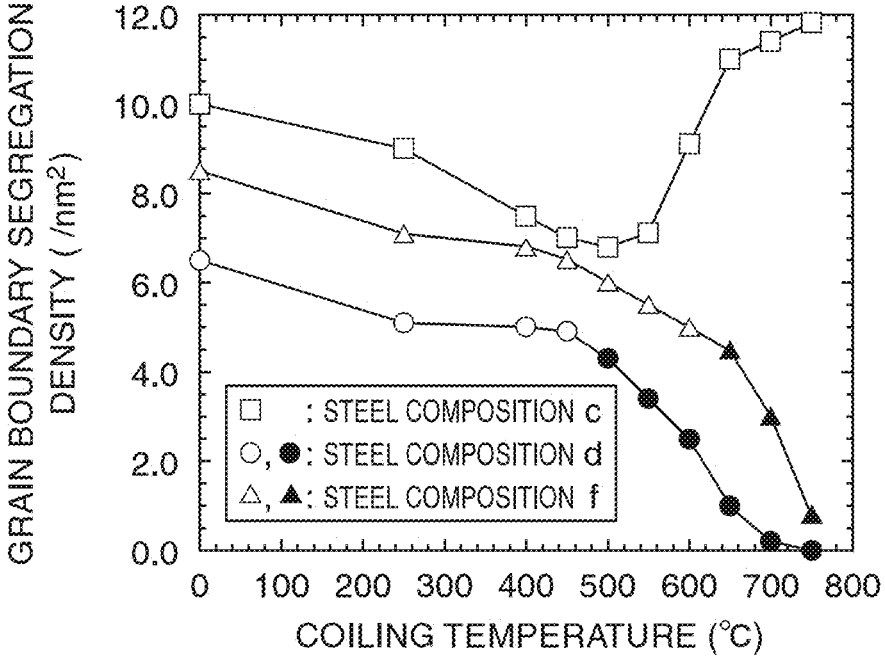
FIG. 11B is a view depicting another example of the existence or absence of peeling in a relationship between a total grain boundary number density of solid solution C and solid solution B and a coiling temperature.

Results of such examination are depicted in FIG. 11A and FIG. 11B. FIG. 11A depicts the existence or absence of peeling in the relationship between the total grain boundary number density of solid solution C and solid solution B and a coiling temperature (CT) in the steel compositions c, d, and e. FIG. 11B depicts the existence or absence of peeling in the relationship between the total grain boundary number density of solid solution C and solid solution B and the coiling temperature (CT) in the steel compositions c, d, and f. In FIG. 11A and FIG. 11B, outline marks (□, ○, ◇, Δ) each indicate that no peeling has occurred, and black marks (●, ♦, ▲) each indicate that slight peeling has occurred.

It was found from FIG. 11A and FIG. 11B that in a case of the grain boundary number density of solid solution C and solid solution B exceeding $4.5/nm^2$, the peeling can be suppressed effectively. The reason why the slight peeling has occurred at $4.5/nm^2$ or less is presumed because the strength at the grain boundary was relatively decreased as compared with that of the grain interior.

With regard to the relationship between the existence or absence of peeling and the coiling temperature, in the steel composition c not containing Ti and Nb substantially, the grain boundary number density of solid solution C and solid solution B was in excess of $4.5/nm^2$ even at any coiling temperature, and no peeling occurred. In contrast to this, in the steel compositions d to f each containing Ti and Nb, when the coiling temperature was increased, the grain boundary number density of solid solution C and solid solution B became $4.5/nm^2$ or less, and the peeling occurred.

This is presumed because, though in the steel composition c, Ti and Nb were not contained substantially, so that even though the coiling temperature was increased, precipitation of TiC and the like did not occur and the high grain boundary number density of solid solution C and solid solution B was kept, in the steel compositions d to f, when the coiling temperature was increased, solid solution C that had segregated in the grain boundary precipitated in the grain interior as TiC after the coiling mainly and thus the grain boundary number density of solid solution C was decreased.

Further, the reason why in the steel compositions e and f, the grain boundary number density exceeding $4.5/nm^2$ was obtained up to the coiling temperature higher than that of the steel composition d was because B was contained, and thus even though C precipitated in the grain interior as TiC, solid solution B segregated in the grain boundary and thereby the decrease in solid solution C in the grain boundary was compensated.

As a result that the present inventors further conducted various examinations of the obtained steel sheets in order to find the condition of further improving the bore expandability, it turned out that the effect of the size of grain boundary cementite on the bore expandability is particularly large. In this examination, similarly to the above-described method, plural test pieces, for example, 10 test pieces were made from a single sample steel, and were each subjected to a bore expansion test based on the method described in JFS T 1001-1996 of the Japan Iron and Steel Federation Standard, and the average λave of the bore expansion ratio was calculated. Further, the size of grain boundary cementite was measured according to a method described below.

First, a sample for a transmission electron microscope was taken from the position of the ¼ thickness of a sample cut out from a ¼ sheet width portion or a ¾ sheet width portion of the sample steel. Then, the sample was observed with a transmission electron microscope having a field emission gun (FEG) with an acceleration voltage of 200 kV mounted thereon. As a result, analyzing a diffraction pattern made it possible to confirm that precipitates observed in grain boundaries is cementite. Incidentally, in the present invention, the size of grain boundary cementite is defined as an average of a circle equivalent size of which all grain boundary cementite observed in a single visual field is measured by image processing or the like.

Figure 12A:
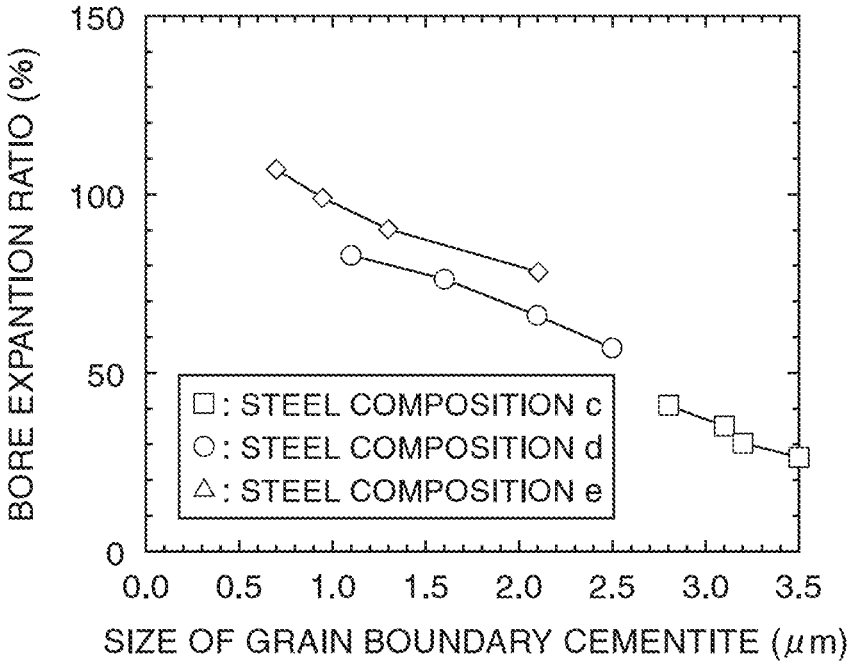
FIG. 12A is a view depicting an example of a relationship between a size of grain boundary cementite and a bore expansion ratio.
Figure 12B:
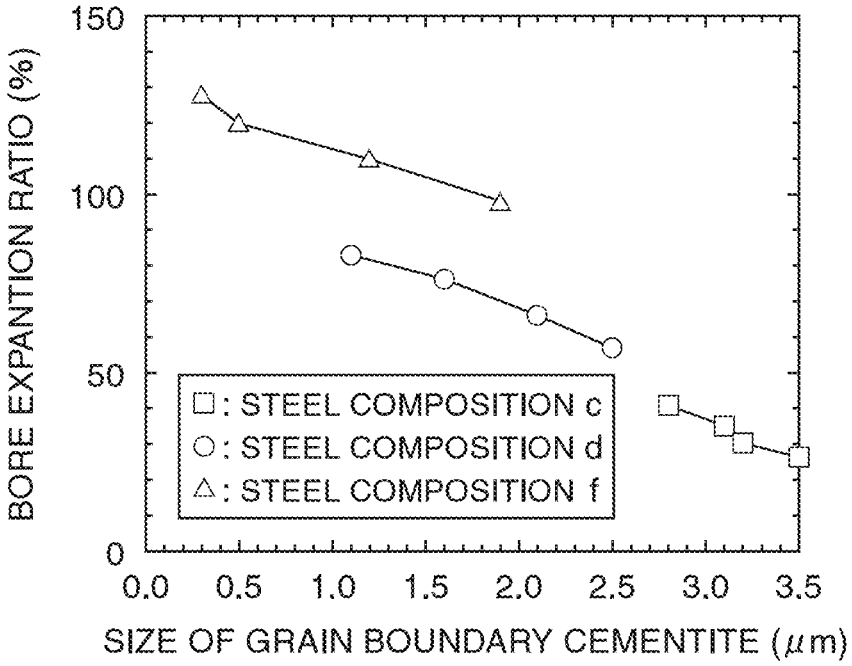
FIG. 12B is a view depicting another example of the relationship between a size of grain boundary cementite and a bore expansion ratio.

FIG. 12A depicts the relationship between the size of grain boundary cementite and the bore expansion ratio in the steel compositions c, d, and e. FIG. 12B depicts the relationship between the size of grain boundary cementite and the bore expansion ratio in the steel compositions c, d, and f.

It is found from FIG. 12A and FIG. 12B that a correlation exists between the bore expansion ratio and the size of grain boundary cementite. That is, it was newly found that as the size of grain boundary cementite is smaller, the bore expansion ratio is improved, and when the size of grain boundary cementite becomes 2 μm or less, the bore expansion ratio becomes 80% or more.

The reason why as the size of cementite existing in grain boundaries is smaller, the bore expansion ratio is improved is conceivably because of the following reason.

First, it is conceivable that stretch flanging workability and burring workability typified by the bore expansion ratio are affected by voids to be the origin of cracking formed during punching or shearing. It is conceivable that the voids occur because in the case when a cementite phase precipitated in grain boundaries of matrix is large in some degree with respect to matrix grains, the matrix grains are subjected to excessive stress in the vicinity of phase boundaries of the matrix grains. On the other hand, it is conceivable that in the a case when the size of grain boundary cementite is small, cementite is relatively small with respect to the matrix grains and mechanically, the stress concentration does not occur and the voids do not occur easily, and thus the bore expansion ratio is improved.

Figure 13A:
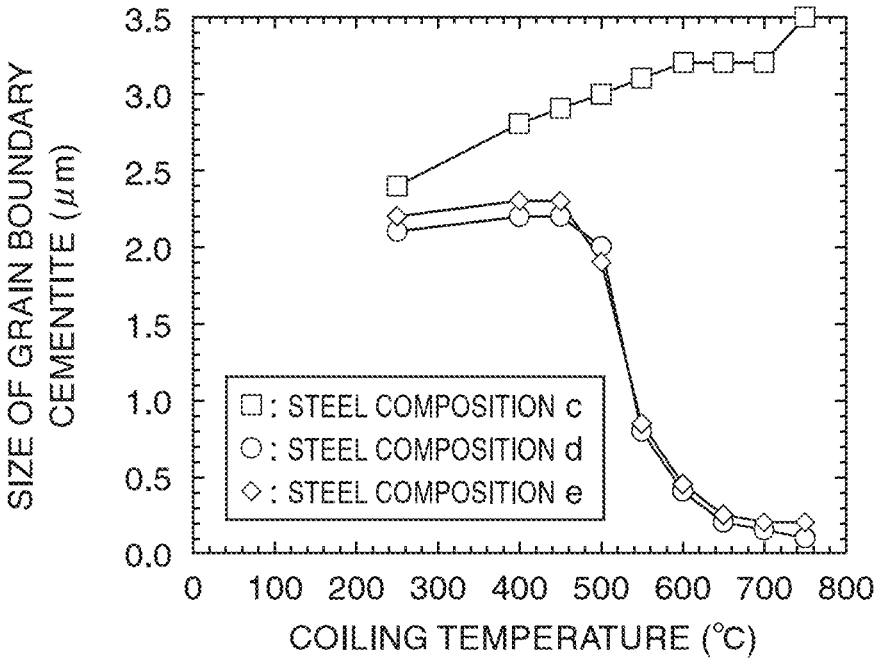
FIG. 13A is a view depicting an example of a relationship between a coiling temperature and a size of grain boundary cementite.
Figure 13B:
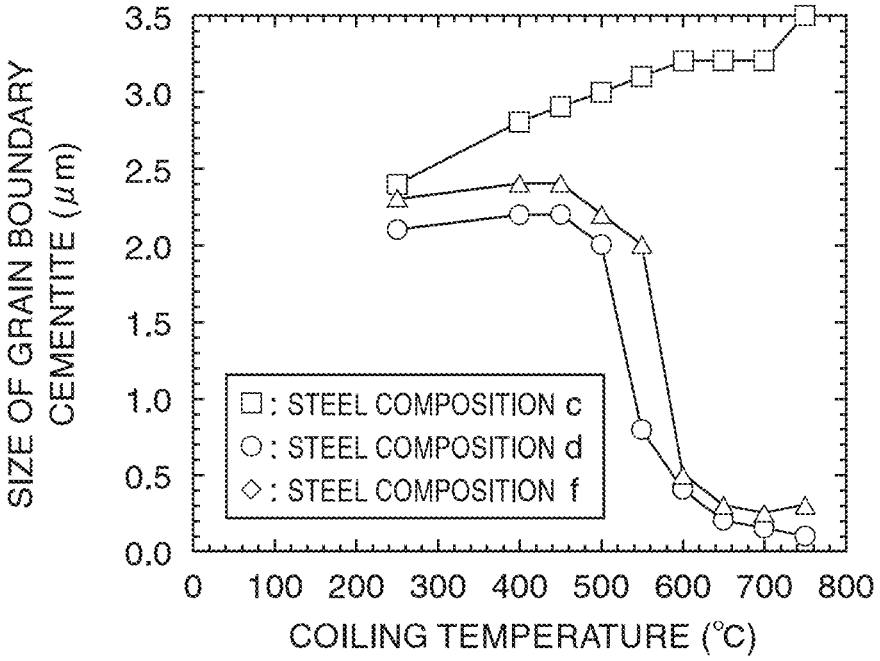
FIG. 13B is a view depicting another example of the relationship between a coiling temperature and a size of grain boundary cementite.

FIG. 13A depicts the relationship between the coiling temperature and the size of grain boundary cementite in the steel compositions c, d, and e. FIG. 13B depicts the relationship between the coiling temperature and the size of grain boundary cementite in the steel compositions c, d, and f.

As depicted in FIG. 13A and FIG. 13B, even in all the steel compositions c to f, as the coiling temperature is increased, the size of grain boundary cementite is increased, but the size of grain boundary cementite tends to be small rapidly when the coiling temperature becomes a certain temperature or higher. In the steel compositions d to f each containing Ti and Nb, in particular, the decrease in the size of grain boundary cementite was remarkable. Particularly, in the steel composition e, the size of grain boundary cementite became 2 μm or less in the case of the coiling temperature being 480° C. or higher, and in the steel composition f, the size of grain boundary cementite became 2 μm or less in the case of the coiling temperature being 560° C. or higher. This is conceivable as follows.

It has been conceivable that there is a nose zone in terms of a precipitation temperature of cementite in an α-phase. It has been known that this nose zone is expressed by a balance between nucleation with the degree of supersaturation of C in the α-phase set as a driving force and grain growth of $Fe_3C$ whose rate is determined by diffusion of C and Fe. When the coiling temperature is lower than the nose zone, the degree of supersaturation of C is large and the driving force of the nucleation is large, but C and Fe can hardly diffuse due to the low temperature and the precipitation of cementite is suppressed regardless of the grain boundary or grain interior, and even though cementite precipitates, the size is small. On the other hand, when the coiling temperature is higher than the temperature of the nose zone, solubility of C is increased and the driving force of the nucleation is decreased, but a diffusion length is increased, and the density is decreased, but the size shows a tendency to become coarse. However, in a case when the elements that form carbide such as Ti and Nb are contained, a precipitation nose zone of the elements (Ti, Nb, and so on) in the α-phase is on the higher temperature side than that of cementite, and due to precipitation of carbide, C is depleted. Therefore, a precipitation amount of cementite and the size of cementite are decreased. For such a reason, it is conceivable that in the steel composition e, the size of grain boundary cementite became 2 μm or less in the case of the coiling temperature being 480° C. or higher, and in the steel composition f, the size of grain boundary cementite became 2 μm or less in the case of the coiling temperature being 560° C. or higher.

The present invention, as described above, has been made by performing the control of the inclusions, particularly the content and form of sulfide, and the control of the microstructure and the texture, for the purpose of inventing the steel sheet having the high strength, the high formability, and the high fracture property, in order to contribute to a reduction in weight of a passenger vehicle or the like.

(First Embodiment)

Next, there will be explained reasons for limiting a composition in a high-strength hot-rolled steel sheet according to a first embodiment of the present invention. Note that hereinafter, mass % in the composition is simply described as %.

C: 0.02% to 0.1%

C is an element which bonds to Nb, Ti, and so on to contribute to the improvement of the tensile strength by precipitation strengthening. Also, C decreases the fracture appearance transition temperature by making the microstructure fine. Further, C segregates in the grain boundaries as solid solution C to thereby have an effect of suppressing exfoliation of the grain boundaries during punching to suppress the occurrence of the peeling. When the C content is less than 0.02%, the effects cannot be obtained sufficiently, and the desired bore expandability and fracture property cannot be obtained. On the other hand, when the C content exceeds 0.1%, iron carbide ($Fe_3C$), which is not preferable for the average λave of the bore expansion ratio, the crack occurrence resistance value Jc, and the Charpy absorbed energy, is likely to be formed excessively. Therefore, the C content is set to be not less than 0.02% nor more than 0.1%. Further, in order to further improve the above-described effects of improving the tensile strength and the like, the C content is preferably 0.03% or more, and is more preferably 0.04% or more. Further, as the C content is decreased, the formation of iron carbide ($Fe_3C$) is effectively suppressed, and thus in order to obtain the more excellent average λave of the bore expansion ratio, and so on, the C content is preferably 0.06% or less, and is more preferably 0.05% or less.

Si: 0.001% to 3.0%

Si is an element necessary for preliminary deoxidation. When the Si content is less than 0.001%, it is difficult to perform the sufficient preliminary deoxidation. Also, Si contributes to the improvement of the tensile strength as a solid solution strengthening element and suppresses the formation of iron carbide ($Fe_3C$) to enhance precipitation of carbide fine precipitates of Nb and Ti. As a result, the average λave of the bore expansion ratio, the crack occurrence resistance value Jc, and the Charpy absorbed energy are made better. On the other hand, when the Si content exceeds 3.0%, the effects are saturated and the economic efficiency is deteriorated. Therefore, the Si content is set to be not less than 0.001% nor more than 3.0%. Further, in order to further improve the above-described effects of improving the tensile strength and the like, the Si content is preferably 0.5% or more, and is more preferably 1.0% or more. Further, in consideration of the economic efficiency, the Si content is preferably 2.0% or less, and is more preferably 1.3% or less.

Mn: 0.5% to 3.0%

Mn is an element which contributes to the improvement of the tensile strength of the steel sheet as a solid solution strengthening element. When the Mn content is less than 0.5%, it is difficult to obtain the sufficient tensile strength. On the other hand, when the Mn content exceeds 3.0%, slab cracking during hot rolling occurs easily. Therefore, the Mn content is set to be not less than 0.5% nor more than 3.0%. Further, in order to obtain the higher tensile strength, the Mn content is preferably 0.75% or more, and is more preferably 1.0% or more. Further, in order to more securely suppress the slab cracking, the Mn content is preferably 2.0% or less, and is more preferably 1.5% or less.

P: 0.1% or less (not containing 0%)

P is an impurity to be mixed inevitably, and with an increase in the content, its segregation amount in the grain boundaries increases, and P is an element which causes the deterioration of the average λave of the bore expansion ratio, the crack occurrence resistance value Jc, and the Charpy absorbed energy. Therefore, the smaller the P content is, the more desirable it is, and in the case of the P content being 0.1% or less, these characteristic values of the average λave of the bore expansion ratio, and so on fall within allowable ranges. Therefore, the P content is set to 0.1% or less. Further, in order to further suppress the deterioration of the properties caused by the containing of P, the P content is preferably 0.02% or less, and is more preferably 0.01% or less.

S: 0.01% or less (not including 0%)

S is an impurity to be mixed inevitably, and when the S content exceeds 0.01%, MnS is formed in large amounts in the steel during slab heating to be extended by hot rolling, and thereby the sum total M of the rolling direction length of the inclusion and the major diameter/minor diameter ratio of the inclusion are increased. As a result, it is not possible to obtain the desired average λave and standard deviation σ of the bore expansion ratio, crack occurrence resistance value Jc, crack propagation resistance value T. M., and Charpy absorbed energy. Therefore, the S content is set to 0.01% or less. Further, in order to further suppress the deterioration of the properties caused by the containing of S, the S content is preferably 0.003% or less, and is more preferably 0.002% or less. On the other hand, in the case when the desulfurization with the desulfurization material is not performed, it is difficult to set the S content to be less than 0.001%.

Al: 0.001% to 2.0%

Al is an element necessary for deoxidation of the molten steel. When the Al content is less than 0.001%, it is difficult to deoxidize the molten steel sufficiently. Also, Al is also an element that contributes to the improvement of the tensile strength. On the other hand, when the Al content exceeds 2.0%, the effects are saturated and the economic efficiency is deteriorated. Therefore, the Al content is set to be not less than 0.001% nor more than 2.0%. Also, in order to make the deoxidation more secure, the Al content is preferably 0.01% or more, and is more preferably 0.02% or more. Further, in consideration of the economic efficiency, the Al content is preferably 0.5% or less, and is more preferably 0.1% or less.

N: 0.02% or less (not including 0%)

N forms precipitates with Ti and Nb at a higher temperature than C to decrease Ti and Nb effective for fixing C. That is, N causes the decrease in the tensile strength. Thus, the N content has to be decreased as much as possible, but if the N content is 0.02% or less, it is allowable. Further, in order to more effectively suppress the decrease in the tensile strength, the N content is preferably 0.005% or less, and is more preferably 0.003% or less.

Ti: 0.03% to 0.3%

Ti is an element which finely precipitates as TiC to contribute to the improvement of the tensile strength of the steel sheet by precipitation strengthening. When the Ti content is less than 0.03%, it is difficult to obtain the sufficient tensile strength. Further, Ti precipitates as TiS during slab heating in a hot rolling process to thereby suppress the precipitation of MnS which forms the extended inclusion and decrease the sum total M of the rolling direction length of the inclusion. As a result, the average λave of the bore expansion ratio, the crack occurrence resistance value Jc, the crack propagation resistance value T. M., and the Charpy absorbed energy are made better. On the other hand, when the Ti content exceeds 0.3%, the effects are saturated the economic efficiency is deteriorated. Thus, the Ti content is set to be not less than 0.03% nor more than 0.3%. Also, in order to obtain the higher tensile strength, the Ti content is preferably 0.08% or more, and is more preferably 0.12% or more. Further, in consideration of the economic efficiency, the Ti content is preferably 0.2% or less, and is more preferably 0.15% or less.

Nb: 0.001% to 0.06%

Nb is an element which improves the tensile strength by precipitation strengthening and making the microstructure fine and makes the average grain size of the microstructure fine. When the Nb content is less than 0.001%, the sufficient tensile strength and fracture appearance transition temperature are not likely to be obtained. On the other hand, when the Nb content exceeds 0.06%, the temperature range of a non-recrystallization in the hot rolling process is expanded, and a large rolled texture in a non-recrystallization state, which increases the X-ray random intensity ratio of the {211} plane, remains after the hot rolling process is finished. When the X-ray random intensity ratio of the {211} plane is increased excessively, the average λave of the bore expansion ratio, the crack occurrence resistance value Jc, and the Charpy absorbed energy are deteriorated. Therefore, the Nb content is set to be not less than 0.001% nor more than 0.06%. Also, in order to further improve the above-described effects of improving the tensile strength and the like, the Nb content is preferably 0.01% or more, and is more preferably 0.015% or more. Further, in order to suppress the increase in the X-ray random intensity ratio of the {211} plane, the Nb content is preferably 0.04% or less, and is more preferably 0.02% or less.

The above are the reasons for limiting the basic components in the first embodiment, but one type or both types of REM and Ca may also be contained in a manner to have the following contents.

REM: 0.0001% to 0.02%

REM (rare-earth metal) is an element which makes the form of sulfide such as MnS, which causes the deterioration of the average λave of the bore expansion ratio, the crack occurrence resistance value Jc, the crack propagation resistance value T. M., and the Charpy absorbed energy, spherical to thereby decrease the maximum of the major diameter/minor diameter ratio of the inclusion and the sum total M of the rolling direction length of the inclusion. Thus, REM can make the average λave of the bore expansion ratio, the crack occurrence resistance value Jc, the crack propagation resistance value T. M., and the Charpy absorbed energy better. Incidentally, even in a case of containing REM, when the REM content is less than 0.0001%, the effect of making the form of sulfide such as MnS spherical sometimes cannot be obtained sufficiently. On the other hand, when the REM content exceeds 0.02%, such an effect is saturated and the economic efficiency is deteriorated. Therefore, the REM content may be set to be not less than 0.0001% nor more than 0.02%. Also, in order to further improve the above-described effect, the REM content is preferably 0.002% or more, and is more preferably 0.003% or more. Further, in consideration of the economic efficiency, the REM content is preferably 0.005% or less, and is more preferably 0.004% or less.

Ca: 0.0001% to 0.02%

Ca is an element which fixes S in the steel as spherical CaS to suppress the formation of MnS and makes the form of sulfide such as MnS spherical to thereby decrease the maximum of the major diameter/minor diameter ratio of the inclusion and the sum total M of the rolling direction length of the inclusion. Thus, Ca can also make the average λave of the bore expansion ratio, the crack occurrence resistance value Jc, the crack propagation resistance value T. M., and the Charpy absorbed energy better. Incidentally, even in the case of containing Ca, when the Ca content is less than 0.0001%, the effect of making the form of sulfide such as MnS spherical cannot be sufficiently obtained. On the other hand, when the Ca content exceeds 0.02%, calcium aluminate, which is likely to be the extended-shaped inclusion, is formed in large amounts, and thus the sum total M of the rolling direction length of the inclusion is likely to be increased. Therefore, the Ca content may be set to be not less than 0.0001% nor more than 0.02%. Also, in order to further improve the above-described effect, the Ca content is preferably 0.002% or more, and is more preferably 0.003% or more. Further, in consideration of the economic efficiency, the Ca content is preferably 0.005% or less, and is more preferably 0.004% or less.

Further, in order to decrease MnS to cause the deterioration of the bore expandability as much as possible, with regard to the contents of Ti, S, REM, and Ca, the previously described parameter Q or Q' is set to 30.0 or more. When the parameter Q or Q' is 30.0 or more, the content of MnS in the steel is decreased and the sum total M of the rolling direction length of the inclusion is decreased sufficiently. As a result, the average λave of the bore expansion ratio, the crack occurrence resistance value Jc, the crack propagation resistance value T. M., and the Charpy absorbed energy are improved. When the parameter Q or Q' is less than 30.0, these characteristic values are not likely to become sufficient.

[Mathematical expression 6]

(Mathematical expression 1)

$$Q = \frac{[\mathrm{Ti}]}{48} \Big/ \frac{[\mathrm{S}]}{32}$$

(Mathematical expression 1')

$$Q' = \frac{[\mathrm{Ti}]}{48} \Big/ \frac{[\mathrm{S}]}{32} + \left\{ \frac{[\mathrm{Ca}]}{40} \Big/ \frac{[\mathrm{S}]}{32} + \frac{[REM]}{140} \Big/ \frac{[\mathrm{S}]}{32} \right\} \times 15.0$$

The balance of the steel sheet according to this embodiment other than these basic components may be composed of Fe and inevitable impurities. Incidentally, O, Zn, Pb, As, Sb, and so on are cited as the inevitable impurities, and even though each of them is contained in a range of 0.02% or less, the effect of the present invention is not lost.

Further, with regard to the contents of Ca and REM, in terms of suppressing the maximum of the major diameter/minor diameter ratio of the inclusion, Mathematical expression 2 is preferably established as described above. In a case when Mathematical expression 2 is not established, the maximum of the major diameter/minor diameter ratio of the inclusion may exceed 3.0, thereby making it impossible to obtain the preferable values, which are 85% or more of the average λave of the bore expansion ratio and 10% or less of the standard deviation σ of the bore expansion ratio. Further, the more excellent crack occurrence resistance value Jc and Charpy absorbed energy may be not likely to be obtained.

$$0.3 \leq ([\mathrm{REM}]/140)/([\mathrm{Ca}]/40) \qquad \text{(Mathematical expression 2)}$$

Further, according to need, one or more components out of B, Cu, Cr, Mo, and Ni may also be contained in the steel sheet in the following ranges.

B: 0.0001% to 0.005%

B is an element which segregates in the grain boundaries as solid solution B with solid solution C to thereby suppress exfoliation of the grain boundaries during punching to suppress the occurrence of the peeling. Further, with such an effect, in the case of B being contained, it is possible to perform the coiling in the hot rolling process at a relatively high temperature. When the B content is less than 0.0001%, the effects are not likely to be obtained sufficiently. On the other hand, when the B content exceeds 0.005%, the temperature range of the non-recrystallization in the hot rolling process is expanded, and the large rolled texture in the non-recrystallization state remains after the hot rolling process is finished. The rolled texture in the non-recrystallization state increases the X-ray random intensity ratio of the {211} plane. Then, when the X-ray random intensity ratio of the {211} plane is increased excessively, the average λave of the bore expansion ratio, the crack occurrence resistance value Jc, and the Charpy absorbed energy are deteriorated. Therefore, the B content is preferably not less than 0.0001% nor more than 0.005%. Also, in order to further suppress the occurrence of the peeling, the B content is more preferably 0.001% or more, and is still more preferably 0.002% or more. Further, in order to further suppress the X-ray random intensity ratio of the {211} plane, the B content is more preferably 0.004% or less, and is still more preferably 0.003% or less.

Cu, Cr, Mo, Ni, and V are elements each having an effect of improving the tensile strength of the hot-rolled steel sheet by precipitation strengthening or solid solution strengthening. However, when the Cu content is less than 0.001%, the Cr content is less than 0.001%, the Mo content is less than 0.001%, the Ni content is less than 0.001%, and the V content is less than 0.001%, the sufficient effect of improving the tensile strength cannot be obtained. On the other hand, when the Cu content exceeds 1.0%, the Cr content exceeds 1.0%, the Mo content exceeds 1.0%, the Ni content exceeds 1.0%, and the V content exceeds 0.2%, the effect of improving the tensile strength is saturated to cause the deterioration of the economic efficiency. Thus, the Cu content is preferably not less than 0.001% nor more than 1.0%, the Cr content is preferably not less than 0.001% nor more than 1.0%, the Mo content is preferably not less than 0.001% nor more than 1.0%, the Ni content is preferably not less than 0.001% nor more than 1.0%, and the V content is preferably not less than 0.001% nor more than 0.2%. Also, in order to further improve the tensile strength, the Cu content is more preferably 0.1% or more, the Cr content is more preferably 0.1% or more, the Mo content is more preferably 0.1% or more, the Ni content is more preferably 0.1% or more, and the V content is more preferably 0.05% or more. Further, the Cu content is still more preferably 0.3% or more, the Cr content is still more preferably 0.3% or more, the Mo content is still more preferably 0.3% or more, the Ni content is still more preferably 0.3% or more, and the V content is still more preferably 0.07% or more. On the other hand, in consideration of the economic efficiency, the Cu content is more preferably 0.7% or less, the Cr content is more preferably 0.7% or less, the Mo content is more preferably 0.7% or less, the Ni content is more preferably 0.7% or less, and the V content is more preferably 0.1% or less. Further, the Cu content is still more preferably 0.5% or less, the Cr content is still more preferably 0.5% or less, the Mo content is still more preferably 0.5% or less, the Ni content is still more preferably 0.5% or less, and the V content is still more preferably 0.09% or less.

Further, it is also acceptable that 1% or less of Zr, Sn, Co, W, and Mg in total is contained in the steel sheet according to need.

Further, the total grain boundary number density of solid solution C and solid solution B is preferably not less than $4.5/nm^2$ nor more than $12/nm^2$. This is because when the grain boundary number density is $4.5/nm^2$ or more, particularly, the occurrence of the peeling can be suppressed, but when the grain boundary number density exceeds $12/nm^2$, the effect is saturated. Incidentally, in order to improve grain boundary strength and more effectively suppress the peeling to occur during punching or shearing, the grain boundary number density is more preferably $5/nm^2$ or more, and is still more preferably $6/nm^2$ or more.

Further, the size of grain boundary cementite is preferably 2 μm or less. This is because when the size of grain boundary cementite is 2 μm or less, voids do not occur easily and the bore expandability can be further improved.

Next, there will be explained reasons for limiting a microstructure, a texture, and inclusions of the hot-rolled steel sheet according to the first embodiment.

The microstructure of the hot-rolled steel sheet according to the first embodiment is set to a ferrite structure, a bainite structure, or a structure mixed with them. This is because when the microstructure is a ferrite structure, a bainite structure, or a structure mixed with them, the overall hardness of the microstructure becomes relatively uniform, the ductile fracture is suppressed, the average λave of the bore expansion ratio, the crack occurrence resistance value Jc, and the Charpy absorbed energy are made better, and the sufficient bore expandability and fracture property can be obtained. Further, there is sometimes a case that in the microstructure, a structure called island-shaped martensite (MA) that is a mixture of martensite and retained austenite slightly remains. The island-shaped martensite (MA) promotes the ductile fracture to deteriorate the average λave of the bore expansion ratio, and so on, so that it is preferable that island-shaped martensite (MA) should not remain, but if its area fracture is 3% or less, island-shaped martensite (MA) is allowed.

Further, the average grain size in the microstructure is set to 6 μm or less. This is because in the case of the average grain size being in excess of 6 μm, the sufficient fracture appearance transition temperature cannot be obtained. That is, when the average grain size exceeds 6 μm, the sufficient fracture property cannot be obtained. Further, the average grain size is preferably 5 μm or less in order to make the fracture property better.

The {211} plane intensity in the texture is set to 2.4 or less. This is because when the {211} plane intensity exceeds 2.4, anisotropy of the steel sheet is increased, during bore expanding, on the edge face in the rolling direction that receives tensile strain in the sheet width direction, a decrease in thickness is increased, and high stress occurs on the edge face to make the crack occur and propagate easily to thereby deteriorate the average λave of the bore expansion ratio. Further, this is because when the {211} plane intensity exceeds 2.4, the crack occurrence resistance value Jc and the Charpy absorbed energy are also deteriorated. That is, when the {211} plane intensity exceeds 2.4, the desired bore expandability and fracture property cannot be obtained. Further, the {211} plane intensity is preferably 2.35 or less, and is more preferably 2.2 or less in order to make the bore expandability and the fracture property better.

As described above, the maximum of the major diameter/minor diameter ratio expressed by the major diameter of the inclusion/the minor diameter of the inclusion is set to 8.0 or less. This is because in a case of the major diameter/minor diameter ratio being in excess of 8.0, during deformation of the steel sheet, the stress concentration in the vicinity of the inclusion is increased, and the desired average λave and standard deviation σ of the bore expansion ratio, crack occurrence resistance value Jc, and Charpy absorbed energy are not likely to be obtained. That is, when the maximum of the major diameter/minor diameter ratio exceeds 8.0, the sufficient bore expandability and fracture property are not likely to be obtained. Further, the maximum of the major diameter/minor diameter ratio of the inclusion is preferably 3.0 or less. When the maximum of the major diameter/minor diameter ratio of the inclusion is 3.0 or less, the average λave of the bore expansion ratio can be 85% or more, which is better, and the standard deviation σ of the bore expansion ratio can be 10% or less, which is better, and further the crack occurrence resistance value Jc and the Charpy absorbed energy can also be made more excellent. These are clear also from FIG. 5A, FIG. 5B, FIG. 6A, and FIG. 6B.

Further, as described above, the sum total M of the rolling direction length of the inclusion is set to $0.25\ mm/mm^2$ or less. This is because in the case of the sum total M being in excess of $0.25\ mm/mm^2$, during deformation of the steel sheet, the ductile fracture is easily promoted and the desired average λave of the bore expansion ratio, crack occurrence resistance value Jc, crack propagation resistance value T. M., and Charpy absorbed energy are not likely to be obtained. That is, when the sum total M exceeds $0.25\ mm/mm^2$, the desired bore expandability and fracture property are not likely to be obtained. This is clear also from FIG. 5A, FIG. 5B, FIG. 6A, and FIG. 6B. Further, the sum total M of the rolling direction length of the inclusion is preferably $0.05\ mm/mm^2$ or less. When the sum total M of the rolling direction length of the inclusion is $0.05\ mm/mm^2$ or less, the crack propagation resistance value T. M. can be $900\ MJ/m^3$ or more, which is better, and further the average λave of the bore expansion ratio, the crack occurrence resistance value Jc, and the Charpy absorbed energy can also be made more excellent. From such a point of view, the sum total M of the rolling direction length of the inclusion is more preferably $0.01\ mm/mm^2$ or less, and the sum total M may also be zero.

Incidentally, the inclusion described here means, for example, sulfides such as MnS and CaS in the steel, oxides such as a $CaO—Al_2O_3$ based chemical compound (calcium aluminate), a residue made of a desulfurization material such $CaF_2$, and so on.

The methods of measuring the microstructure, the texture, and the inclusion, and the definitions of the X-ray random intensity ratio, the sum total M of the rolling direction length of the inclusion, and the major diameter/minor diameter ratio of the inclusion are as described above.

Incidentally, the n value (work hardening coefficient) is preferably 0.08 or more and the fracture appearance transition temperature is preferably −15° C. or lower, which are not limited in particular.

Next, there will be explained a method for manufacturing a hot-rolled steel sheet according to the first embodiment.

First, in a steelmaking process, for example, a molten iron is obtained in a shaft furnace or the like, and then is subjected to a decarburization treatment and has alloy added thereto in a steel converter. Thereafter, a tapped molten steel is subjected to a desulfurization treatment, a deoxidation treatment, and so on in various secondary refining apparatuses. In this manner, a molten steel containing predetermined components is made.

In a secondary refining process, it is preferable to add Ca, REM, and/or Ti in a manner that the parameter Q or Q' becomes 30.0 or more to thereby suppress extended MnS. On this occasion, when Ca is added in large amounts, extended calcium aluminate is formed, so that it is preferable that REM should be added and Ca should not be added, or Ca should be added in minute amounts. By such a treatment, it is possible to set the sum total M of the rolling direction length of the inclusion to preferable 0.01 $mm/mm^2$ or less, and further it is possible to set the crack propagation resistance value T. M. to preferable 900 $MJ/m^3$ or more. It is also possible to make the average λave of the bore expansion ratio, the crack occurrence resistance value Jc, and the Charpy absorbed energy more excellent. Incidentally, due to the cost, it is preferable not to perform desulfurization with the desulfurization material.

In a case when the restriction of cost is small, the desulfurization with the desulfurization material may also be performed in order to further suppress the S content. In the case, there is a possibility that the desulfurization material itself that is likely to be the extended inclusion remains to a final product, so that it is preferable that sufficient reflux of the molten steel should be performed after the application of the desulfurization material during the secondary refining process to remove the desulfurization material. Further, in the case of the desulfurization material being used, in order to prevent the desulfurization material remaining after the secondary refining process from being extended by rolling, it is preferable to make a composition of which the desulfurization material is not easily extended by rolling at a high temperature.

Except the above points, the steelmaking process prior to the hot rolling process is not limited in particular. The molten steel containing the predetermined components is made by the secondary refining, and then is cast by normal continuous casting or casting by an ingot method, or by a method of thin slab casting, or the like, and thereby a steel slab is obtained. In the case when the steel slab is obtained by continue casting, the hot steel slab may be directly sent to a hot rolling mill, or it may also be designed that the steel slab is cooled to room temperature and then is reheated in a heating furnace, and thereafter the steel slab is hot rolled. Further, as an alternative method of obtaining a molten iron in a shaft furnace, it may also be designed that scrap iron is used as a raw material and is melted in an electric furnace, and then is subjected to various secondary refining, and thereby a molten steel containing the predetermined components is obtained.

Next, conditions on the occasion when the steel slab obtained by continuous casting or the like is hot rolled will be explained.

First, the steel slab obtained by continuous casting or the like is heated in a heating furnace. The heating temperature on the occasion is preferably set to 1200° C. or higher in order to obtain the desired tensile strength. When the heating temperature is lower than 1200° C., the precipitates containing Ti or Nb are not sufficiently dissolved in the steel slab and are coarsened, and precipitation strengthening capability by the precipitate of Ti or Nb cannot be obtained, and thus the desired tensile strength sometimes cannot be obtained. Further, when the heating temperature is lower than 1200° C., MnS is not sufficiently dissolved by reheating, and it is not possible to encourage S to precipitate as TiS, and thus the desired bore expandability is not likely to be obtained.

Subsequently, rough-rolling is performed on the steel slab extracted from a heating furnace. In the rough-rolling, the rolling of which the accumulated reduction ratio becomes 70% or less in the high temperature zone exceeding 1150° C. is performed. This is because when the accumulated reduction ratio in the temperature zone exceeds 70%, the sum total M of the rolling direction length of the inclusion and the maximum of the major diameter/minor diameter ratio of the inclusion are both increased, and the desired average λave of the bore expansion ratio, crack occurrence resistance value Jc, and crack propagation resistance value T. M. are not likely to be obtained. From such a point of view, the accumulated reduction ratio in the high temperature zone exceeding 1150° C. is preferably 65% or less, and is more preferably 60% or less.

Further, in the rough-rolling, the rolling of which the accumulated reduction ratio becomes not less than 10% nor more than 25% in the low temperature zone of 1150° C. or lower is also performed. When the accumulated reduction ratio in this temperature zone being less than 10%, the average grain size of the microstructure is increased, and the average grain size required in the present invention (6 μm or less) cannot be obtained. As a result, the desired fracture appearance transition temperature is not likely to be obtained. On the other hand, in the case of the accumulated reduction ratio in this temperature zone being in excess of 25%, the {211} plane intensity is increased, and the {211} plane intensity required in the present invention (2.4 or less) cannot be obtained. As a result, the desired average λave of the bore expansion ratio, crack occurrence resistance value Jc, and Charpy absorbed energy are not likely to be obtained. Therefore, the accumulated reduction ratio in the low temperature zone of 1150° C. or lower is set to be not less than 10% nor more than 25%. Incidentally, in order to obtain the better fracture appearance transition temperature, the accumulated reduction ratio in the low temperature zone of 1150° C. or lower is preferably 13% or more, and is more preferably 15% or more. Further, in order to obtain the better average λave of the bore expansion ratio, crack occurrence resistance value Jc, and Charpy absorbed energy, the accumulated reduction ratio in the low temperature zone of 1150° C. or lower is preferably 20% or less, and is more preferably 17% or less.

Subsequently, finish-rolling is performed on the steel slab obtained through the rough-rolling. In the finish-rolling process, the beginning temperature is set to 1050° C. or higher. This is because as the beginning temperature of the finish-rolling is higher, dynamic recrystallization during the rolling is promoted, and the texture which increases the {211} plane intensity, the texture being formed due to repeatedly reducing the steel slab in a non-recrystallization state, is decreased, and thereby the {211} plane intensity required in the present invention (2.4 or less) can be obtained. In order to further suppress the {211} plane intensity, the beginning temperature of the finish-rolling is preferably set to 1100° C. or higher.

Further, in the finish-rolling process, the finishing temperature is set to be not lower than Ar3 +130° C. nor higher than Ar3 +230° C. When the finishing temperature of the finish-rolling is lower than Ar3 +130° C., the rolled texture in the non-recrystallization state to be the cause of increasing the {211}plane intensity easily remains, and the {211} plane intensity required in the present invention (2.4 or less) cannot be obtained easily. On the other hand, when the finishing temperature of the finish-rolling exceeds Ar3 +230° C., grains are coarsened excessively and the average grain size required in the present invention (6 μm or less) cannot be obtained easily. Therefore, the finishing temperature of the finish-rolling is set to be not lower than Ar3 +130° C. nor higher than Ar3 +230° C. In order to further suppress the {211} plane intensity, the finishing temperature of the finish-rolling is preferably Ar3 +150° C. or higher, and is more preferably Ar3 +160° C. or higher. Further, in order to further decrease the average grain size of the microstructure, the finishing temperature of the finish-rolling is preferably Ar3 +200° C. or lower, and is more preferably Ar3 +175° C. or lower.

Note that Ar3 may be obtained from Mathematical expression 11 below.

[Mathematical expression 7]

$$Ar3=868-396\times[C]+25\times[Si]-68\times[Mn]-36\times[Ni]-21\times[Cu]-25\times[Cr]+30\times[Mo]\ldots \quad \text{(Mathematical expression 11)}$$

([C] indicates the C content (mass %), [Si] indicates the Si content (mass %), [Mn] indicates the Mn content (mass %), [Ni] indicates the Ni content (mass %), [Cu] indicates the Cu content (mass %), [Cr] indicates the Cr content (mass %), and [Mo] indicates the Mo content (mass %).)

Also, a finishing temperature FT of the finish-rolling preferably satisfies Mathematical expression 12 below according to the Nb content and the B content. This is because in the case when Mathematical expression 12 is satisfied, the {211} plane intensity and the average grain size are particularly suppressed.

[Mathematical expression 8]

$$848+2167\times[Nb]+40353\times[B]\leq FT\leq 955+1389\times[Nb] \quad \text{(Mathematical expression 12)}$$

([Nb] indicates the Nb content (mass %) and [B] indicates the B content (mass %).)

Subsequently, the steel sheet obtained through the finish-rolling process is cooled on the run-out-table or the like. In this cooling process, the cooling rate is set to 15° C./sec or more. This is because when the cooling rate is less than 15° C./sec, pearlite to cause the deterioration of the average λave of the bore expansion ratio and the like is formed, and further the average grain size of the microstructure is increased to deteriorate the fracture appearance transition temperature. As a result, the sufficient bore expandability and fracture property are not likely to be obtained. Therefore, the cooling rate is preferably set to be not less than 15° C./sec nor more than 20° C./sec.

Further, in the cooling process, in order to make the precipitates such as TiC fine to obtain the hot-rolled steel sheet more excellent in tensile strength, a three-stage cooling process as will be explained next is preferably performed. In the three-stage cooling process, for example, the first-stage cooling with the cooling rate set to 20° C./sec or more is performed, subsequently, the second-stage cooling with the cooling rate set to 15° C./sec or less in a temperature zone of not lower than 550° C. nor higher than 650° C. is performed, and subsequently the third-stage cooling with the cooling rate set to 20° C./sec or more is performed.

The reason why in the first-stage cooling in the three-stage cooling process, the cooling rate is set to 20° C./sec or more is because when the cooling rate is smaller than the above cooling rate, pearlite to cause the deterioration of the average λave of the bore expansion ratio and the like is likely to be formed.

The reason why, in the second-stage cooling in the three-stage cooling process, the cooling rate is set to 15° C./sec or less is because when the cooling rate is larger than the above cooling rate, the fine precipitates are not likely to precipitate sufficiently. Further, the reason why the temperature zone where this cooling is performed is set to 550° C. or higher is because when the temperature zone is lower than the above temperature, the effect of finely precipitating TiC for a short period of time is decreased. Further, the reason why the temperature zone where this cooling is performed is set to 650° C. or lower is because when the temperature zone is higher than the above temperature, the precipitates such as TiC precipitate coarsely, and the sufficient tensile strength is not likely to be obtained. The reason is also because pearlite is formed in a temperature zone exceeding 650° C. to be likely to deteriorate the bore expandability. The duration of this cooling is desirably set to be not longer than 1 second nor shorter than 5 seconds. This is because when it is shorter than 1 second, the fine precipitates do not precipitate sufficiently. This is because when it exceeds 5 seconds, conversely the precipitates coarsely precipitate to cause the deterioration of the tensile strength. This is also because when the duration of this cooling exceeds 5 seconds, pearlite is formed to be likely to deteriorate the bore expandability.

The reason why in the third-stage cooling in the three-stage cooling process, the cooling rate is set to 20° C./sec or more is because unless the cooling is performed immediately after the second-stage cooling, the precipitates coarsely precipitate to be likely to cause the deterioration of the tensile strength. Further, the reason is also because when this cooling rate is less than 20° C./sec, pearlite is formed to be likely to deteriorate the bore expandability.

Incidentally, in each of the cooling processes, the cooling rate of 20° C./sec or more may be achieved by for example, water cooling, mist cooling, or the like, and the cooling rate of 15° C./sec or less may be achieved by for example, air cooling.

Subsequently, the steel sheet cooled by the cooling process or the three-stage cooling process is coiled by a coiling apparatus or the like. In this coiling process, the steel sheet is coiled in a temperature zone of 640° C. or lower. This is because when the steel sheet is coiled in a temperature zone exceeding 640° C., pearlite to cause the deterioration of the average λave of the bore expansion ratio and the like is formed. Further, TiC precipitates excessively to decrease solid solution C, and thereby the peeling caused by the punching occurs easily.

Incidentally, a coiling temperature CT is preferably adjusted according to the B content and the Nb content, and in a case of the B content being less than 0.0002%, the coiling temperature CT is preferably set to 540° C. or lower. Further, in the case of the B content being not less than 0.0002% nor more than 0.002%, if the Nb content is not less than 0.005% nor more than 0.06%, the coiling temperature CT is preferably set to 560° C. or lower, and if the Nb content is 0.001% or more and less than 0.005%, the coiling temperature CT is preferably set to 640° C. or lower. This is because according to the B content and the Nb content, the grain boundary number density of solid solution B and the like may change. Further, the coiling temperature CT preferably satisfies Mathematical expression 13 below. This is because in the case of Mathematical expression 13 being satisfied, the higher tensile strength can be obtained.

[Mathematical expression 9]

$$8.12\times e^{\frac{4863}{FT+273}}\leq CT \quad \text{(Mathematical expression 13)}$$

(FT indicates the finishing temperature (° C.) of the finish-rolling.)

In this manner, it is possible to manufacture the high-strength hot-rolled steel sheet according to the first embodiment.

Incidentally, after the hot rolling process is finished, skin-pass rolling may also be performed. By performing the skin-pass rolling, it is possible to improve the ductility by introduction of mobile dislocation and to correct the shape of the steel sheet, for example. Further, after the hot rolling process is finished, scales attached to the surface of the hot-rolled steel sheet may also be removed by pickling. Further, after the hot rolling is finished or the pickling is finished, the skin-pass rolling or cold rolling may also be performed on the obtained steel sheet in-line or off-line.

Further, after the hot rolling process is finished, plating may be performed by a hot dipping method to improve corrosion resistance of the steel sheet. Further, in addition to the hot dipping, alloying may also be performed.

(Second Embodiment)

Next, a second embodiment of the present invention will be explained. A hot-rolled steel sheet according to the second embodiment differs from that according to the first embodiment on the point where a predetermined amount of V is contained and Nb is hardly contained. The other points are the same as those of the first embodiment.

V: 0.001% to 0.2%

V is an element which finely precipitates as VC to contribute to the improvement of the tensile strength of the steel sheet by precipitation strengthening. When the V content is less than 0.001%, it may be difficult to obtain the sufficient tensile strength. Further, V has an effect of increasing the n value (work hardening coefficient) being one of the indexes of the formability. On the other hand, when the V content exceeds 0.2%, the effects are saturated and the economic efficiency is deteriorated. Thus, the V content is set to be not less than 0.001% nor more than 0.2%. Further, in order to further improve the above-described effect of improving the tensile strength and the like, the V content is preferably 0.05% or more, and is more preferably 0.07% or more. Further, in consideration of the economic efficiency, the V content is preferably 0.1% or less, and is more preferably 0.09% or less.

Nb: less than 0.01% (not including 0%)

As has been explained in the first embodiment, Nb contributes to the improvement of the tensile strength. However, in this embodiment, V is contained, so that when the Nb content is 0.01% or more, the X-ray random intensity ratio of the {211} plane increases excessively to be likely to deteriorate the average λave of the bore expansion ratio, the crack occurrence resistance value Jc, and the Charpy absorbed energy. Therefore, the Nb content is set to be less than 0.01%.

Note that it is possible to manufacture the hot-rolled steel sheet according to the second embodiment by a method similar to that of the first embodiment.

EXAMPLE

Next, experiments conducted by the present inventors will be explained. Conditions and so on in these experiments are examples employed for confirming the applicability and effects of the present invention, and the present invention is not limited to these examples.

(First Experiment)

First, molten steels containing steel compositions 1A1 to 3C11 listed in Table 4 were obtained. Each of the molten steels was manufactured through performing melting and secondary refining in a steel converter. The secondary refining was performed in an RH (Ruhrstahl-Heraeus), and desulfurization was performed with a CaO—$CaF_2$—MgO based desulfurization material added as needed. In some of the steel compositions, in order to prevent the desulfurization material to be the extended inclusion from remaining, desulfurization was not performed and the process was advanced in a manner to keep the S content obtained after primary refining in a steel converter unchanged. From each of the molten steels, a steel slab was obtained through continuous casting. Thereafter, hot rolling was performed under conditions listed in Table 5, and thereby hot-rolled steel sheets each having a thickness of 2.9 mm were obtained. Characteristic values of the microstructure, the texture, and the inclusions of the obtained hot-rolled steel sheets are listed in Table 6, and mechanical properties of the obtained hot-rolled steel sheets are listed in Table 7. The methods of measuring the microstructure, the texture, and the inclusions, and the methods of measuring the mechanical property are as described above.

Incidentally, in the evaluation of the bore expandability, 20 test pieces were made from a single sample steel. Each underline in Table 4 to Table 7 indicates that the value is outside the range of the present invention, or no desired characteristic value is obtained.

TABLE 4

| STEEL | CHEMICAL COMPONENT (UNIT: MASS %) | | | | | | | | | | | | | |
|---|---|---|---|---|---|---|---|---|---|---|---|---|---|---|
| COMPOSITION | C | Si | Mn | P | S | Al | N | Ti | REM | Ca | Nb | *1 | *2 | OTHER ELEMENTS |
| 1A1 | 0.040 | 1.10 | 1.25 | 0.007 | 0.0030 | 0.023 | 0.0021 | 0.13 | 0.0040 | 0.0038 | 0.040 | 48.66 | 0.30 | — |
| 1A2 | 0.035 | 1.20 | 1.2 | 0.008 | 0.0010 | 0.020 | 0.0025 | 0.13 | 0.0025 | 0.0020 | 0.038 | 119.24 | 0.36 | — |
| 1A3 | 0.042 | 0.90 | 1.35 | 0.011 | 0.0040 | 0.029 | 0.0029 | 0.18 | 0.0000 | 0.0000 | 0.040 | 30.00 | ∞ | — |
| 1A4 | 0.037 | 1.80 | 0.7 | 0.009 | 0.0010 | 0.026 | 0.0021 | 0.12 | 0.0000 | 0.0000 | 0.038 | 80.00 | ∞ | — |
| 1A5 | 0.045 | 1.20 | 1.05 | 0.01 | 0.0040 | 0.028 | 0.0020 | 0.18 | 0.0000 | 0.0003 | 0.035 | 30.90 | 0.00 | — |
| 1A6 | 0.060 | 1.00 | 1.25 | 0.011 | 0.0010 | 0.025 | 0.0029 | 0.18 | 0.0000 | 0.0004 | 0.038 | 124.80 | 0.00 | — |
| 1A7 | 0.041 | 0.10 | 1.85 | 0.012 | 0.0030 | 0.025 | 0.0027 | 0.13 | 0.0050 | 0.0000 | 0.011 | 34.60 | ∞ | — |
| 1A8 | 0.040 | 0.10 | 1.87 | 0.008 | 0.0035 | 0.028 | 0.0029 | 0.13 | 0.0050 | 0.0003 | 0.020 | 30.69 | 4.76 | — |
| 1B | 0.041 | 1.05 | 1.25 | 0.01 | 0.0044 | 0.024 | 0.0029 | 0.13 | 0.0040 | 0.0038 | 0.054 | 33.18 | 0.30 | — |
| 1C | 0.038 | 1.41 | 1.35 | 0.011 | 0.0045 | 0.027 | 0.0028 | 0.14 | 0.0040 | 0.0034 | 0.005 | 32.86 | 0.34 | — |
| 1D | 0.039 | 1.45 | 1.51 | 0.012 | 0.0035 | 0.021 | 0.0026 | 0.048 | 0.0055 | 0.0050 | 0.040 | 31.67 | 0.31 | — |
| 1E | 0.028 | 0.85 | 1.25 | 0.012 | 0.0040 | 0.023 | 0.0024 | 0.12 | 0.0040 | 0.0037 | 0.040 | 34.53 | 0.31 | — |
| 1F | 0.041 | 0.89 | 1.27 | 0.008 | 0.0040 | 0.021 | 0.0022 | 0.11 | 0.0040 | 0.0038 | 0.038 | 33.16 | 0.30 | B: 0.0034 |
| 1G | 0.045 | 0.94 | 1.26 | 0.006 | 0.0040 | 0.028 | 0.0029 | 0.13 | 0.0040 | 0.0037 | 0.039 | 36.20 | 0.31 | B: 0.0017 |
| 1H | 0.048 | 0.98 | 1.15 | 0.005 | 0.0040 | 0.022 | 0.0025 | 0.14 | 0.0100 | 0.0000 | 0.035 | 31.90 | ∞ | Cr: 0.1, Mo: 0.05 |
| 1I | 0.040 | 1.12 | 1.05 | 0.011 | 0.0040 | 0.025 | 0.0022 | 0.13 | 0.0000 | 0.0050 | 0.037 | 36.67 | 0.00 | — |
| 1J | 0.041 | 1.20 | 1.25 | 0.012 | 0.0040 | 0.027 | 0.0025 | 0.13 | 0.0000 | 0.0040 | 0.040 | 33.67 | 0.00 | — |
| 1K | 0.042 | 1.10 | 1.15 | 0.009 | 0.0040 | 0.021 | 0.0024 | 0.12 | 0.0010 | 0.0031 | 0.035 | 30.16 | 0.09 | — |

TABLE 4-continued

| STEEL COMPOSITION | CHEMICAL COMPONENT (UNIT: MASS %) | | | | | | | | | | | | | |
|---|---|---|---|---|---|---|---|---|---|---|---|---|---|---|
| | C | Si | Mn | P | S | Al | N | Ti | REM | Ca | Nb | *1 | *2 | OTHER ELEMENTS |
| 1L | 0.035 | 1.08 | 1.25 | 0.011 | 0.0040 | 0.029 | 0.0023 | 0.11 | 0.0020 | 0.0042 | 0.035 | 32.65 | 0.14 | — |
| 1M | 0.039 | 1.05 | 1.24 | 0.012 | 0.0040 | 0.027 | 0.0027 | 0.13 | 0.0032 | 0.0044 | 0.035 | 37.61 | 0.21 | — |
| 1N | 0.040 | 1.15 | 1.18 | 0.014 | 0.0040 | 0.020 | 0.0026 | 0.14 | 0.0034 | 0.0040 | 0.040 | 39.25 | 0.24 | — |
| 1O | 0.037 | 0.90 | 1.21 | 0.008 | 0.0038 | 0.022 | 0.0020 | 0.12 | 0.0027 | 0.0025 | 0.040 | 31.38 | 0.31 | Cu: 0.2, Ni: 0.1 |
| 1P | 0.039 | 0.89 | 1.22 | 0.009 | 0.0040 | 0.024 | 0.0029 | 0.13 | 0.0031 | 0.0024 | 0.035 | 31.52 | 0.37 | V: 0.02 |
| 1Q | 0.042 | 0.95 | 1.18 | 0.011 | 0.0040 | 0.023 | 0.0024 | 0.11 | 0.0055 | 0.0040 | 0.032 | 35.05 | 0.39 | — |
| 1R | 0.041 | 1.02 | 1.2 | 0.012 | 0.0035 | 0.024 | 0.0023 | 0.13 | 0.0038 | 0.0035 | 0.040 | 40.48 | 0.31 | — |
| 1S | 0.040 | 1.00 | 1.21 | 0.014 | 0.0043 | 0.026 | 0.0021 | 0.12 | 0.0032 | 0.0032 | 0.040 | 30.09 | 0.29 | — |
| 1T | 0.041 | 1.03 | 1.22 | 0.009 | 0.0072 | 0.024 | 0.0022 | 0.13 | 0.0034 | 0.0041 | 0.040 | 20.49 | 0.24 | — |
| 1U | 0.035 | 1.20 | 1.1 | 0.008 | 0.0100 | 0.025 | 0.0021 | 0.13 | 0.0015 | 0.0023 | 0.035 | 11.94 | 0.19 | — |
| 1U2 | 0.041 | 1.10 | 1.3 | 0.009 | 0.0021 | 0.026 | 0.0028 | 0.12 | 0.0020 | 0.0018 | 0.010 | 51.65 | 0.32 | — |
| 1W1 | 0.038 | 0.05 | 1.95 | 0.011 | 0.0040 | 0.030 | 0.0024 | 0.13 | 0.0032 | 0.0022 | 0.040 | 31.01 | 0.42 | — |
| 1W2 | 0.039 | 0.10 | 1.85 | 0.012 | 0.0038 | 0.023 | 0.0030 | 0.12 | 0.0031 | 0.0024 | 0.040 | 31.43 | 0.37 | — |
| 1W3 | 0.040 | 0.08 | 2.05 | 0.008 | 0.0040 | 0.024 | 0.0026 | 0.13 | 0.0030 | 0.0026 | 0.038 | 32.04 | 0.33 | — |
| 3C1 | 0.015 | 1.10 | 1.85 | 0.007 | 0.0031 | 0.023 | 0.0047 | 0.13 | 0.0041 | 0.0038 | 0.040 | 47.20 | 0.31 | — |
| 3C2 | 0.120 | 0.50 | 0.8 | 0.008 | 0.0023 | 0.025 | 0.0031 | 0.135 | 0.0040 | 0.0036 | 0.040 | 50.66 | 0.32 | — |
| 3C3 | 0.045 | 0.0005 | 1.75 | 0.006 | 0.0030 | 0.029 | 0.0035 | 0.14 | 0.0042 | 0.0037 | 0.040 | 50.71 | 0.32 | — |
| 3C4 | 0.044 | 1.70 | 0.400 | 0.01 | 0.0031 | 0.024 | 0.0041 | 0.142 | 0.0041 | 0.0038 | 0.040 | 49.78 | 0.31 | — |
| 3C5 | 0.038 | 1.00 | 1.3 | 0.110 | 0.0030 | 0.023 | 0.0025 | 0.145 | 0.0040 | 0.0036 | 0.040 | 51.19 | 0.32 | — |
| 3C6 | 0.039 | 0.95 | 1.45 | 0.008 | 0.011 | 0.025 | 0.0029 | 0.139 | 0.0110 | 0.0100 | 0.040 | 22.76 | 0.31 | — |
| 3C7 | 0.041 | 1.05 | 1.25 | 0.007 | 0.0030 | 0.0008 | 0.0021 | 0.14 | 0.0042 | 0.0037 | 0.040 | 50.71 | 0.32 | — |
| 3C8 | 0.040 | 1.04 | 1.32 | 0.006 | 0.0032 | 0.023 | 0.021 | 0.141 | 0.0041 | 0.0036 | 0.040 | 47.27 | 0.33 | — |
| 3C9 | 0.041 | 1.03 | 1.33 | 0.008 | 0.0030 | 0.031 | 0.0040 | 0.020 | 0.0040 | 0.0038 | 0.040 | 24.22 | 0.30 | — |
| 3C10 | 0.042 | 1.12 | 1.28 | 0.005 | 0.0033 | 0.041 | 0.0038 | 0.132 | 0.0040 | 0.0035 | 0.0005 | 43.55 | 0.33 | — |
| 3C11 | 0.038 | 1.10 | 1.29 | 0.006 | 0.0030 | 0.023 | 0.0039 | 0.141 | 0.0040 | 0.0038 | 0.070 | 51.10 | 0.30 | — |

*1: ([Ti]/48/([S]/32)) + ([Ca]/40 + [REM]/140)/[S]/32*15) (PARMETER Q)
*2: ([REM]/140)/([Ca]/40)

TABLE 5

| | | | | MANUFACTURING CONDITION | | | |
|---|---|---|---|---|---|---|---|
| | | | | | | ACCUMULATED REDUCTION RATIO (%) IN ROUGH-ROLLING | |
| | STEEL No. | STEEL COMPOSITION | Ar3 TRANSFORMATION TEMPERATURE | DESULFURIZATION MATERIAL IN SECONDARY REFINING | HEATING HEATING TEMPERATURE (° C.) | TEMPERATURE ZONE EXCEEDING 1150° C. | TEMPERATURE ZONE OF 1150° C. OR LOWER |
| EXAMPLE | 1-1-1 | 1A1 | 795 | WITHOUT | 1250 | 65 | 21 |
| EXAMPLE | 1-1-2 | 1A2 | 805 | WITH | 1250 | 65 | 21 |
| EXAMPLE | 1-1-3 | 1A3 | 782 | WITHOUT | 1250 | 65 | 21 |
| EXAMPLE | 1-1-4 | 1A4 | 851 | WITH | 1250 | 65 | 21 |
| EXAMPLE | 1-1-5 | 1A5 | 809 | WITHOUT | 1250 | 65 | 21 |
| EXAMPLE | 1-1-6 | 1A6 | 784 | WITH | 1250 | 65 | 21 |
| EXAMPLE | 1-1-7 | 1A7 | 728 | WITHOUT | 1250 | 65 | 21 |
| EXAMPLE | 1-1-8 | 1A8 | 726 | WITHOUT | 1250 | 65 | 21 |
| EXAMPLE | 1-2 | 1B | 753 | WITHOUT | 1250 | 65 | 21 |
| EXAMPLE | 1-3 | 1C | 796 | WITHOUT | 1250 | 65 | 21 |
| EXAMPLE | 1-4 | 1D | 786 | WITHOUT | 1250 | 65 | 21 |
| EXAMPLE | 1-5 | 1E | 753 | WITHOUT | 1250 | 65 | 21 |
| EXAMPLE | 1-6 | 1F | 788 | WITHOUT | 1250 | 65 | 21 |
| EXAMPLE | 1-7 | 1G | 788 | WITHOUT | 1250 | 65 | 21 |
| EXAMPLE | 1-8 | 1H | 795 | WITHOUT | 1250 | 65 | 21 |
| EXAMPLE | 1-9 | 1I | 809 | WITHOUT | 1250 | 65 | 21 |
| EXAMPLE | 1-10 | 1J | 797 | WITHOUT | 1250 | 65 | 21 |
| EXAMPLE | 1-11 | 1K | 801 | WITHOUT | 1250 | 65 | 21 |
| EXAMPLE | 1-12 | 1L | 796 | WITHOUT | 1250 | 65 | 21 |
| EXAMPLE | 1-13 | 1M | 794 | WITHOUT | 1250 | 65 | 21 |
| EXAMPLE | 1-14 | 1N | 801 | WITHOUT | 1250 | 65 | 21 |
| EXAMPLE | 1-15 | 1O | 794 | WITHOUT | 1250 | 65 | 21 |
| EXAMPLE | 1-16 | 1P | 792 | WITHOUT | 1250 | 65 | 21 |
| EXAMPLE | 1-17 | 1Q | 795 | WITHOUT | 1250 | 65 | 21 |
| EXAMPLE | 1-18 | 1R | 796 | WITHOUT | 1250 | 65 | 21 |
| EXAMPLE | 1-19 | 1S | 795 | WITHOUT | 1250 | 65 | 21 |
| COMPARATIVE EXAMPLE | 1-20 | 1T | 795 | WITHOUT | 1250 | 65 | 21 |
| COMPARATIVE EXAMPLE | 1-21 | 1U | 809 | WITHOUT | 1250 | 65 | 21 |

TABLE 5-continued

| | | | | | | | |
|---|---|---|---|---|---|---|---|
| COMPARATIVE EXAMPLE | 1-22 | 1U2 | 791 | WITHOUT | 1250 | 71 | 21 |
| EXAMPLE | 1-23-1 | 1W1 | 722 | WITHOUT | 1250 | 65 | 21 |
| EXAMPLE | 1-23-2 | 1W2 | 729 | WITHOUT | 1250 | 65 | 21 |
| EXAMPLE | 1-23-3 | 1W3 | 715 | WITHOUT | 1250 | 65 | 21 |
| EXAMPLE | 1-27 | 1A1 | 795 | WITHOUT | 1150 | 65 | 21 |
| COMPARATIVE EXAMPLE | 1-28-0 | 1A1 | 795 | WITHOUT | 1250 | 75 | 11 |
| EXAMPLE | 1-28-1 | 1A1 | 795 | WITHOUT | 1250 | 70 | 16 |
| COMPARATIVE EXAMPLE | 1-28-2 | 1A1 | 795 | WITHOUT | 1250 | 58 | 28 |
| EXAMPLE | 1-28-3 | 1A1 | 795 | WITHOUT | 1250 | 61 | 25 |
| EXAMPLE | 1-28-4 | 1A1 | 795 | WITHOUT | 1248 | 67 | 10 |
| COMPARATIVE EXAMPLE | 1-28-5 | 1A1 | 795 | WITHOUT | 1249 | 70 | 5 |
| COMPARATIVE EXAMPLE | 1-30 | 1A1 | 795 | WITHOUT | 1250 | 65 | 21 |
| COMPARATIVE EXAMPLE | 1-31 | 1A1 | 795 | WITHOUT | 1250 | 65 | 21 |
| COMPARATIVE EXAMPLE | 1-32 | 1A1 | 795 | WITHOUT | 1250 | 65 | 21 |
| COMPARATIVE EXAMPLE | 1-33 | 1A1 | 795 | WITHOUT | 1250 | 65 | 21 |
| COMPARATIVE EXAMPLE | 1-34 | 1A1 | 795 | WITHOUT | 1250 | 65 | 21 |
| COMPARATIVE EXAMPLE | 3-1 | 3C1 | 764 | WITHOUT | 1200 | 65 | 21 |
| COMPARATIVE EXAMPLE | 3-2 | 3C2 | 779 | WITHOUT | 1220 | 65 | 21 |
| COMPARATIVE EXAMPLE | 3-3 | 3C3 | 731 | WITHOUT | 1250 | 65 | 21 |
| COMPARATIVE EXAMPLE | 3-4 | 3C4 | 866 | WITHOUT | 1250 | 65 | 21 |
| COMPARATIVE EXAMPLE | 3-5 | 3C5 | 790 | WITHOUT | 1250 | 65 | 21 |
| COMPARATIVE EXAMPLE | 3-6 | 3C6 | 778 | WITHOUT | 1250 | 65 | 21 |
| COMPARATIVE EXAMPLE | 3-7 | 3C7 | 793 | WITHOUT | 1250 | 65 | 21 |
| COMPARATIVE EXAMPLE | 3-8 | 3C8 | 788 | WITHOUT | 1250 | 65 | 21 |
| COMPARATIVE EXAMPLE | 3-9 | 3C9 | 787 | WITHOUT | 1250 | 65 | 21 |
| COMPARATIVE EXAMPLE | 3-10 | 3C10 | 792 | WITHOUT | 1250 | 65 | 21 |
| COMPARATIVE EXAMPLE | 3-11 | 3C11 | 793 | WITHOUT | 1250 | 65 | 21 |

| | | MANUFACTURING CONDITION | | | | | |
|---|---|---|---|---|---|---|---|
| | | FINISH-ROLLING | | COOLING | | | COILING |
| | STEEL No. | BEGINNING TEMPERATURE (° C.) | FINISHING TEMPERATURE (° C.) | COOLING RATE (° C./SEC) | THREE-STAGE COOLING | CONDITION FOR SECOND COOLING | COILING TEMPERATURE (° C.) |
| EXAMPLE | 1-1-1 | 1072 | 947 | 29 | WITHOUT | WITHOUT | 463 |
| EXAMPLE | 1-1-2 | 1074 | 949 | 30 | WITHOUT | WITHOUT | 479 |
| EXAMPLE | 1-1-3 | 1071 | 955 | 33 | WITHOUT | WITHOUT | 475 |
| EXAMPLE | 1-1-4 | 1077 | 985 | 27 | WITH | COOLING RATE: 10° C./SEC, 580~550° C. | 475 |
| EXAMPLE | 1-1-5 | 1075 | 948 | 32 | WITHOUT | WITHOUT | 461 |
| EXAMPLE | 1-1-6 | 1071 | 953 | 35 | WITHOUT | WITHOUT | 463 |
| EXAMPLE | 1-1-7 | 1072 | 951 | 31 | WITH | COOLING RATE: 10° C./SEC, 650~620° C. | 460 |
| EXAMPLE | 1-1-8 | 1074 | 951 | 31 | WITHOUT | WITHOUT | 463 |
| EXAMPLE | 1-2 | 1078 | 950 | 31 | WITHOUT | WITHOUT | 461 |
| EXAMPLE | 1-3 | 1078 | 952 | 27 | WITHOUT | WITHOUT | 479 |
| EXAMPLE | 1-4 | 1072 | 947 | 30 | WITHOUT | WITHOUT | 479 |
| EXAMPLE | 1-5 | 1074 | 952 | 26 | WITHOUT | WITHOUT | 477 |
| EXAMPLE | 1-6 | 1073 | 954 | 28 | WITHOUT | WITHOUT | 464 |
| EXAMPLE | 1-7 | 1080 | 952 | 30 | WITHOUT | WITHOUT | 463 |
| EXAMPLE | 1-8 | 1073 | 952 | 31 | WITHOUT | WITHOUT | 461 |
| EXAMPLE | 1-9 | 1072 | 952 | 28 | WITHOUT | WITHOUT | 460 |
| EXAMPLE | 1-10 | 1071 | 951 | 31 | WITHOUT | WITHOUT | 478 |
| EXAMPLE | 1-11 | 1078 | 951 | 34 | WITHOUT | WITHOUT | 478 |
| EXAMPLE | 1-12 | 1073 | 950 | 30 | WITHOUT | WITHOUT | 465 |
| EXAMPLE | 1-13 | 1079 | 951 | 33 | WITHOUT | WITHOUT | 478 |

TABLE 5-continued

| | | | | | | | |
|---|---|---|---|---|---|---|---|
| EXAMPLE | 1-14 | 1078 | 953 | 29 | WITHOUT | WITHOUT | 475 |
| EXAMPLE | 1-15 | 1070 | 954 | 30 | WITHOUT | WITHOUT | 477 |
| EXAMPLE | 1-16 | 1077 | 952 | 32 | WITHOUT | WITHOUT | 484 |
| EXAMPLE | 1-17 | 1072 | 947 | 27 | WITHOUT | WITHOUT | 483 |
| EXAMPLE | 1-18 | 1079 | 949 | 35 | WITHOUT | WITHOUT | 475 |
| EXAMPLE | 1-19 | 1072 | 953 | 35 | WITHOUT | WITHOUT | 485 |
| COMPARATIVE EXAMPLE | 1-20 | 1073 | 946 | 32 | WITHOUT | WITHOUT | 477 |
| COMPARATIVE EXAMPLE | 1-21 | 1070 | 947 | 25 | WITHOUT | WITHOUT | 475 |
| COMPARATIVE EXAMPLE | 1-22 | 1070 | 947 | 25 | WITHOUT | WITHOUT | 480 |
| EXAMPLE | 1-23-1 | 1070 | 947 | 28 | WITHOUT | WITHOUT | 481 |
| EXAMPLE | 1-23-2 | 1076 | 947 | 34 | WITHOUT | WITHOUT | 478 |
| EXAMPLE | 1-23-3 | 1078 | 945 | 31 | WITHOUT | WITHOUT | 483 |
| EXAMPLE | 1-27 | 1078 | 949 | 26 | WITHOUT | WITHOUT | 479 |
| COMPARATIVE EXAMPLE | 1-28-0 | 1079 | 951 | 27 | WITHOUT | WITHOUT | 484 |
| EXAMPLE | 1-28-1 | 1072 | 945 | 35 | WITHOUT | WITHOUT | 481 |
| COMPARATIVE EXAMPLE | 1-28-2 | 1080 | 948 | 34 | WITHOUT | WITHOUT | 478 |
| EXAMPLE | 1-28-3 | 1072 | 952 | 26 | WITHOUT | WITHOUT | 482 |
| EXAMPLE | 1-28-4 | 1076 | 946 | 27 | WITHOUT | WITHOUT | 482 |
| COMPARATIVE EXAMPLE | 1-28-5 | 1072 | 949 | 27 | WITHOUT | WITHOUT | 483 |
| COMPARATIVE EXAMPLE | 1-30 | 1000 | 940 | 30 | WITHOUT | WITHOUT | 463 |
| COMPARATIVE EXAMPLE | 1-31 | 1074 | 820 | 34 | WITHOUT | WITHOUT | 484 |
| COMPARATIVE EXAMPLE | 1-32 | 1070 | 1030 | 26 | WITHOUT | WITHOUT | 476 |
| COMPARATIVE EXAMPLE | 1-33 | 1075 | 940 | 14 | WITHOUT | WITHOUT | 480 |
| COMPARATIVE EXAMPLE | 1-34 | 1075 | 940 | 30 | WITHOUT | WITHOUT | 650 |
| COMPARATIVE EXAMPLE | 3-1 | 1080 | 950 | 29 | WITHOUT | WITHOUT | 460 |
| COMPARATIVE EXAMPLE | 3-2 | 1090 | 960 | 35 | WITHOUT | WITHOUT | 520 |
| COMPARATIVE EXAMPLE | 3-3 | 1075 | 945 | 15 | WITHOUT | WITHOUT | 500 |
| COMPARATIVE EXAMPLE | 3-4 | 1130 | 1000 | 25 | WITHOUT | WITHOUT | 510 |
| COMPARATIVE EXAMPLE | 3-5 | 1070 | 940 | 20 | WITHOUT | WITHOUT | 530 |
| COMPARATIVE EXAMPLE | 3-6 | 1070 | 940 | 20 | WITHOUT | WITHOUT | 500 |
| COMPARATIVE EXAMPLE | 3-7 | 1065 | 955 | 40 | WITHOUT | WITHOUT | 490 |
| COMPARATIVE EXAMPLE | 3-8 | 1095 | 965 | 20 | WITHOUT | WITHOUT | 500 |
| COMPARATIVE EXAMPLE | 3-9 | 1100 | 970 | 25 | WITHOUT | WITHOUT | 490 |
| COMPARATIVE EXAMPLE | 3-10 | 1080 | 950 | 22 | WITHOUT | WITHOUT | 510 |
| COMPARATIVE EXAMPLE | 3-11 | 1070 | 940 | 30 | WITHOUT | WITHOUT | 520 |

TABLE 6

| | | | MICROSTRUCTURE | | | |
|---|---|---|---|---|---|---|
| | STEEL No. | STEEL COMPOSITION | MAINLY OBSERBED PHASE | ISLAND-SHAPED MARTENSITE | AVERAGE GRAIN SIZE (μm) | COARSE PRECIPITATE |
| EXAMPLE | 1-1-1 | 1A1 | FERRITE, BAINITE | PRESENCE | 3.22 | ABSENCE |
| EXAMPLE | 1-1-2 | 1A2 | FERRITE, BAINITE | PRESENCE | 3.25 | ABSENCE |
| EXAMPLE | 1-1-3 | 1A3 | FERRITE, BAINITE | PRESENCE | 3.22 | ABSENCE |
| EXAMPLE | 1-1-4 | 1A4 | FERRITE, BAINITE | PRESENCE | 3.16 | ABSENCE |
| EXAMPLE | 1-1-5 | 1A5 | FERRITE, BAINITE | PRESENCE | 3.19 | ABSENCE |
| EXAMPLE | 1-1-6 | 1A6 | FERRITE, BAINITE | PRESENCE | 3.20 | ABSENCE |
| EXAMPLE | 1-1-7 | 1A7 | FERRITE, BAINITE | ABSENCE | 3.19 | ABSENCE |
| EXAMPLE | 1-1-8 | 1A8 | FERRITE, BAINITE | ABSENCE | 3.20 | ABSENCE |
| EXAMPLE | 1-2 | 1B | FERRITE, BAINITE | PRESENCE | 3.16 | ABSENCE |
| EXAMPLE | 1-3 | 1C | FERRITE, BAINITE | PRESENCE | 5.5 | ABSENCE |
| EXAMPLE | 1-4 | 1D | FERRITE, BAINITE | PRESENCE | 3.21 | ABSENCE |
| EXAMPLE | 1-5 | 1E | FERRITE, BAINITE | PRESENCE | 5.5 | ABSENCE |

TABLE 6-continued

| | | | | | | |
|---|---|---|---|---|---|---|
| EXAMPLE | 1-6 | 1F | FERRITE, BAINITE | PRESENCE | 3.19 | ABSENCE |
| EXAMPLE | 1-7 | 1G | FERRITE, BAINITE | PRESENCE | 3.22 | ABSENCE |
| EXAMPLE | 1-8 | 1H | FERRITE, BAINITE | PRESENCE | 3.21 | ABSENCE |
| EXAMPLE | 1-9 | 1I | FERRITE, BAINITE | PRESENCE | 3.17 | ABSENCE |
| EXAMPLE | 1-10 | 1J | FERRITE, BAINITE | PRESENCE | 3.21 | ABSENCE |
| EXAMPLE | 1-11 | 1K | FERRITE, BAINITE | PRESENCE | 3.18 | ABSENCE |
| EXAMPLE | 1-12 | 1L | FERRITE, BAINITE | PRESENCE | 3.20 | ABSENCE |
| EXAMPLE | 1-13 | 1M | FERRITE, BAINITE | PRESENCE | 3.17 | ABSENCE |
| EXAMPLE | 1-14 | 1N | FERRITE, BAINITE | PRESENCE | 3.25 | ABSENCE |
| EXAMPLE | 1-15 | 1O | FERRITE, BAINITE | PRESENCE | 3.19 | ABSENCE |
| EXAMPLE | 1-16 | 1P | FERRITE, BAINITE | PRESENCE | 3.22 | ABSENCE |
| EXAMPLE | 1-17 | 1Q | FERRITE, BAINITE | PRESENCE | 3.20 | ABSENCE |
| EXAMPLE | 1-18 | 1R | FERRITE, BAINITE | PRESENCE | 3.2 | ABSENCE |
| EXAMPLE | 1-19 | 1S | FERRITE, BAINITE | PRESENCE | 3.2 | ABSENCE |
| COMPARATIVE EXAMPLE | 1-20 | 1T | FERRITE, BAINITE | PRESENCE | 3.2 | ABSENCE |
| COMPARATIVE EXAMPLE | 1-21 | 1U | FERRITE, BAINITE | PRESENCE | 3.15 | ABSENCE |
| COMPARATIVE EXAMPLE | 1-22 | 1U2 | FERRITE, BAINITE | PRESENCE | 3.50 | ABSENCE |
| EXAMPLE | 1-23-1 | 1W1 | FERRITE, BAINITE | ABSENCE | 3.15 | ABSENCE |
| EXAMPLE | 1-23-2 | 1W2 | FERRITE, BAINITE | ABSENCE | 3.16 | ABSENCE |
| EXAMPLE | 1-23-3 | 1W3 | FERRITE, BAINITE | ABSENCE | 3.18 | ABSENCE |
| EXAMPLE | 1-27 | 1A1 | FERRITE, BAINITE | PRESENCE | 3.24 | ABSENCE |
| COMPARATIVE EXAMPLE | 1-28-0 | 1A1 | FERRITE, BAINITE | PRESENCE | 3.2 | ABSENCE |
| EXAMPLE | 1-28-1 | 1A1 | FERRITE, BAINITE | PRESENCE | 3.2 | ABSENCE |
| COMPARATIVE EXAMPLE | 1-28-2 | 1A1 | FERRITE, BAINITE | PRESENCE | 2.9 | ABSENCE |
| EXAMPLE | 1-28-3 | 1A1 | FERRITE, BAINITE | PRESENCE | 3.2 | ABSENCE |
| EXAMPLE | 1-28-4 | 1A1 | FERRITE, BAINITE | PRESENCE | 5 | ABSENCE |
| COMPARATIVE EXAMPLE | 1-28-5 | 1A1 | FERRITE, BAINITE | PRESENCE | 7 | ABSENCE |
| COMPARATIVE EXAMPLE | 1-30 | 1A1 | FERRITE, BAINITE | PRESENCE | 2.7 | ABSENCE |
| COMPARATIVE EXAMPLE | 1-31 | 1A1 | FERRITE, BAINITE | PRESENCE | 2.7 | ABSENCE |
| COMPARATIVE EXAMPLE | 1-32 | 1A1 | FERRITE, BAINITE | PRESENCE | 5.1 | ABSENCE |
| COMPARATIVE EXAMPLE | 1-33 | 1A1 | FERRITE, BAINITE, PEARITE | ABSENCE | 3.7 | ABSENCE |
| COMPARATIVE EXAMPLE | 1-34 | 1A1 | FERRITE, BAINITE, PEARITE | ABSENCE | 3.9 | ABSENCE |
| COMPARATIVE EXAMPLE | 3-1 | 3C1 | FERRITE, BAINITE | PRESENCE | 7.80 | ABSENCE |
| COMPARATIVE EXAMPLE | 3-2 | 3C2 | FERRITE, BAINITE | PRESENCE | 2.80 | GRAIN BOUNDARY CEMENTITE |
| COMPARATIVE EXAMPLE | 3-3 | 3C3 | FERRITE, BAINITE | PRESENCE | 3.30 | GRAIN BOUNDARY CEMENTITE |
| COMPARATIVE EXAMPLE | 3-4 | 3C4 | FERRITE, BAINITE | PRESENCE | 4.20 | GRAIN BOUNDARY CEMENTITE |
| COMPARATIVE EXAMPLE | 3-5 | 3C5 | FERRITE, BAINITE | PRESENCE | 3.20 | ABSENCE |
| COMPARATIVE EXAMPLE | 3-6 | 3C6 | FERRITE, BAINITE | PRESENCE | 3.30 | ABSENCE |
| COMPARATIVE EXAMPLE | 3-7 | 3C7 | FERRITE, BAINITE | PRESENCE | 3.20 | GRAIN BOUNDARY CEMENTITE |
| COMPARATIVE EXAMPLE | 3-8 | 3C8 | FERRITE, BAINITE | PRESENCE | 3.20 | TiN |
| COMPARATIVE EXAMPLE | 3-9 | 3C9 | FERRITE, BAINITE | PRESENCE | 3.20 | ABSENCE |
| COMPARATIVE EXAMPLE | 3-10 | 3C10 | FERRITE, BAINITE | PRESENCE | 6.8 | ABSENCE |
| COMPARATIVE EXAMPLE | 3-11 | 3C11 | FERRITE, BAINITE | PRESENCE | 2.20 | ABSENCE |

TABLE 6-continued

| | STEEL No. | TEXTURE RANDOM INTENSITY RATIO OF (211) PLANE | INCLUSION MAXIMUM OF MAJOR DIAMETER/ MINOR DIAMETER RATIO | SUM TOTAL M OF ROLLING DIRECTION LENGTH (mm/mm$^2$) | MAINLY OBSERBED EXTENDED INCLUSION |
|---|---|---|---|---|---|
| EXAMPLE | 1-1-1 | 2.31 | 3.0 | 0.03 | CALCIUM ALMINATE |
| EXAMPLE | 1-1-2 | 2.30 | 1.5 | 0.04 | CALCIUM ALMINATE, RESIDUE OF DESULFURIZATION MATERIAL |
| EXAMPLE | 1-1-3 | 2.25 | 1.0 | 0.00 | ABSENCE |
| EXAMPLE | 1-1-4 | 2.32 | 1.5 | 0.02 | RESIDUE OF DESULFURIZATION MATERIAL |
| EXAMPLE | 1-1-5 | 2.31 | 4.5 | 0.00 | ABSENCE |
| EXAMPLE | 1-1-6 | 2.27 | 4.5 | 0.02 | RESIDUE OF DESULFURIZATION MATERIAL |
| EXAMPLE | 1-1-7 | 2.08 | 1.0 | 0.00 | ABSENCE |
| EXAMPLE | 1-1-8 | 2.05 | 1.0 | 0.00 | ABSENCE |
| EXAMPLE | 1-2 | 2.40 | 3.0 | 0.12 | CALCIUM ALMINATE, CaS |
| EXAMPLE | 1-3 | 2.27 | 2.8 | 0.14 | CALCIUM ALMINATE, CaS |
| EXAMPLE | 1-4 | 2.32 | 2.9 | 0.15 | CALCIUM ALMINATE, CaS |
| EXAMPLE | 1-5 | 2.27 | 3.0 | 0.12 | CALCIUM ALMINATE, CaS |
| EXAMPLE | 1-6 | 2.38 | 3.0 | 0.12 | CALCIUM ALMINATE, CaS |
| EXAMPLE | 1-7 | 2.27 | 3.0 | 0.12 | CALCIUM ALMINATE, CaS |
| EXAMPLE | 1-8 | 2.27 | 1.0 | 0.00 | ABSENCE |
| EXAMPLE | 1-9 | 2.28 | 8.0 | 0.13 | CALCIUM ALMINATE, CaS |
| EXAMPLE | 1-10 | 2.29 | 8.0 | 0.19 | CALCIUM ALMINATE, CaS |
| EXAMPLE | 1-11 | 2.28 | 7.0 | 0.23 | CALCIUM ALMINATE, CaS |
| EXAMPLE | 1-12 | 2.29 | 5.8 | 0.14 | CALCIUM ALMINATE, CaS |
| EXAMPLE | 1-13 | 2.28 | 4.8 | 0.12 | CALCIUM ALMINATE, CaS |
| EXAMPLE | 1-14 | 2.26 | 4.0 | 0.11 | CALCIUM ALMINATE, CaS |
| EXAMPLE | 1-15 | 2.26 | 2.8 | 0.21 | CALCIUM ALMINATE, CaS |
| EXAMPLE | 1-16 | 2.27 | 2.0 | 0.20 | CALCIUM ALMINATE |
| EXAMPLE | 1-17 | 2.31 | 1.0 | 0.10 | CALCIUM ALMINATE |
| EXAMPLE | 1-18 | 2.30 | 1.0 | 0.00 | CALCIUM ALMINATE, CaS |
| EXAMPLE | 1-19 | 2.26 | 3.0 | 0.25 | CALCIUM ALMINATE, CaS |
| COMPARATIVE EXAMPLE | 1-20 | 2.32 | 4.0 | 0.40 | CALCIUM ALMINATE, MnS |
| COMPARATIVE EXAMPLE | 1-21 | 2.25 | 9.0 | 0.30 | MnS |
| COMPARATIVE EXAMPLE | 1-22 | 2.29 | 9.0 | 0.15 | MnS |
| EXAMPLE | 1-23-1 | 2.32 | 1.3 | 0.24 | CALCIUM ALMINATE |
| EXAMPLE | 1-23-2 | 2.31 | 1.0 | 0.23 | CALCIUM ALMINATE |
| EXAMPLE | 1-23-3 | 2.31 | 2.1 | 0.20 | CALCIUM ALMINATE, CaS |
| EXAMPLE | 1-27 | 2.30 | 3.0 | 0.06 | CALCIUM ALMINATE, CaS |
| COMPARATIVE EXAMPLE | 1-28-0 | 2.39 | 9.0 | 0.48 | CALCIUM ALMINATE, CaS |
| EXAMPLE | 1-28-1 | 2.39 | 8.0 | 0.25 | CALCIUM ALMINATE, CaS |
| COMPARATIVE EXAMPLE | 1-28-2 | 2.50 | 3.0 | 0.25 | CALCIUM ALMINATE, CaS |
| EXAMPLE | 1-28-3 | 2.49 | 2.9 | 0.24 | CALCIUM ALMINATE, CaS |
| EXAMPLE | 1-28-4 | 2.30 | 5.0 | 0.15 | CALCIUM ALMINATE, CaS |
| COMPARATIVE EXAMPLE | 1-28-5 | 2.25 | 7.0 | 0.20 | CALCIUM ALMINATE, CaS |
| COMPARATIVE EXAMPLE | 1-30 | 2.60 | 3.0 | 0.06 | CALCIUM ALMINATE, CaS |
| COMPARATIVE EXAMPLE | 1-31 | 3.46 | 3.0 | 0.06 | CALCIUM ALMINATE, CaS |
| COMPARATIVE EXAMPLE | 1-32 | 1.84 | 3.0 | 0.06 | CALCIUM ALMINATE, CaS |
| COMPARATIVE EXAMPLE | 1-33 | 2.33 | 3.0 | 0.06 | CALCIUM ALMINATE, CaS |
| COMPARATIVE EXAMPLE | 1-34 | 2.35 | 3.0 | 0.06 | CALCIUM ALMINATE, CaS |
| COMPARATIVE EXAMPLE | 3-1 | 2.10 | 3.0 | 0.03 | CALCIUM ALMINATE |
| COMPARATIVE EXAMPLE | 3-2 | 2.35 | 3.0 | 0.03 | CALCIUM ALMINATE |
| COMPARATIVE EXAMPLE | 3-3 | 2.15 | 3.0 | 0.03 | CALCIUM ALMINATE |
| COMPARATIVE EXAMPLE | 3-4 | 2.10 | 3.0 | 0.03 | CALCIUM ALMINATE |
| COMPARATIVE EXAMPLE | 3-5 | 2.50 | 3.0 | 0.03 | CALCIUM ALMINATE |

TABLE 6-continued

| | | | | | |
|---|---|---|---|---|---|
| COMPARATIVE EXAMPLE | 3-6 | 2.31 | 5.0 | 0.35 | MnS |
| COMPARATIVE EXAMPLE | 3-7 | 2.31 | 3.0 | 0.03 | CALCIUM ALMINATE |
| COMPARATIVE EXAMPLE | 3-8 | 2.25 | 3.0 | 0.03 | CALCIUM ALMINATE |
| COMPARATIVE EXAMPLE | 3-9 | 2.31 | 3.0 | 0.32 | MnS |
| COMPARATIVE EXAMPLE | 3-10 | 2.09 | 3.0 | 0.03 | CALCIUM ALMINATE |
| COMPARATIVE EXAMPLE | 3-11 | 2.5 | 3.0 | 0.03 | CALCIUM ALMINATE |

TABLE 7

| | | | MECHANICAL PROPERTIES | | | |
|---|---|---|---|---|---|---|
| | | | | BORE EXPANSION TEST | | |
| | STEEL No. | STEEL COMPOSITION | TENSILE STRENGTH (MPa) | AVERAGE λave (%) | STANDARD DEVIATION σ | n VALUE |
| EXAMPLE | 1-1-1 | 1A1 | 790 | 88 | 10 | 0.08 |
| EXAMPLE | 1-1-2 | 1A2 | 800 | 95 | 9 | 0.08 |
| EXAMPLE | 1-1-3 | 1A3 | 790 | 95 | 7 | 0.08 |
| EXAMPLE | 1-1-4 | 1A4 | 790 | 95 | 8 | 0.08 |
| EXAMPLE | 1-1-5 | 1A5 | 790 | 84 | 13 | 0.08 |
| EXAMPLE | 1-1-6 | 1A6 | 790 | 84 | 11 | 0.08 |
| EXAMPLE | 1-1-7 | 1A7 | 750 | 110 | 7 | 0.08 |
| EXAMPLE | 1-1-8 | 1A8 | 790 | 110 | 7 | 0.08 |
| EXAMPLE | 1-2 | 1B | 790 | 81 | 10 | 0.08 |
| EXAMPLE | 1-3 | 1C | 785 | 82 | 9 | 0.09 |
| EXAMPLE | 1-4 | 1D | 765 | 95 | 10 | 0.10 |
| EXAMPLE | 1-5 | 1E | 785 | 83 | 10 | 0.09 |
| EXAMPLE | 1-6 | 1F | 790 | 85 | 10 | 0.08 |
| EXAMPLE | 1-7 | 1G | 790 | 85 | 10 | 0.08 |
| EXAMPLE | 1-8 | 1H | 790 | 103 | 8 | 0.08 |
| EXAMPLE | 1-9 | 1I | 750 | 83 | 15 | 0.08 |
| EXAMPLE | 1-10 | 1J | 790 | 82 | 15 | 0.08 |
| EXAMPLE | 1-11 | 1K | 750 | 81 | 15 | 0.08 |
| EXAMPLE | 1-12 | 1L | 790 | 80 | 13 | 0.08 |
| EXAMPLE | 1-13 | 1M | 790 | 81 | 10 | 0.08 |
| EXAMPLE | 1-14 | 1N | 790 | 82 | 11 | 0.08 |
| EXAMPLE | 1-15 | 1O | 790 | 85 | 9 | 0.08 |
| EXAMPLE | 1-16 | 1P | 790 | 88 | 8 | 0.08 |
| EXAMPLE | 1-17 | 1Q | 790 | 100 | 7 | 0.08 |
| EXAMPLE | 1-18 | 1R | 790 | 87 | 8 | 0.08 |
| EXAMPLE | 1-19 | 1S | 790 | 85 | 10 | 0.08 |
| COMPARATIVE EXAMPLE | 1-20 | 1T | 790 | 70 | 18 | 0.08 |
| COMPARATIVE EXAMPLE | 1-21 | 1U | 794 | 60 | 20 | 0.08 |
| COMPARATIVE EXAMPLE | 1-22 | 1U2 | 794 | 73 | 16 | 0.08 |
| EXAMPLE | 1-23-1 | 1W1 | 790 | 90 | 8 | 0.08 |
| EXAMPLE | 1-23-2 | 1W2 | 790 | 93 | 8 | 0.08 |
| EXAMPLE | 1-23-3 | 1W3 | 790 | 100 | 8 | 0.08 |
| EXAMPLE | 1-27 | 1A1 | 774 | 86 | 10 | 0.09 |
| COMPARATIVE EXAMPLE | 1-28-0 | 1A1 | 765 | 60 | 18 | 0.09 |
| EXAMPLE | 1-28-1 | 1A1 | 790 | 80 | 10 | 0.08 |
| COMPARATIVE EXAMPLE | 1-28-2 | 1A1 | 790 | 72 | 10 | 0.08 |
| EXAMPLE | 1-28-3 | 1A1 | 790 | 85 | 9 | 0.08 |
| EXAMPLE | 1-28-4 | 1A1 | 790 | 85 | 9 | 0.08 |
| COMPARATIVE EXAMPLE | 1-28-5 | 1A1 | 790 | 82 | 10 | 0.08 |
| COMPARATIVE EXAMPLE | 1-30 | 1A1 | 802 | 73 | 10 | 0.08 |
| COMPARATIVE EXAMPLE | 1-31 | 1A1 | 810 | 65 | 10 | 0.07 |
| COMPARATIVE EXAMPLE | 1-32 | 1A1 | 785 | 80 | 10 | 0.08 |
| COMPARATIVE EXAMPLE | 1-33 | 1A1 | 775 | 74 | 10 | 0.08 |
| COMPARATIVE EXAMPLE | 1-34 | 1A1 | 790 | 70 | 9 | 0.08 |

TABLE 7-continued

| | | | | | | |
|---|---|---|---|---|---|---|
| COMPARATIVE EXAMPLE | 3-1 | 3C1 | 785 | 90 | 8 | 0.08 |
| COMPARATIVE EXAMPLE | 3-2 | 3C2 | 810 | 65 | 10 | 0.08 |
| COMPARATIVE EXAMPLE | 3-3 | 3C3 | 785 | 75 | 10 | 0.08 |
| COMPARATIVE EXAMPLE | 3-4 | 3C4 | 784 | 76 | 10 | 0.08 |
| COMPARATIVE EXAMPLE | 3-5 | 3C5 | 790 | 70 | 10 | 0.08 |
| COMPARATIVE EXAMPLE | 3-6 | 3C6 | 790 | 75 | 16 | 0.08 |
| COMPARATIVE EXAMPLE | 3-7 | 3C7 | 786 | 75 | 10 | 0.08 |
| COMPARATIVE EXAMPLE | 3-8 | 3C8 | 784 | 76 | 10 | 0.08 |
| COMPARATIVE EXAMPLE | 3-9 | 3C9 | 760 | 75 | 10 | 0.08 |
| COMPARATIVE EXAMPLE | 3-10 | 3C10 | 775 | 88 | 10 | 0.08 |
| COMPARATIVE EXAMPLE | 3-11 | 3C11 | 305 | 63 | 10 | 0.08 |

| | | MECHANICAL PROPERTIES | | | | |
|---|---|---|---|---|---|---|
| | | THREE-POINT BENDING TEST | | CHARPY IMPACT TEST | | |
| | STEEL No. | Jc ($MJ/m^2$) | T.M. ($MJ/m^2$) | FRACTURE PPEARANCE TRANSITION TEMPERATURE (° C.) | CHARPY ABSORBED ENERGY (J) | PEELING |
| EXAMPLE | 1-1-1 | 0.85 | 893 | −90 | 34.8 | SLIGHT OCCURRENCE |
| EXAMPLE | 1-1-2 | 0.94 | 880 | −89 | 36.8 | SLIGHT OCCURRENCE |
| EXAMPLE | 1-1-3 | 0.94 | 933 | −90 | 38.6 | SLIGHT OCCURRENCE |
| EXAMPLE | 1-1-4 | 0.94 | 906 | −91 | 38.8 | SLIGHT OCCURRENCE |
| EXAMPLE | 1-1-5 | 0.80 | 933 | −91 | 32.6 | SLIGHT OCCURRENCE |
| EXAMPLE | 1-1-6 | 0.80 | 906 | −90 | 32.6 | SLIGHT OCCURRENCE |
| EXAMPLE | 1-1-7 | 1.13 | 933 | −90 | 47.4 | SLIGHT OCCURRENCE |
| EXAMPLE | 1-1-8 | 1.19 | 933 | −90 | 47.4 | SLIGHT OCCURRENCE |
| EXAMPLE | 1-2 | 0.76 | 773 | −91 | 30.9 | SLIGHT OCCURRENCE |
| EXAMPLE | 1-3 | 0.78 | 746 | −27 | 31.4 | SLIGHT OCCURRENCE |
| EXAMPLE | 1-4 | 0.94 | 693 | −90 | 38.8 | SLIGHT OCCURRENCE |
| EXAMPLE | 1-5 | 0.79 | 773 | −27 | 32.9 | SLIGHT OCCURRENCE |
| EXAMPLE | 1-6 | 0.81 | 773 | −91 | 33.1 | NONE |
| EXAMPLE | 1-7 | 0.81 | 773 | −90 | 33.1 | NONE |
| EXAMPLE | 1-8 | 1.04 | 933 | −90 | 43.4 | SLIGHT OCCURRENCE |
| EXAMPLE | 1-9 | 0.79 | 760 | −91 | 32.0 | SLIGHT OCCURRENCE |
| EXAMPLE | 1-10 | 0.78 | 680 | −90 | 31.4 | SLIGHT OCCURRENCE |
| EXAMPLE | 1-11 | 0.76 | 626 | −91 | 30.9 | SLIGHT OCCURRENCE |
| EXAMPLE | 1-12 | 0.75 | 746 | −90 | 30.9 | SLIGHT OCCURRENCE |
| EXAMPLE | 1-13 | 0.76 | 773 | −91 | 30.9 | SLIGHT OCCURRENCE |
| EXAMPLE | 1-14 | 0.78 | 786 | −89 | 31.4 | SLIGHT OCCURRENCE |
| EXAMPLE | 1-15 | 0.81 | 653 | −91 | 33.1 | SLIGHT OCCURRENCE |
| EXAMPLE | 1-16 | 0.85 | 666 | −90 | 34.8 | SLIGHT OCCURRENCE |
| EXAMPLE | 1-17 | 1.00 | 800 | −90 | 41.7 | SLIGHT OCCURRENCE |

TABLE 7-continued

| | | | | | | |
|---|---|---|---|---|---|---|
| EXAMPLE | 1-18 | 0.84 | 933 | −90 | 34.3 | SLIGHT OCCURRENCE |
| EXAMPLE | 1-19 | 0.81 | 602 | −90 | 33.1 | SLIGHT OCCURRENCE |
| COMPARATIVE EXAMPLE | 1-20 | 0.62 | 400 | −90 | 24.6 | SLIGHT OCCURRENCE |
| COMPARATIVE EXAMPLE | 1-21 | 0.50 | 533 | −92 | 18.9 | SLIGHT OCCURRENCE |
| COMPARATIVE EXAMPLE | 1-22 | 0.73 | 733 | −82 | 29.1 | SLIGHT OCCURRENCE |
| EXAMPLE | 1-23-1 | 0.88 | 613 | −91 | 36.0 | SLIGHT OCCURRENCE |
| EXAMPLE | 1-23-2 | 0.91 | 526 | −91 | 37.7 | SLIGHT OCCURRENCE |
| EXAMPLE | 1-23-3 | 1.00 | 666 | −91 | 41.7 | SLIGHT OCCURRENCE |
| EXAMPLE | 1-27 | 0.83 | 853 | −89 | 33.7 | SLIGHT OCCURRENCE |
| COMPARATIVE EXAMPLE | 1-28-0 | 0.50 | 293 | −90 | 18.9 | SLIGHT OCCURRENCE |
| EXAMPLE | 1-28-1 | 0.75 | 600 | −90 | 30.3 | SLIGHT OCCURRENCE |
| COMPARATIVE EXAMPLE | 1-28-2 | 0.65 | 600 | −98 | 25.7 | SLIGHT OCCURRENCE |
| EXAMPLE | 1-28-3 | 0.81 | 613 | −90 | 33.1 | SLIGHT OCCURRENCE |
| EXAMPLE | 1-28-4 | 0.81 | 733 | −41 | 33.1 | SLIGHT OCCURRENCE |
| COMPARATIVE EXAMPLE | 1-28-5 | 0.78 | 666 | 14 | 31.4 | SLIGHT OCCURRENCE |
| COMPARATIVE EXAMPLE | 1-30 | 0.66 | 853 | −104 | 26.3 | SLIGHT OCCURRENCE |
| COMPARATIVE EXAMPLE | 1-31 | 0.56 | 853 | −104 | 21.7 | SLIGHT OCCURRENCE |
| COMPARATIVE EXAMPLE | 1-32 | 0.75 | 853 | −38 | 30.3 | SLIGHT OCCURRENCE |
| COMPARATIVE EXAMPLE | 1-33 | 0.67 | 853 | −77 | 26.9 | SLIGHT OCCURRENCE |
| COMPARATIVE EXAMPLE | 1-34 | 0.62 | 853 | −71 | 24.6 | OCCURRENCE |
| COMPARATIVE EXAMPLE | 3-1 | 0.86 | 893 | 36 | 36 | OCCURRENCE |
| COMPARATIVE EXAMPLE | 3-2 | 0.56 | 893 | −101 | 22 | SLIGHT OCCURRENCE |
| COMPARATIVE EXAMPLE | 3-3 | 0.69 | 893 | −68 | 27 | SLIGHT OCCURRENCE |
| COMPARATIVE EXAMPLE | 3-4 | 0.70 | 893 | −63 | 28 | SLIGHT OCCURRENCE |
| COMPARATIVE EXAMPLE | 3-5 | 0.62 | 893 | −90 | 25 | SLIGHT OCCURRENCE |
| COMPARATIVE EXAMPLE | 3-6 | 0.69 | 466 | −90 | 27 | SLIGHT OCCURRENCE |
| COMPARATIVE EXAMPLE | 3-7 | 0.69 | 893 | −90 | 27 | SLIGHT OCCURRENCE |
| COMPARATIVE EXAMPLE | 3-8 | 0.70 | 893 | −90 | 28 | SLIGHT OCCURRENCE |
| COMPARATIVE EXAMPLE | 3-9 | 0.69 | 506 | −90 | 27 | SLIGHT OCCURRENCE |
| COMPARATIVE EXAMPLE | 3-10 | 0.85 | 893 | 8 | 35 | SLIGHT OCCURRENCE |
| COMPARATIVE EXAMPLE | 3-11 | 0.60 | 833 | −116 | 23 | SLIGHT OCCURRENCE |

In Steel numbers 1-1-1 to 1-1-8, 1-2 to 1-19, 1-23-1 to 1-23-3, 1-28-1, 1-28-3, and 1-28-4, the requirements of the present invention were satisfied. Therefore, the tensile strength was 780 MPa or more, the average λave of the bore expansion ratio was 80% or more, the standard deviation σ of the bore expansion ratio was 15% or less, the n value was 0.08 or more, the crack occurrence resistance value Jc was 0.75 $MJ/m^2$ or more, the crack propagation resistance value T. M. was 600 $MJ/m^3$ or more, the fracture appearance transition temperature was −13° C. or lower, and the Charpy absorbed energy was 30 J or more. That is, the desired characteristic values were able to be obtained. Even in Steel number 1-27, the requirements of the present invention were satisfied, so that the desired characteristic values were able to be obtained substantially. Further, in Steel numbers 1-1-1 to 1-1-4, 1-1-7, 1-1-8, 1-2 to 1-8, 1-15 to 1-19, 1-23-1 to 1-23-3, 1-27, and 1-28-3, the requirements of the present invention were satisfied and the maximum of the major diameter/minor diameter ratio of the inclusion was 3.0 or less. Therefore, it was possible to obtain the preferable characteristic values of the average λave of the bore expansion ratio being 85% or more and the standard deviation σ being 10% or less. Further, in Steel numbers 1-1-3, 1-1-5, 1-1-7, 1-1-8, and 1-8, the requirements of the present invention were satisfied, Ca was not added or Ca was added in minute amounts, and the desulfurization with the desulfurization material was not performed. Therefore, it was possible to obtain the preferable characteristic values of the sum total M of the rolling direction length of the inclusion being 0.01 mm/mm$^2$ or less and the crack propagation resistance value T. M. being 900 MJ/m$^3$ or more. Further, the average λave of the bore expansion ratio, the crack occurrence resistance value Jc, and the Charpy absorbed energy were also made better.

Particularly, Steel numbers 1-1-3 to 1-1-6 each are an example where Ca and REM were hardly added and the control of the form of sulfide was performed only with Ti practically. Among Steel numbers 1-1-3 to 1-1-6, Steel numbers 1-1-3 and 1-1-5 each are an example where the desulfurization material was not used, and were able to obtain the good characteristic values respectively.

In Steel numbers 1-1-7 and 1-1-8, the Si content was small in particular, so that island-shaped martensite was also not observed. Further, Ca was hardly added and the form of sulfide was controlled, and further the desulfurization material was not used, and thus no extended-shaped inclusions were formed, and particularly the good characteristic values were able to be obtained.

In Steel number 1-2, the Nb content was relatively high, so that the {211} plane intensity was relatively high. In Steel number 1-3, the Nb content was relatively low, so that the tensile strength was relatively low. In Steel number 1-4, the Ti content was relatively low, so that the tensile strength was relatively low. In Steel number 1-5, the C content was relatively low, so that the average λave of the bore expansion ratio and the crack occurrence resistance value Jc were relatively low, and the fracture appearance transition temperature was relatively high. In Steel number 1-6, the B content was relatively high, so that the {211} plane intensity was relatively high. Further, the peeling did not occur at all.

Steel number 1-7 was an example of the present invention, and a preferable amount of B was contained, so that the peeling did not occur at all.

Steel number 1-8 was an example of the present invention, without adding Ca, the form of sulfide was controlled, and further the desulfurization material was not used, so that the number of the extended-shaped inclusions was extremely small and particularly the good characteristic values were able to be obtained.

Each of Steel numbers 1-9 to 1-14 was an example of the present invention, but REM was not added or REM was added in minute amounts, and thus the value of ([REM]/140)/([Ca]/40) was less than 0.3, the maximum of the major diameter/minor diameter ratio of the inclusion was slightly high, and the standard deviation σ of the bore expansion ratio was slightly large.

In Steel numbers 1-23-1 to 1-23-3, the Si content was small in particular, so that island-shaped martensite was not observed, and the average λave of the bore expansion ratio, the crack occurrence resistance value Jc, and the Charpy absorbed energy were better in particular.

Steel number 1-27 was an example of the present invention, but the heating temperature was lower than 1200° C., so that the tensile strength was slightly low.

In Steel numbers 1-20 and 1-21, the parameter Q was less than 30.0, and Mathematical expression 2 was not satisfied, so that it was not possible to obtain the sum total M of the rolling direction length of the inclusion and the maximum of the major diameter/minor diameter ratio that are required in the present invention. Therefore, it was not possible to obtain the desired average λave and standard deviation σ of the bore expansion ratio, crack occurrence resistance value Jc, crack propagation resistance value T. M., and Charpy absorbed energy.

In Steel number 1-22, the accumulated reduction ratio of the rough-rolling in the temperature zone exceeding 1150° C. was larger than the present invention range, so that the maximum of the major diameter/minor diameter ratio of the inclusion was larger than the value required in the present invention and the average λave of the bore expansion ratio, the standard deviation σ of the bore expansion ratio, the crack occurrence resistance value Jc, and the Charpy absorbed energy were deteriorated.

In Steel number 1-28-0, the accumulated reduction ratio of the rough-rolling in the temperature zone exceeding 1150° C. was larger than the present invention range, so that the sum total M of the rolling direction length of the inclusion and the maximum of the major diameter/minor diameter ratio of the inclusion were larger than the values required in the present invention and the average λave of the bore expansion ratio, the standard deviation σ of the bore expansion ratio, the crack occurrence resistance value Jc, the crack propagation resistance value T. M., and the Charpy absorbed energy were deteriorated.

In Steel number 1-28-2, the accumulated reduction ratio of the rough-rolling in the temperature zone of 1150° C. or lower was larger than the present invention range, so that it was not possible to obtain the {211} plane intensity required in the present invention. Therefore, it was not possible to obtain the desired average λave of the bore expansion ratio, crack occurrence resistance value Jc, and Charpy absorbed energy.

In Steel number 1-28-5, the accumulated reduction ratio of the rough-rolling in the temperature zone of 1150° C. or lower was smaller than the present invention range, so that the average grain size of the microstructure was larger than the value required in the present invention. Therefore, the fracture appearance transition temperature was higher than the desired value.

In Steel number 1-30, the beginning temperature of the finish-rolling was lower than the present invention range, so that the {211} plane intensity was higher than the value required in the present invention. Further, since the {211} plane intensity was higher than the value required in the present invention, it was not possible to obtain the desired average λave of the bore expansion ratio, crack occurrence resistance value Jc, and Charpy absorbed energy.

In Steel number 1-31, the finishing temperature of the finish-rolling was lower than the present invention range, so that the {211} plane intensity was higher than the value required in the present invention. Further, since the {211} plane intensity was higher than the value required in the present invention, it was not possible to obtain the desired average λave of the bore expansion ratio, crack occurrence resistance value Jc, and Charpy absorbed energy.

In Steel number 1-32, the finishing temperature of the finish-rolling was higher than the present invention range, and the average grain size of the microstructure was larger than the present invention range, so that the fracture appearance transition temperature was higher than the desired value.

In Steel number 1-33, the cooling rate was smaller than the present invention range, so that pearlite was formed and it was not possible to obtain the desired average λave of the bore expansion ratio, crack occurrence resistance value Jc, and Charpy absorbed energy.

In Steel number 1-34, the coiling temperature was higher than the present invention range, so that pearlite was formed and it was not possible to obtain the desired average λave of the bore expansion ratio, crack occurrence resistance value Jc, and Charpy absorbed energy.

In Steel number 3-1, the C content was lower than the present invention range, so that the average grain size was larger than the value required in the present invention. As a result, the fracture appearance transition temperature was extremely high and the peeling occurred. In Steel number 3-2, the C content was higher than the present invention range, so that coarse grain boundary cementite having a size of exceeding 2 μm precipitated. As a result, it was not possible to obtain the desired average λave of the bore expansion ratio, crack occurrence resistance value Jc, and Charpy absorbed energy.

In Steel number 3-3, the Si content was lower than the present invention range, so that coarse grain boundary cementite having a size of exceeding 2 μm precipitated. As a result, it was not possible to obtain the desired average λave of the bore expansion ratio, crack occurrence resistance value Jc, and Charpy absorbed energy.

In Steel number 3-4, the Mn content was lower than the present invention range, so that coarse grain boundary cementite having a size of exceeding 2 μm precipitated. As a result, it was not possible to obtain the desired average λave of the bore expansion ratio, crack occurrence resistance value Jc, and Charpy absorbed energy.

In Steel number 3-5, the P content was higher than the present invention range, so that the {211} plane intensity was higher than the value required in the present invention. Further, since the {211} plane intensity was higher than the value required in the present invention, it was not possible to obtain the desired average λave of the bore expansion ratio, crack occurrence resistance value Jc, and Charpy absorbed energy.

In Steel number 3-6, the S content was higher than the present invention range, so that the maximum of the major diameter/minor diameter ratio of the inclusion was larger than the value required in the present invention. As a result, the average λave of the bore expansion ratio, the standard deviation σ of the bore expansion ratio, the crack occurrence resistance value Jc, the crack propagation resistance value T. M., and the Charpy absorbed energy were deteriorated.

In Steel number 3-7, the Al content was lower than the present invention range, so that coarse grain boundary cementite having a size of exceeding 2 μm precipitated. As a result, it was not possible to obtain the desired average λave of the bore expansion ratio, crack occurrence resistance value Jc, and Charpy absorbed energy.

In Steel number 3-8, the N content was higher than the present invention range, so that coarse TiN having a size of exceeding 2 μm precipitated. As a result, it was not possible to obtain the desired average λave of the bore expansion ratio, crack occurrence resistance value Jc, and Charpy absorbed energy.

In Steel number 3-9, the Ti content was lower than the present invention range, so that it was not possible to obtain the desired tensile strength. Further, MnS precipitated, and the sum total M of the rolling direction length of the inclusion was higher than the value required in the present invention. Therefore, it was not possible to obtain the desired average λave of the bore expansion ratio, crack occurrence resistance value Jc, crack propagation resistance value T. M., and Charpy absorbed energy.

In Steel number 3-10, the Nb content was lower than the present invention range, so that the average grain size was larger than the value required in the present invention. As a result, the tensile strength and toughness were low. In Steel number 3-11, the Nb content was higher than the present invention range, so that the non-recrystallized rolled texture existed and the {211} plane intensity was higher than the value required in the present invention. Further, since the {211} plane intensity was higher than the value required in the present invention, it was not possible to obtain the desired average λave of the bore expansion ratio, crack occurrence resistance value Jc, and Charpy absorbed energy.

Second Experiment

First, molten steels containing steel compositions 2A1 to 2W3 listed in Table 8 were obtained. Each of the molten steels was manufactured through performing melting and secondary refining in a steel converter. The secondary refining was performed in an RH, and desulfurization was performed with a $CaO—CaF_2—MgO$ based desulfurization material added as needed. In some of the steel compositions, in order to prevent the desulfurization material to be the extended inclusion from remaining, desulfurization was not performed and the process was advanced in a manner to keep the S content obtained after primary refining in a steel converter unchanged. From each of the molten steels, a steel slab was obtained through continuous casting, and thereafter, hot rolling was performed under manufacturing conditions listed in Table 9, and thereby hot-rolled steel sheets each having a thickness of 2.9 mm were obtained. Characteristic values of the microstructure, the texture, and the inclusions of the obtained hot-rolled steel sheets are listed in Table 10, and mechanical properties of the obtained hot-rolled steel sheets are listed in Table 11. The methods of measuring the microstructure, the texture, and the inclusions, and the methods of measuring the mechanical property are as described above. Incidentally, in the evaluation of the bore expandability, 20 test pieces were made from a single sample steel. Each underline in Table 8 to Table 11 indicates that the value is outside the range of the present invention, or no desired characteristic value is obtained.

TABLE 8

| STEEL | CHEMICAL COMONENT (UNIT: MASS %) | | | | | | | | | | | | | | |
|---|---|---|---|---|---|---|---|---|---|---|---|---|---|---|---|
| COMPOSITION | C | Si | Mn | P | S | Al | N | Ti | REM | Ca | Nb | V | *1 | *2 | OTHER ELEMENTS |
| 2A1 | 0.039 | 1.10 | 1.25 | 0.007 | 0.0030 | 0.023 | 0.0021 | 0.13 | 0.0040 | 0.0038 | 0.001 | 0.080 | 48.66 | 0.30 | — |
| 2A2 | 0.036 | 1.20 | 1.2 | 0.008 | 0.0010 | 0.020 | 0.0025 | 0.13 | 0.0025 | 0.0020 | 0.001 | 0.045 | 119.24 | 0.36 | — |
| 2A3 | 0.040 | 0.90 | 1.35 | 0.011 | 0.0040 | 0.029 | 0.0029 | 0.18 | 0.0000 | 0.0000 | 0.001 | 0.070 | 30.00 | ∞ | — |
| 2A4 | 0.035 | 1.80 | 0.7 | 0.009 | 0.0010 | 0.026 | 0.0021 | 0.12 | 0.0000 | 0.0000 | 0.007 | 0.065 | 80.00 | ∞ | — |
| 2A5 | 0.043 | 1.20 | 1.05 | 0.01 | 0.0040 | 0.028 | 0.0020 | 0.18 | 0.0000 | 0.0003 | 0.001 | 0.070 | 30.90 | 0.00 | — |
| 2A6 | 0.039 | 1.00 | 1.25 | 0.011 | 0.0010 | 0.025 | 0.0029 | 0.18 | 0.0000 | 0.0004 | 0.001 | 0.060 | 124.80 | 0.00 | — |
| 2A7 | 0.040 | 0.10 | 1.85 | 0.012 | 0.0030 | 0.025 | 0.0027 | 0.13 | 0.0050 | 0.0000 | 0.002 | 0.055 | 34.60 | ∞ | — |
| 2A8 | 0.020 | 0.10 | 1.87 | 0.008 | 0.0035 | 0.028 | 0.0029 | 0.13 | 0.0050 | 0.0003 | 0.001 | 0.061 | 30.69 | 4.76 | — |
| 2B | 0.036 | 1.05 | 1.25 | 0.01 | 0.0044 | 0.024 | 0.0029 | 0.13 | 0.0040 | 0.0038 | 0.015 | 0.050 | 33.18 | 0.30 | — |
| 2C | 0.039 | 1.50 | 1.4 | 0.011 | 0.0045 | 0.027 | 0.0028 | 0.14 | 0.0040 | 0.0034 | 0.001 | 0.005 | 32.86 | 0.34 | — |
| 2D | 0.039 | 1.45 | 1.42 | 0.012 | 0.0035 | 0.021 | 0.0026 | 0.048 | 0.0055 | 0.0050 | 0.001 | 0.040 | 31.67 | 0.31 | — |
| 2E | 0.027 | 0.85 | 1.25 | 0.012 | 0.0040 | 0.023 | 0.0024 | 0.12 | 0.0040 | 0.0037 | 0.001 | 0.056 | 34.53 | 0.31 | — |
| 2F | 0.042 | 0.89 | 1.27 | 0.008 | 0.0040 | 0.021 | 0.0022 | 0.11 | 0.0040 | 0.0038 | 0.001 | 0.080 | 33.16 | 0.30 | B: 0.0034 |
| 2G | 0.035 | 0.94 | 1.26 | 0.006 | 0.0040 | 0.028 | 0.0029 | 0.13 | 0.0040 | 0.0037 | 0.001 | 0.054 | 36.20 | 0.31 | B: 0.0017 |

TABLE 8-continued

| STEEL COMPOSITION | CHEMICAL COMONENT (UNIT: MASS %) | | | | | | | | | | | | | | |
|---|---|---|---|---|---|---|---|---|---|---|---|---|---|---|---|
| | C | Si | Mn | P | S | Al | N | Ti | REM | Ca | Nb | V | *1 | *2 | OTHER ELEMENTS |
| 2H | 0.049 | 0.98 | 1.15 | 0.005 | 0.0040 | 0.022 | 0.0025 | 0.14 | 0.0100 | 0.0000 | 0.001 | 0.060 | 31.90 | ∞ | Cr: 0.1, Mo: 0.05 |
| 2I | 0.040 | 1.12 | 1.05 | 0.011 | 0.0040 | 0.025 | 0.0022 | 0.13 | 0.0000 | 0.0050 | 0.001 | 0.070 | 36.67 | 0.00 | — |
| 2J | 0.040 | 1.20 | 1.25 | 0.012 | 0.0040 | 0.027 | 0.0025 | 0.13 | 0.0000 | 0.0040 | 0.001 | 0.060 | 33.67 | 0.00 | — |
| 2K | 0.035 | 1.10 | 1.15 | 0.009 | 0.0040 | 0.021 | 0.0024 | 0.12 | 0.0010 | 0.0031 | 0.001 | 0.040 | 30.16 | 0.09 | — |
| 2L | 0.032 | 1.08 | 1.25 | 0.011 | 0.0040 | 0.029 | 0.0023 | 0.11 | 0.0020 | 0.0042 | 0.001 | 0.055 | 32.65 | 0.14 | — |
| 2M | 0.040 | 1.05 | 1.24 | 0.012 | 0.0040 | 0.027 | 0.0027 | 0.13 | 0.0032 | 0.0044 | 0.001 | 0.068 | 37.61 | 0.21 | — |
| 2N | 0.035 | 1.15 | 1.18 | 0.014 | 0.0040 | 0.020 | 0.0026 | 0.14 | 0.0034 | 0.0040 | 0.001 | 0.070 | 38.25 | 0.24 | — |
| 2O | 0.038 | 0.90 | 1.21 | 0.008 | 0.0038 | 0.022 | 0.0020 | 0.12 | 0.0027 | 0.0025 | 0.001 | 0.056 | 31.38 | 0.31 | Cu: 0.2, Ni: 0.1 |
| 2P | 0.042 | 0.89 | 1.22 | 0.009 | 0.0040 | 0.024 | 0.0029 | 0.13 | 0.0031 | 0.0024 | 0.001 | 0.046 | 31.52 | 0.37 | V: 0.02 |
| 2Q | 0.041 | 0.95 | 1.18 | 0.011 | 0.0040 | 0.023 | 0.0024 | 0.11 | 0.0055 | 0.0040 | 0.001 | 0.049 | 35.05 | 0.39 | — |
| 2R | 0.042 | 1.02 | 1.2 | 0.012 | 0.0035 | 0.024 | 0.0023 | 0.13 | 0.0038 | 0.0035 | 0.001 | 0.050 | 40.48 | 0.31 | — |
| 2S | 0.035 | 1.00 | 1.21 | 0.014 | 0.0043 | 0.026 | 0.0021 | 0.12 | 0.0032 | 0.0032 | 0.001 | 0.080 | 30.09 | 0.29 | — |
| 2T | 0.045 | 1.03 | 1.22 | 0.009 | 0.0072 | 0.024 | 0.0022 | 0.13 | 0.0034 | 0.0041 | 0.001 | 0.070 | 20.45 | 0.24 | — |
| 2U | 0.034 | 1.20 | 1.1 | 0.008 | 0.0100 | 0.025 | 0.0021 | 0.13 | 0.0015 | 0.0023 | 0.001 | 0.070 | 11.94 | 0.19 | — |
| 2U2 | 0.040 | 1.05 | 1.3 | 0.009 | 0.0021 | 0.025 | 0.0030 | 0.12 | 0.0020 | 0.0018 | 0.001 | 0.070 | 51.65 | 0.32 | — |
| 2W1 | 0.046 | 0.05 | 1.95 | 0.011 | 0.0040 | 0.030 | 0.0024 | 0.13 | 0.0032 | 0.0022 | 0.001 | 0.060 | 31.01 | 0.42 | — |
| 2W2 | 0.039 | 0.10 | 1.85 | 0.012 | 0.0038 | 0.023 | 0.0030 | 0.12 | 0.0031 | 0.0024 | 0.001 | 0.070 | 31.43 | 0.37 | — |
| 2W3 | 0.050 | 0.08 | 2.05 | 0.008 | 0.0040 | 0.024 | 0.0026 | 0.13 | 0.0030 | 0.0026 | 0.001 | 0.080 | 32.04 | 0.33 | — |

The symbol "—" means that the element is not added and that the content of the element is as low as inevitable impurities.

*1: ([Ti]/48/([S]/32)) + ([Ca]/40 + [REM]/140)/[S]/32*15) (PARMETER Q)

*2: ([REM]/140)/([Ca]/40)

TABLE 9

| | | | | MANUFACTURING CONDITION | | | |
|---|---|---|---|---|---|---|---|
| | | | | | | ACCUMULATED REDUCTION RATIO (%) | |
| | STEEL No. | STEEL COMPOSITION | Ar3 TRANSFORMATION TEMPERATURE | DESULFURIZATION MATERIAL IN SECONDARY REFINING | HEATING HEATING TEMPERATURE (° C.) | TEMPERATURE ZONE EXCEEDING 1150° C. | TEMPERATURE ZONE OF 1150° C. OR LOWER |
| EXAMPLE | 2-1-1 | 2A1 | 795 | WITHOUT | 1250 | 65 | 21 |
| EXAMPLE | 2-1-2 | 2A2 | 802 | WITH | 1250 | 65 | 21 |
| EXAMPLE | 2-1-3 | 2A3 | 783 | WITHOUT | 1250 | 65 | 21 |
| EXAMPLE | 2-1-4 | 2A4 | 852 | WITH | 1250 | 65 | 21 |
| EXAMPLE | 2-1-5 | 2A5 | 810 | WITHOUT | 1250 | 65 | 21 |
| EXAMPLE | 2-1-6 | 2A6 | 793 | WITH | 1250 | 65 | 21 |
| EXAMPLE | 2-1-7 | 2A7 | 729 | WITHOUT | 1250 | 65 | 21 |
| EXAMPLE | 2-1-8 | 2A8 | 735 | WITHOUT | 1250 | 65 | 21 |
| EXAMPLE | 2-2 | 2B | 795 | WITHOUT | 1250 | 65 | 21 |
| EXAMPLE | 2-3 | 2C | 795 | WITHOUT | 1250 | 65 | 21 |
| EXAMPLE | 2-4 | 2D | 792 | WITHOUT | 1250 | 65 | 21 |
| EXAMPLE | 2-5 | 2E | 794 | WITHOUT | 1250 | 65 | 21 |
| EXAMPLE | 2-6 | 2F | 787 | WITHOUT | 1250 | 65 | 21 |
| EXAMPLE | 2-7 | 2G | 792 | WITHOUT | 1250 | 65 | 21 |
| EXAMPLE | 2-8 | 2H | 795 | WITHOUT | 1250 | 65 | 21 |
| EXAMPLE | 2-9 | 2I | 809 | WITHOUT | 1250 | 65 | 21 |
| EXAMPLE | 2-10 | 2J | 797 | WITHOUT | 1250 | 65 | 21 |
| EXAMPLE | 2-11 | 2K | 803 | WITHOUT | 1250 | 65 | 21 |
| EXAMPLE | 2-12 | 2L | 797 | WITHOUT | 1250 | 65 | 21 |
| EXAMPLE | 2-13 | 2M | 794 | WITHOUT | 1250 | 65 | 21 |
| EXAMPLE | 2-14 | 2N | 803 | WITHOUT | 1250 | 65 | 21 |
| EXAMPLE | 2-15 | 2O | 793 | WITHOUT | 1250 | 65 | 21 |
| EXAMPLE | 2-16 | 2P | 731 | WITHOUT | 1250 | 65 | 21 |
| EXAMPLE | 2-17 | 2Q | 795 | WITHOUT | 1250 | 65 | 21 |
| EXAMPLE | 2-18 | 2R | 795 | WITHOUT | 1250 | 65 | 21 |
| EXAMPLE | 2-19 | 2S | 797 | WITHOUT | 1250 | 65 | 21 |
| COMPARATIVE EXAMPLE | 2-20 | 2T | 793 | WITHOUT | 1250 | 65 | 21 |
| COMPARATIVE EXAMPLE | 2-21 | 2U | 810 | WITHOUT | 1250 | 65 | 21 |
| COMPARATIVE EXAMPLE | 2-22 | 2U2 | 790 | WITHOUT | 1250 | 71 | 21 |
| EXAMPLE | 2-23-1 | 2W1 | 718 | WITHOUT | 1250 | 65 | 21 |
| EXAMPLE | 2-23-2 | 2W2 | 729 | WITHOUT | 1250 | 65 | 21 |
| EXAMPLE | 2-23-3 | 2W3 | 711 | WITHOUT | 1250 | 65 | 21 |
| EXAMPLE | 2-27 | 2A1 | 795 | WITHOUT | 1150 | 65 | 21 |

TABLE 9-continued

| | | | | | | | |
|---|---|---|---|---|---|---|---|
| COMPARATIVE EXAMPLE | 2-28-0 | 2A1 | 795 | WITHOUT | 1250 | 75 | 11 |
| EXAMPLE | 2-28-1 | 2A1 | 795 | WITHOUT | 1250 | 70 | 16 |
| COMPARATIVE EXAMPLE | 2-28-2 | 2A1 | 795 | WITHOUT | 1250 | 58 | 32 |
| EXAMPLE | 2-28-3 | 2A1 | 795 | WITHOUT | 1250 | 61 | 25 |
| EXAMPLE | 2-28-4 | 2A1 | 795 | WITHOUT | 1248 | 67 | 10 |
| COMPARATIVE EXAMPLE | 2-28-5 | 2A1 | 795 | WITHOUT | 1249 | 70 | 8 |
| COMPARATIVE EXAMPLE | 2-30 | 2A1 | 795 | WITHOUT | 1250 | 65 | 21 |
| COMPARATIVE EXAMPLE | 2-31 | 2A1 | 795 | WITHOUT | 1250 | 65 | 21 |
| COMPARATIVE EXAMPLE | 2-32 | 2A1 | 795 | WITHOUT | 1250 | 65 | 21 |
| COMPARATIVE EXAMPLE | 2-33 | 2A1 | 795 | WITHOUT | 1250 | 65 | 21 |
| COMPARATIVE EXAMPLE | 2-34 | 2A1 | 795 | WITHOUT | 1250 | 65 | 21 |

| | | MANUFACTURING CONDITION | | | | | |
|---|---|---|---|---|---|---|---|
| | | FINISH-ROLLING | | COOLING | | | COILING |
| | STEEL No. | BEGINNING TEMPERATURE (° C.) | FINISHING TEMPERATURE (° C.) | COOLING RATE (° C./SEC) | THREE-STAGE COOLING | CONDITION FOR SECOND COOLING | COILING TEMPERATURE (° C.) |
| EXAMPLE | 2-1-1 | 1072 | 947 | 29 | WITOUT | WITOUT | 483 |
| EXAMPLE | 2-1-2 | 1074 | 949 | 30 | WITOUT | WITOUT | 479 |
| EXAMPLE | 2-1-3 | 1071 | 955 | 33 | WITOUT | WITOUT | 475 |
| EXAMPLE | 2-1-4 | 1077 | 985 | 27 | WITH | COOLING RAGE: 10° C./SEC, 580~550° C. | 475 |
| EXAMPLE | 2-1-5 | 1075 | 948 | 32 | WITOUT | WITOUT | 481 |
| EXAMPLE | 2-1-6 | 1071 | 953 | 35 | WITOUT | WITOUT | 463 |
| EXAMPLE | 2-1-7 | 1072 | 951 | 31 | WITH | COOLING RATE: 10° C./SEC, 650~620° C. | 480 |
| EXAMPLE | 2-1-8 | 1074 | 951 | 31 | WITOUT | WITOUT | 483 |
| EXAMPLE | 2-2 | 1078 | 950 | 31 | WITOUT | WITOUT | 481 |
| EXAMPLE | 2-3 | 1078 | 952 | 27 | WITOUT | WITOUT | 479 |
| EXAMPLE | 2-4 | 1072 | 947 | 30 | WITOUT | WITOUT | 479 |
| EXAMPLE | 2-5 | 1074 | 952 | 26 | WITOUT | WITOUT | 477 |
| EXAMPLE | 2-6 | 1073 | 954 | 28 | WITOUT | WITOUT | 484 |
| EXAMPLE | 2-7 | 1080 | 952 | 30 | WITOUT | WITOUT | 483 |
| EXAMPLE | 2-8 | 1073 | 952 | 31 | WITOUT | WITOUT | 481 |
| EXAMPLE | 2-9 | 1072 | 952 | 23 | WITOUT | WITOUT | 480 |
| EXAMPLE | 2-10 | 1071 | 951 | 31 | WITOUT | WITOUT | 478 |
| EXAMPLE | 2-11 | 1078 | 951 | 34 | WITOUT | WITOUT | 478 |
| EXAMPLE | 2-12 | 1073 | 950 | 30 | WITOUT | WITOUT | 485 |
| EXAMPLE | 2-13 | 1079 | 951 | 33 | WITOUT | WITOUT | 478 |
| EXAMPLE | 2-14 | 1078 | 953 | 29 | WITOUT | WITOUT | 475 |
| EXAMPLE | 2-15 | 1070 | 954 | 30 | WITOUT | WITOUT | 477 |
| EXAMPLE | 2-16 | 1077 | 952 | 32 | WITOUT | WITOUT | 484 |
| EXAMPLE | 2-17 | 1072 | 947 | 27 | WITOUT | WITOUT | 483 |
| EXAMPLE | 2-18 | 1079 | 949 | 28 | WITOUT | WITOUT | 475 |
| EXAMPLE | 2-19 | 1072 | 953 | 33 | WITOUT | WITOUT | 485 |
| COMPARATIVE EXAMPLE | 2-20 | 1073 | 946 | 32 | WITOUT | WITOUT | 477 |
| COMPARATIVE EXAMPLE | 2-21 | 1070 | 947 | 25 | WITOUT | WITOUT | 475 |
| COMPARATIVE EXAMPLE | 2-22 | 1070 | 1000 | 25 | WITOUT | WITOUT | 480 |
| EXAMPLE | 2-23-1 | 1070 | 947 | 28 | WITOUT | WITOUT | 481 |
| EXAMPLE | 2-23-2 | 1076 | 947 | 34 | WITOUT | WITOUT | 478 |
| EXAMPLE | 2-23-3 | 1078 | 945 | 31 | WITOUT | WITOUT | 483 |
| EXAMPLE | 2-27 | 1078 | 949 | 26 | WITOUT | WITOUT | 479 |
| COMPARATIVE EXAMPLE | 2-28-0 | 1079 | 951 | 27 | WITOUT | WITOUT | 484 |
| EXAMPLE | 2-28-1 | 1072 | 945 | 35 | WITOUT | WITOUT | 481 |
| COMPARATIVE EXAMPLE | 2-28-2 | 1080 | 948 | 34 | WITOUT | WITOUT | 478 |
| EXAMPLE | 2-28-3 | 1072 | 952 | 26 | WITOUT | WITOUT | 482 |
| EXAMPLE | 2-28-4 | 1076 | 946 | 27 | WITOUT | WITOUT | 482 |
| COMPARATIVE EXAMPLE | 2-28-5 | 1072 | 949 | 27 | WITOUT | WITOUT | 483 |
| COMPARATIVE EXAMPLE | 2-30 | 990 | 940 | 30 | WITOUT | WITOUT | 483 |

TABLE 9-continued

| | | | | | | | |
|---|---|---|---|---|---|---|---|
| COMPARATIVE EXAMPLE | 2-31 | 1074 | 820 | 34 | WITOUT | WITOUT | 484 |
| COMPARATIVE EXAMPLE | 2-32 | 1070 | 1030 | 26 | WITOUT | WITOUT | 476 |
| COMPARATIVE EXAMPLE | 2-33 | 1075 | 940 | 14 | WITOUT | WITOUT | 480 |
| COMPARATIVE EXAMPLE | 2-34 | 1075 | 940 | 30 | WITOUT | WITOUT | 650 |

TABLE 10

| | | | MICROSTCTURE | | | |
|---|---|---|---|---|---|---|
| | STEEL No. | STEEL COMPOSITION | MAINLY OBSERBED PHASE | ISLAND-SHAPED MARTENSITE | AVERAGE GRAIN SIZE (μm) | COARSE PRECIPITATE |
| EXAMPLE | 2-1-1 | 2A1 | FERRITE, BAINITE | PRESENCE | 3.86 | ABSENCE |
| EXAMPLE | 2-1-2 | 2A2 | FERRITE, BAINITE | PRESENCE | 3.90 | ABSENCE |
| EXAMPLE | 2-1-3 | 2A3 | FERRITE, BAINITE | PRESENCE | 3.87 | ABSENCE |
| EXAMPLE | 2-1-4 | 2A4 | FERRITE, BAINITE | PRESENCE | 3.79 | ABSENCE |
| EXAMPLE | 2-1-5 | 2A5 | FERRITE, BAINITE | PRESENCE | 3.83 | ABSENCE |
| EXAMPLE | 2-1-6 | 2A6 | FERRITE, BAINITE | PRESENCE | 3.84 | ABSENCE |
| EXAMPLE | 2-1-7 | 2A7 | FERRITE, BAINITE | ABSENCE | 3.83 | ABSENCE |
| EXAMPLE | 2-1-8 | 2A8 | FERRITE, BAINITE | ABSENCE | 5.50 | ABSENCE |
| EXAMPLE | 2-2 | 2B | FERRITE, BAINITE | PRESENCE | 3.79 | ABSENCE |
| EXAMPLE | 2-3 | 2C | FERRITE, BAINITE | PRESENCE | 6.00 | ABSENCE |
| EXAMPLE | 2-4 | 2D | FERRITE, BAINITE | PRESENCE | 3.85 | ABSENCE |
| EXAMPLE | 2-5 | 2E | FERRITE, BAINITE | PRESENCE | 5.90 | ABSENCE |
| EXAMPLE | 2-6 | 2F | FERRITE, BAINITE | PRESENCE | 3.82 | ABSENCE |
| EXAMPLE | 2-7 | 2G | FERRITE, BAINITE | PRESENCE | 3.87 | ABSENCE |
| EXAMPLE | 2-8 | 2H | FERRITE, BAINITE | PRESENCE | 3.85 | ABSENCE |
| EXAMPLE | 2-9 | 2I | FERRITE, BAINITE | PRESENCE | 3.80 | ABSENCE |
| EXAMPLE | 2-10 | 2J | FERRITE, BAINITE | PRESENCE | 3.85 | ABSENCE |
| EXAMPLE | 2-11 | 2K | FERRITE, BAINITE | PRESENCE | 3.81 | ABSENCE |
| EXAMPLE | 2-12 | 2L | FERRITE, BAINITE | PRESENCE | 3.84 | ABSENCE |
| EXAMPLE | 2-13 | 2M | FERRITE, BAINITE | PRESENCE | 3.80 | ABSENCE |
| EXAMPLE | 2-14 | 2N | FERRITE, BAINITE | PRESENCE | 3.90 | ABSENCE |
| EXAMPLE | 2-15 | 2O | FERRITE, BAINITE | PRESENCE | 3.82 | ABSENCE |
| EXAMPLE | 2-16 | 2P | FERRITE, BAINITE | PRESENCE | 3.87 | ABSENCE |
| EXAMPLE | 2-17 | 2Q | FERRITE, BAINITE | PRESENCE | 3.84 | ABSENCE |
| EXAMPLE | 2-18 | 2R | FERRITE, BAINITE | PRESENCE | 3.84 | ABSENCE |
| EXAMPLE | 2-19 | 2S | FERRITE, BAINITE | PRESENCE | 3.84 | ABSENCE |
| COMPARATIVE EXAMPLE | 2-20 | 2T | FERRITE, BAINITE | PRESENCE | 3.84 | ABSENCE |
| COMPARATIVE EXAMPLE | 2-21 | 2U | FERRITE, BAINITE | PRESENCE | 3.78 | ABSENCE |
| COMPARATIVE EXAMPLE | 2-22 | 2U2 | FERRITE, BAINITE | PRESENCE | 3.80 | ABSENCE |
| EXAMPLE | 2-23-1 | 2W1 | FERRITE, BAINITE | ABSENCE | 3.78 | ABSENCE |
| EXAMPLE | 2-23-2 | 2W2 | FERRITE, BAINITE | ABSENCE | 3.79 | ABSENCE |
| EXAMPLE | 2-23-3 | 2W3 | FERRITE, BAINITE | ABSENCE | 3.81 | ABSENCE |
| EXAMPLE | 2-27 | 2A1 | FERRITE, BAINITE | PRESENCE | 3.88 | ABSENCE |
| COMPARATIVE EXAMPLE | 2-28-0 | 2A1 | FERRITE, BAINITE | PRESENCE | 3.84 | ABSENCE |
| EXAMPLE | 2-28-1 | 2A1 | FERRITE, BAINITE | PRESENCE | 3.84 | ABSENCE |
| COMPARATIVE EXAMPLE | 2-28-2 | 2A1 | FERRITE, BAINITE | PRESENCE | 3.48 | ABSENCE |
| EXAMPLE | 2-28-3 | 2A1 | FERRITE, BAINITE | PRESENCE | 3.84 | ABSENCE |
| EXAMPLE | 2-28-4 | 2A1 | FERRITE, BAINITE | PRESENCE | 6 | ABSENCE |
| COMPARATIVE EXAMPLE | 2-28-5 | 2A1 | FERRITE, BAINITE | PRESENCE | 6.12 | ABSENCE |
| COMPARATIVE EXAMPLE | 2-30 | 2A1 | FERRITE, BAINITE | PRESENCE | 3.2 | ABSENCE |
| COMPARATIVE EXAMPLE | 2-31 | 2A1 | FERRITE, BAINITE | PRESENCE | 3.24 | ABSENCE |
| COMPARATIVE EXAMPLE | 2-32 | 2A1 | FERRITE, BAINITE | PRESENCE | 6.12 | ABSENCE |
| COMPARATIVE EXAMPLE | 2-33 | 2A1 | FERRITE, BAINITE, PEARITE | ABSENCE | 4.44 | ABSENCE |
| COMPARATIVE EXAMPLE | 2-34 | 2A1 | FERRITE, BAINITE, PEARITE | ABSENCE | 4.68 | ABSENCE |

TABLE 10-continued

| | STEEL No. | TEXTURE RANDOM INTENSITY RATIO OF (211) PLANE | INCLUSION MAXIMUM OF MAJOR DIAMETER/ MINOR DIAMETER RATIO | SUM TOTAL M OF ROLLING DIRECTION LENGTH (mm/mm$^2$) | MAINLY OBSERBED EXTENDED INCLUSION |
|---|---|---|---|---|---|
| EXAMPLE | 2-1-1 | 2.12 | 3.0 | 0.03 | CALCIUM ALMINATE |
| EXAMPLE | 2-1-2 | 2.11 | 1.5 | 0.04 | CALCIUM ALMINATE, RESIDUE OF DESULFURIZATION MATERIAL |
| EXAMPLE | 2-1-3 | 2.06 | 1.0 | 0.00 | ABSENCE |
| EXAMPLE | 2-1-4 | 2.12 | 1.5 | 0.02 | RESIDUE OF DESULFURIZATION MATERIAL |
| EXAMPLE | 2-1-5 | 2.12 | 4.5 | 0.00 | ABSENCE |
| EXAMPLE | 2-1-6 | 2.08 | 4.5 | 0.02 | RESIDUE OF DESULFURIZATION MATERIAL |
| EXAMPLE | 2-1-7 | 1.83 | 1.0 | 0.00 | ABSENCE |
| EXAMPLE | 2-1-8 | 1.88 | 1.0 | 0.00 | ABSENCE |
| EXAMPLE | 2-2 | 2.29 | 3.0 | 0.12 | CALCIUM ALMINATE, CaS |
| EXAMPLE | 2-3 | 2.08 | 2.8 | 0.14 | CALCIUM ALMINATE, CaS |
| EXAMPLE | 2-4 | 2.13 | 2.9 | 0.18 | CALCIUM ALMINATE, CaS |
| EXAMPLE | 2-5 | 2.08 | 3.0 | 0.12 | CALCIUM ALMINATE, CaS |
| EXAMPLE | 2-6 | 2.38 | 3.0 | 0.12 | CALCIUM ALMINATE, CaS |
| EXAMPLE | 2-7 | 2.08 | 3.0 | 0.12 | CALCIUM ALMINATE, CaS |
| EXAMPLE | 2-8 | 2.08 | 1.0 | 0.00 | ABSENCE |
| EXAMPLE | 2-9 | 2.09 | 8.0 | 0.13 | CALCIUM ALMINATE, CaS |
| EXAMPLE | 2-10 | 2.09 | 8.0 | 0.19 | CALCIUM ALMINATE, CaS |
| EXAMPLE | 2-11 | 2.09 | 7.0 | 0.23 | CALCIUM ALMINATE, CaS |
| EXAMPLE | 2-12 | 2.10 | 5.8 | 0.14 | CALCIUM ALMINATE, CaS |
| EXAMPLE | 2-13 | 2.09 | 4.8 | 0.12 | CALCIUM ALMINATE, CaS |
| EXAMPLE | 2-14 | 2.07 | 4.0 | 0.11 | CALCIUM ALMINATE, CaS |
| EXAMPLE | 2-15 | 2.07 | 2.8 | 0.21 | CALCIUM ALMINATE, CaS |
| EXAMPLE | 2-16 | 2.08 | 2.0 | 0.20 | CALCIUM ALMINATE |
| EXAMPLE | 2-17 | 2.12 | 1.0 | 0.10 | CALCIUM ALMINATE |
| EXAMPLE | 2-18 | 2.11 | 1.0 | 0.00 | CALCIUM ALMINATE, CaS |
| EXAMPLE | 2-19 | 2.07 | 3.0 | 0.25 | CALCIUM ALMINATE, CaS |
| COMPARATIVE EXAMPLE | 2-20 | 2.13 | 4.0 | 0.40 | CALCIUM ALMINATE, MnS |
| COMPARATIVE EXAMPLE | 2-21 | 2.06 | 9.0 | 0.30 | MnS |
| COMPARATIVE EXAMPLE | 2-22 | 2.10 | 9.0 | 0.15 | MnS |
| EXAMPLE | 2-23-1 | 2.12 | 1.3 | 0.24 | CALCIUM ALMINATE |
| EXAMPLE | 2-23-2 | 2.12 | 1.0 | 0.23 | CALCIUM ALMINATE |
| EXAMPLE | 2-23-3 | 2.12 | 2.1 | 0.20 | CALCIUM ALMINATE, CaS |
| EXAMPLE | 2-27 | 2.11 | 3.0 | 0.06 | CALCIUM ALMINATE, CaS |
| COMPARATIVE EXAMPLE | 2-28-0 | 2.11 | 9.0 | 0.48 | CALCIUM ALMINATE, CaS |
| EXAMPLE | 2-28-1 | 2.11 | 8.0 | 0.25 | CALCIUM ALMINATE, CaS |
| COMPARATIVE EXAMPLE | 2-28-2 | 2.45 | 3.0 | 0.25 | CALCIUM ALMINATE, CaS |
| EXAMPLE | 2-28-3 | 2.20 | 2.9 | 0.24 | CALCIUM ALMINATE, CaS |
| EXAMPLE | 2-28-4 | 2.11 | 5.0 | 0.15 | CALCIUM ALMINATE, CaS |
| COMPARATIVE EXAMPLE | 2-28-5 | 2.06 | 7.0 | 0.20 | CALCIUM ALMINATE, CaS |
| COMPARATIVE EXAMPLE | 2-30 | 2.44 | 3.0 | 0.06 | CALCIUM ALMINATE, CaS |
| COMPARATIVE EXAMPLE | 2-31 | 3.17 | 3.0 | 0.06 | CALCIUM ALMINATE, CaS |
| COMPARATIVE EXAMPLE | 2-32 | 1.69 | 3.0 | 0.06 | CALCIUM ALMINATE, CaS |
| COMPARATIVE EXAMPLE | 2-33 | 2.18 | 3.0 | 0.06 | CALCIUM ALMINATE, CaS |
| COMPARATIVE EXAMPLE | 2-34 | 2.18 | 3.0 | 0.06 | CALCIUM ALMINATE, CaS |

TABLE 11

| | STEEL No. | STEEL COMPOSITION | MECHANICAL PROPERTIES: TENSILE STRENGTH (MPa) | BORE EXPANSION TEST: AVERAGE λave (%) | BORE EXPANSION TEST: STANDARD DEVIATION σ | n VALUE |
|---|---|---|---|---|---|---|
| EXAMPLE | 2-1-1 | 2A1 | 790 | 93 | 8.0 | 0.10 |
| EXAMPLE | 2-1-2 | 2A2 | 800 | 100 | 7.0 | 0.10 |
| EXAMPLE | 2-1-3 | 2A3 | 790 | 100 | 5.0 | 0.10 |
| EXAMPLE | 2-1-4 | 2A4 | 790 | 100 | 6.0 | 0.10 |
| EXAMPLE | 2-1-5 | 2A5 | 790 | 89 | 11.0 | 0.10 |
| EXAMPLE | 2-1-6 | 2A6 | 790 | 89 | 9.0 | 0.10 |
| EXAMPLE | 2-1-7 | 2A7 | 790 | 115 | 5.0 | 0.10 |
| EXAMPLE | 2-1-8 | 2A8 | 790 | 115 | 5.0 | 0.10 |
| EXAMPLE | 2-2 | 2B | 790 | 90 | 8.0 | 0.10 |
| EXAMPLE | 2-3 | 2C | 787 | 87 | 7.0 | 0.08 |
| EXAMPLE | 2-4 | 2D | 790 | 100 | 8.0 | 0.12 |
| EXAMPLE | 2-5 | 2E | 785 | 85 | 8.0 | 0.11 |
| EXAMPLE | 2-6 | 2F | 790 | 84 | 8.0 | 0.10 |
| EXAMPLE | 2-7 | 2G | 790 | 90 | 8.0 | 0.10 |
| EXAMPLE | 2-8 | 2H | 790 | 108 | 6.0 | 0.10 |
| EXAMPLE | 2-9 | 2I | 790 | 88 | 13.0 | 0.10 |
| EXAMPLE | 2-10 | 2J | 790 | 87 | 13.0 | 0.10 |
| EXAMPLE | 2-11 | 2K | 790 | 86 | 13.0 | 0.10 |
| EXAMPLE | 2-12 | 2L | 790 | 85 | 11.0 | 0.10 |
| EXAMPLE | 2-13 | 2M | 790 | 86 | 8.0 | 0.10 |
| EXAMPLE | 2-14 | 2N | 790 | 87 | 9.0 | 0.10 |
| EXAMPLE | 2-15 | 2O | 790 | 90 | 7.0 | 0.10 |
| EXAMPLE | 2-16 | 2P | 790 | 93 | 6.0 | 0.10 |
| EXAMPLE | 2-17 | 2Q | 790 | 105 | 5.0 | 0.10 |
| EXAMPLE | 2-18 | 2R | 790 | 92 | 6.0 | 0.10 |
| EXAMPLE | 2-19 | 2S | 790 | 50 | 8.0 | 0.10 |
| COMPARATIVE EXAMPLE | 2-20 | 2T | 790 | 75 | 16.0 | 0.10 |
| COMPARATIVE EXAMPLE | 2-21 | 2U | 794 | 65 | 18.0 | 0.10 |
| COMPARATIVE EXAMPLE | 2-22 | 2U2 | 790 | 78 | 17.0 | 0.10 |
| EXAMPLE | 2-23-1 | 2W1 | 790 | 95 | 6.0 | 0.10 |
| EXAMPLE | 2-23-2 | 2W2 | 790 | 98 | 6.0 | 0.10 |
| EXAMPLE | 2-23-3 | 2W3 | 790 | 105 | 6.0 | 0.10 |
| EXAMPLE | 2-27 | 2A1 | 774 | 91 | 8.0 | 0.11 |
| COMPARATIVE EXAMPLE | 2-28-0 | 2A1 | 785 | 65 | 16.0 | 0.11 |
| EXAMPLE | 2-28-1 | 2A1 | 790 | 85 | 8.0 | 0.10 |
| COMPARATIVE EXAMPLE | 2-28-2 | 2A1 | 790 | 80 | 8.0 | 0.10 |
| EXAMPLE | 2-28-3 | 2A1 | 790 | 90 | 7.0 | 0.10 |
| EXAMPLE | 2-28-4 | 2A1 | 790 | 90 | 7.0 | 0.10 |
| COMPARATIVE EXAMPLE | 2-28-5 | 2A1 | 790 | 87 | 8.0 | 0.10 |
| COMPARATIVE EXAMPLE | 2-30 | 2A1 | 802 | 81 | 8.0 | 0.10 |
| COMPARATIVE EXAMPLE | 2-31 | 2A1 | 810 | 70 | 8.0 | 0.09 |
| COMPARATIVE EXAMPLE | 2-32 | 2A1 | 785 | 85 | 8.0 | 0.10 |
| COMPARATIVE EXAMPLE | 2-33 | 2A1 | 775 | 79 | 8.0 | 0.10 |
| COMPARATIVE EXAMPLE | 2-34 | 2A1 | 790 | 75 | 7.0 | 0.10 |

| | STEEL No. | MECHANICAL PROPERTIES: THREE-POINT Jc ($MJ/m^2$) | THREE-POINT T.M. ($MJ/m^2$) | CHARPY IMPACT TEST: FRACTURE PPEARANCE TRANSITION TEMPERATURE (° C.) | CHARPY ABSORBED ENERGY (J) | PEELING |
|---|---|---|---|---|---|---|
| EXAMPLE | 2-1-1 | 0.91 | 893 | −72 | 37.7 | SLIGHT OCCURRENCE |
| EXAMPLE | 2-1-2 | 1.00 | 880 | −71 | 41.7 | SLIGHT OCCURRENCE |

TABLE 11-continued

| | | | | | | |
|---|---|---|---|---|---|---|
| EXAMPLE | 2-1-3 | 1.00 | 933 | −72 | 41.7 | SLIGHT OCCURRENCE |
| EXAMPLE | 2-1-4 | 1.00 | 906 | −74 | 41.7 | SLIGHT OCCURRENCE |
| EXAMPLE | 2-1-5 | 0.86 | 933 | −73 | 35.4 | SLIGHT OCCURRENCE |
| EXAMPLE | 2-1-6 | 0.86 | 906 | −73 | 35.4 | SLIGHT OCCURRENCE |
| EXAMPLE | 2-1-7 | 1.19 | 933 | −73 | 50.2 | SLIGHT OCCURRENCE |
| EXAMPLE | 2-1-8 | 1.19 | 933 | −27 | 50.2 | SLIGHT OCCURRENCE |
| EXAMPLE | 2-2 | 0.75 | 773 | −74 | 30.3 | SLIGHT OCCURRENCE |
| EXAMPLE | 2-3 | 0.84 | 746 | −14 | 34.3 | SLIGHT OCCURRENCE |
| EXAMPLE | 2-4 | 1.00 | 693 | −72 | 41.7 | SLIGHT OCCURRENCE |
| EXAMPLE | 2-5 | 0.81 | 773 | −16 | 33.1 | SLIGHT OCCURRENCE |
| EXAMPLE | 2-6 | 0.80 | 773 | −73 | 32.6 | NONE |
| EXAMPLE | 2-7 | 0.88 | 773 | −72 | 36.0 | NONE |
| EXAMPLE | 2-8 | 1.10 | 533 | −72 | 46.2 | SLIGHT OCCURRENCE |
| EXAMPLE | 2-9 | 0.85 | 760 | −74 | 34.8 | SLIGHT OCCURRENCE |
| EXAMPLE | 2-10 | 0.84 | 680 | −72 | 34.3 | SLIGHT OCCURRENCE |
| EXAMPLE | 2-11 | 0.83 | 626 | −73 | 33.7 | SLIGHT OCCURRENCE |
| EXAMPLE | 2-12 | 0.81 | 746 | −73 | 33.1 | SLIGHT OCCURRENCE |
| EXAMPLE | 2-13 | 0.83 | 773 | −74 | 33.7 | SLIGHT OCCURRENCE |
| EXAMPLE | 2-14 | 0.84 | 786 | −71 | 34.3 | SLIGHT OCCURRENCE |
| EXAMPLE | 2-15 | 0.88 | 653 | −73 | 36.0 | SLIGHT OCCURRENCE |
| EXAMPLE | 2-16 | 0.91 | 666 | −72 | 37.7 | SLIGHT OCCURRENCE |
| EXAMPLE | 2-17 | 1.07 | 800 | −73 | 44.5 | SLIGHT OCCURRENCE |
| EXAMPLE | 2-18 | 0.90 | 933 | −73 | 37.1 | SLIGHT OCCURRENCE |
| EXAMPLE | 2-19 | 0.88 | 602 | −73 | 36.0 | SLIGHT OCCURRENCE |
| COMPARATIVE EXAMPLE | 2-20 | 0.69 | 400 | −73 | 27.4 | SLIGHT OCCURRENCE |
| COMPARATIVE EXAMPLE | 2-21 | 0.56 | 533 | −74 | 21.7 | SLIGHT OCCURRENCE |
| COMPARATIVE EXAMPLE | 2-22 | 0.73 | 733 | −74 | 29.1 | SLIGHT OCCURRENCE |
| EXAMPLE | 2-23-1 | 0.94 | 613 | −74 | 38.8 | SLIGHT OCCURRENCE |
| EXAMPLE | 2-23-2 | 0.98 | 626 | −74 | 40.5 | SLIGHT OCCURRENCE |
| EXAMPLE | 2-23-3 | 1.07 | 666 | −73 | 44.5 | SLIGHT OCCURRENCE |
| EXAMPLE | 2-27 | 0.89 | 853 | −71 | 36.6 | SLIGHT OCCURRENCE |
| COMPARATIVE EXAMPLE | 2-28-0 | 0.56 | 293 | −73 | 21.7 | SLIGHT OCCURRENCE |
| EXAMPLE | 2-28-1 | 0.81 | 600 | −73 | 33.1 | SLIGHT OCCURRENCE |
| COMPARATIVE EXAMPLE | 2-28-2 | 0.75 | 600 | −83 | 30.3 | SLIGHT OCCURRENCE |
| EXAMPLE | 2-28-3 | 0.88 | 613 | −73 | 36.0 | SLIGHT OCCURRENCE |
| EXAMPLE | 2-28-4 | 0.88 | 733 | −14 | 36.0 | SLIGHT OCCURRENCE |
| COMPARATIVE EXAMPLE | 2-28-5 | 0.84 | 666 | −10 | 34.3 | SLIGHT OCCURRENCE |
| COMPARATIVE EXAMPLE | 2-30 | 0.76 | 853 | −89 | 30.9 | SLIGHT OCCURRENCE |
| COMPARATIVE EXAMPLE | 2-31 | 0.62 | 853 | −89 | 24.6 | SLIGHT OCCURRENCE |
| COMPARATIVE EXAMPLE | 2-32 | 0.81 | 853 | −10 | 33.1 | SLIGHT OCCURRENCE |
| COMPARATIVE EXAMPLE | 2-33 | 0.74 | 853 | −56 | 29.7 | SLIGHT OCCURRENCE |

TABLE 11-continued

| | | | | | | |
|---|---|---|---|---|---|---|
| COMPARATIVE EXAMPLE | 2-34 | 0.69 | 853 | −50 | 27.4 | OCCURRENCE |

In Steel numbers 2-1-1 to 2-1-8, 2-2 to 2-19, 2-23-1 to 2-2-3, 2-28-1, 2-28-3, and 2-28-4, the requirements of the present invention were satisfied. Therefore, the tensile strength was 780 MPa or more, the average λave of the bore expansion ratio was 80% or more, the standard deviation σ of the bore expansion ratio was 15% or less, the n value was 0.08 or more, the crack occurrence resistance value Jc was 0.75 $MJ/m^2$ or more, the crack propagation resistance value T. M. was 600 $MJ/m^3$ or more, the fracture appearance transition temperature was −13° C. or lower, and the Charpy absorbed energy was 30 J or more. That is, the desired characteristic values were able to be obtained. Even in Steel number 2-27, the requirements of the present invention were satisfied, so that the desired characteristic values were able to be obtained substantially. Further, in Steel numbers 2-1-1 to 2-1-4, 2-1-7, 2-1-8, 2-2 to 2-8, 2-15 to 2-19, 2-23-1 to 2-23-3, 2-27, and 2-28-3, the requirements of the present invention were satisfied and the maximum of the major diameter/minor diameter ratio of the inclusion was 3.0 or less. Therefore, it was possible to obtain the preferable characteristic values of the average λave of the bore expansion ratio being 84% or more and the standard deviation σ being 8% or less. Further, in Steel numbers 2-1-3, 2-1-5, 2-1-7, 2-1-8, and 2-8, the requirements of the present invention were satisfied, Ca was not added or Ca was added in minute amounts, and the desulfurization with the desulfurization material was not performed. Therefore, it was possible to obtain the preferable characteristic values of the sum total M of the rolling direction length of the inclusion being 0.01 $mm/mm^2$ or less and the crack propagation resistance value T. M. being 900 $MJ/m^3$ or more. Further, the average λave of the bore expansion ratio, the crack occurrence resistance value Jc, and the Charpy absorbed energy were also made better.

Particularly, Steel numbers 2-1-3 to 2-1-6 each are an example where Ca and REM were hardly added and the control of the form of sulfide was performed only with Ti practically. Among Steel numbers 2-1-3 to 2-1-6, Steel numbers 2-1-3 and 2-1-5 each are an example where the desulfurization material was not used, and were able to obtain the good characteristic values respectively.

In Steel numbers 2-1-7 and 2-1-8, the Si content was small in particular, so that island-shaped martensite was also not observed. Further, Ca was hardly added and the form of sulfide was controlled, and further the desulfurization material was not used, so that no extended-shaped inclusions were formed, and particularly the good characteristic values were able to be obtained.

In Steel number 2-2, the Nb content was relatively high, so that the {211} plane intensity was relatively high. In Steel number 2-5, the C content was relatively low, so that the average λave of the bore expansion ratio and the crack occurrence resistance value Jc were relatively low, and the fracture appearance transition temperature was relatively high. In Steel number 2-6, the B content was relatively high, so that the {211} plane intensity was relatively high. Further, the peeling did not occur at all.

Steel number 2-7 was an example of the present invention, and a preferable amount of B was contained, so that the peeling did not occur at all.

Steel number 2-8 was an example of the present invention, without adding Ca, the form of sulfide was controlled, and further the desulfurization material was not used, so that the number of the extended-shaped inclusions was extremely small and particularly the good characteristic values were able to be obtained.

Each of Steel numbers 2-9 to 2-14 was an example of the present invention, but REM was not added or REM was added in minute amounts, so that the value of ([REM]/140)/([Ca]/40) was less than 0.3, the maximum of the major diameter/minor diameter ratio of the inclusion was slightly high, and the standard deviation σ of the bore expansion ratio was slightly large.

In Steel numbers 2-23-1 to 2-23-3, the Si content was small in particular, so that island-shaped martensite was not observed, and the average λave of the bore expansion ratio, the crack occurrence resistance value Jc, and the Charpy absorbed energy were better in particular.

Steel number 2-27 was an example of the present invention, but the heating temperature was lower than 1200° C., so that the tensile strength was slightly low.

In Steel numbers 2-20 and 2-21, the parameter Q was less than 30.0, and Mathematical expression 2 was not satisfied, so that it was not possible to obtain the sum total M of the rolling direction length of the inclusion and the maximum of the major diameter/minor diameter ratio that are required in the present invention. Therefore, it was not possible to obtain the desired average λave and standard deviation σ of the bore expansion ratio, crack occurrence resistance value Jc, crack propagation resistance value T. M., and Charpy absorbed energy.

In Steel number 2-22, the accumulated reduction ratio of the rough-rolling in the temperature zone exceeding 1150° C. was larger than the present invention range, so that the maximum of the major diameter/minor diameter ratio of the inclusion was larger than the value required in the present invention and the average λave of the bore expansion ratio, the standard deviation σ of the bore expansion ratio, the crack occurrence resistance value Jc, and the Charpy absorbed energy were deteriorated.

In Steel number 2-28-0, the accumulated reduction ratio of the rough-rolling in the temperature zone exceeding 1150° C. was larger than the present invention range, so that the sum total M of the rolling direction length of the inclusion and the maximum of the major diameter/minor diameter ratio of the inclusion were larger than the values required in the present invention and the average λave of the bore expansion ratio, the standard deviation σ of the bore expansion ratio, the crack occurrence resistance value Jc, the crack propagation resistance value T. M., and the Charpy absorbed energy were deteriorated.

In Steel number 2-28-2, the accumulated reduction ratio of the rough-rolling in the temperature zone of 1150° C. or lower was larger than the present invention range, so that it was not possible to obtain the {211} plane intensity required in the present invention. Therefore, it was not possible to obtain the desired average λave of the bore expansion ratio, crack occurrence resistance value Jc, and Charpy absorbed energy.

In Steel number 2-28-5, the accumulated reduction ratio of the rough-rolling in the temperature zone of 1150° C. or lower was smaller than the present invention range, so that the average grain size of the microstructure was larger than the value required in the present invention. Therefore, the fracture appearance transition temperature was higher than the desired value.

In Steel number 2-30, the beginning temperature of the finish-rolling was lower than the present invention range, so that the {211} plane intensity was higher than the value required in the present invention. Further, since the {211} plane intensity was higher than the value required in the present invention, it was not possible to obtain the desired average λave of the bore expansion ratio, crack occurrence resistance value Jc, and Charpy absorbed energy.

In Steel number 2-31, the finishing temperature of the finish-rolling was lower than the present invention range, so that the {211} plane intensity was higher than the value required in the present invention. Further, since the {211} plane intensity was higher than the value required in the present invention, it was not possible to obtain the desired average λave of the bore expansion ratio, crack occurrence resistance value Jc, and Charpy absorbed energy.

In Steel number 2-32, the finishing temperature of the finish-rolling was higher than the present invention range, and the average grain size of the microstructure was larger than the present invention range, so that the fracture appearance transition temperature was higher than the desired value.

In Steel number 2-33, the cooling rate was smaller than the present invention range, so that pearlite was formed and it was not possible to obtain the desired average λave of the bore expansion ratio, crack occurrence resistance value Jc, and Charpy absorbed energy.

In Steel number 2-34, the coiling temperature was higher than the present invention range, so that pearlite was formed and it was not possible to obtain the desired average λave of the bore expansion ratio, crack occurrence resistance value Jc, and Charpy absorbed energy.

(Third Experiment)

First, molten steels containing steel compositions Z1 to Z4 listed in Table 12 were obtained. Each of the molten steels was manufactured through performing melting and secondary refining in a steel converter. The secondary refining was performed in an RH. Incidentally, in order to prevent a desulfurization material to be the extended inclusion from remaining, desulfurization was not performed and the process was advanced in a manner to keep the S content obtained after primary refining in a steel converter unchanged. From each of the molten steels, a steel slab was obtained through continuous casting, and thereafter, hot rolling was performed under the manufacturing conditions listed in Table 13, and thereby hot-rolled steel sheets each having a thickness of 2.9 mm were obtained. Characteristic values of the microstructure, the texture, and the inclusions of the obtained hot-rolled steel sheets are listed in Table 14, and mechanical properties of the obtained hot-rolled steel sheets are listed in Table 15. The methods of measuring the microstructure, the texture, and the inclusions, and the methods of measuring the mechanical property are as described above. Incidentally, in the evaluation of the bore expandability, 20 test pieces were made from a single sample steel. Each underline in Table 12 to Table 15 indicates that the value is outside the range of the present invention, or no desired characteristic value is obtained.

TABLE 12

| | STEEL | CHEMICAL COMPONENT (MASS %) | | | | | | | | | | | | | |
|---|---|---|---|---|---|---|---|---|---|---|---|---|---|---|---|
| | COMPO-SITION | C | Si | Mn | P | S | Al | N | Ti | REM | Ca | Nb | *1 | *2 | OTHER ELEMENT |
| EXAMPLE | Z1 | 0.040 | 1.10 | 1.25 | 0.007 | 0.0030 | 0.023 | 0.0021 | 0.13 | 0.0040 | 0.0038 | 0.0400 | 48.66 | 0.30 | — |
| EXAMPLE | Z2 | 0.040 | 1.10 | 1.21 | 0.007 | 0.0030 | 0.023 | 0.0021 | 0.13 | 0.0040 | 0.0038 | 0.0400 | 48.66 | 0.30 | B: 0.0010 |
| EXAMPLE | 23 | 0.040 | 1.10 | 0.69 | 0.007 | 0.0030 | 0.023 | 0.0021 | 0.13 | 0.0040 | 0.0038 | 0.0400 | 48.66 | 0.30 | — |
| EXAMPLE | 24 | 0.040 | 1.10 | 0.65 | 0.007 | 0.0030 | 0.023 | 0.0021 | 0.13 | 0.0040 | 0.0038 | 0.0400 | 48.66 | 0.30 | B: 0.0010 |

*1: ([Ti]/48/([S]/32)) + ([Ca]/40 + [REM]/140)/[S]/32*15) (PARMETER Q)

*2: ([REM]/140)/([Ca]/40)

TABLE 13

| | | | | MANUFACTURING CONDITION | | | |
|---|---|---|---|---|---|---|---|
| | | | | | | ACCUMULATED REDUCTION RATIO (%) | |
| | STEEL No. | STEEL COMPO-SITION | Ar3 TRANS-FORMATION TEMPERATURE | DESULFURIZA-TION MATERIAL IN SECONDARY REFINING | HEATING HEATING TEMPERATURE (° C.) | TEMPERATURE ZONE EXCEEDING 1150° C. | TEMPERATURE ZONE OF 1150° C. OR LOWER |
| EXAMPLE | 35 | Z1 | 795 | WITHOUT | 1250 | 65 | 21 |
| EXAMPLE | 36 | Z2 | 797 | WITHOUT | 1250 | 65 | 21 |
| EXAMPLE | 37 | Z3 | 833 | WITHOUT | 1250 | 65 | 21 |
| EXAMPLE | 38 | Z4 | 835 | WITHOUT | 1250 | 65 | 21 |

| | | MANUFACTURING CONDITION | | | | | |
|---|---|---|---|---|---|---|---|
| | | FINISH-ROLLING | | COOLING | | | COILING |
| | STEEL No. | BEGINNING TEMPERATURE (° C.) | FINISHING TEMPERATURE (° C.) | COOLING RATE (° C./SEC) | THREE-STAGE COOLING | CONDITION FOR SECOND COOLING | COILING TEMPERATURE (° C.) |
| EXAMPLE | 35 | 1072 | 947 | 29 | WITHOUT | WITHOUT | 490 |
| EXAMPLE | 36 | 1072 | 947 | 29 | WITHOUT | WITHOUT | 500 |
| EXAMPLE | 37 | 1072 | 947 | 29 | WITHOUT | WITHOUT | 610 |
| EXAMPLE | 38 | 1072 | 947 | 29 | WITHOUT | WITHOUT | 600 |

TABLE 14

| | STEEL No. | STEEL COMPOSITION | MICROSTRUCTURE: MAINLY OBSERBED PHASE | MICROSTRUCTURE: ISLAND-SHAPED MARTENSITE | MICROSTRUCTURE: AVERAGE GRAIN SIZE (μm) | TEXTURE RANDOM INTENSITY: RATIO OF (211) PLANE |
|---|---|---|---|---|---|---|
| EXAMPLE | 35 | Z1 | FERRITE, BAINITE | PRESENCE | 3.22 | 2.31 |
| EXAMPLE | 36 | Z2 | FERRITE, BAINITE | PRESENCE | 3.10 | 2.35 |
| EXAMPLE | 37 | Z3 | FERRITE, BAINITE | ABSENCE | 3.22 | 2.31 |
| EXAMPLE | 38 | Z4 | FERRITE, BAINITE | ABSENCE | 3.15 | 2.37 |

| | STEEL No. | INCLUSION: MAXIMUM OF MAJOR DIAMETER/ MINOR DIAMETER RATIO | INCLUSION: SUM TOTAL M OF ROLLING DIRECTION LENGTH (mm/mm$^2$) | INCLUSION: MAINLY OBSERBED EXTENDED INCLUSION | GRAIN BOUNDARY: DENSITY OF SOLID SOLUTION C AND SOLID SOLUTION B (/nm$^2$) | GRAIN BOUNDARY: SIZE OF CEMENTITE (μm) |
|---|---|---|---|---|---|---|
| EXAMPLE | 35 | 3.0 | 0.03 | CALCIUM ALMINATE | 2 | 2 |
| EXAMPLE | 36 | 3.0 | 0.03 | CALCIUM ALMINATE | 5 | 2 |
| EXAMPLE | 37 | 3.0 | 0.03 | CALCIUM ALMINATE | 1 | 0.4 |
| EXAMPLE | 38 | 3.0 | 0.03 | CALCIUM ALMINATE | 4 | 0.4 |

TABLE 15

| | STEEL No. | STEEL COMPOSITION | MECHANICAL PROPERTIES: TENSILE STRENGTH (MPa) | MECHANICAL PROPERTIES: BORE EXPANSION TEST: AVERAGE λave (%) | MECHANICAL PROPERTIES: BORE EXPANSION TEST: STANDARD DEVIATION σ | MECHANICAL PROPERTIES: BORE EXPANSION TEST: n VALUE |
|---|---|---|---|---|---|---|
| EXAMPLE | 35 | Z1 | 790 | 89 | 10 | 0.08 |
| EXAMPLE | 36 | Z2 | 800 | 86 | 10 | 0.08 |
| EXAMPLE | 37 | Z3 | 810 | 93 | 10 | 0.08 |
| EXAMPLE | 38 | Z4 | 815 | 95 | 10 | 0.08 |

| | STEEL No. | MECHANICAL PROPERTIES: THREE-POINT: Jc (MJ/m$^2$) | MECHANICAL PROPERTIES: THREE-POINT: T.M. (MJ/m$^2$) | MECHANICAL PROPERTIES: CHARPY IMPACT TEST: FRACTURE PPEARANCE TRANSITION TEMPERATURE (° C.) | MECHANICAL PROPERTIES: CHARPY IMPACT TEST: CHARPY ABSORBED ENERGY (J) | PEELING |
|---|---|---|---|---|---|---|
| EXAMPLE | 35 | 0.86 | 893 | −90 | 35.4 | SLIGHT OCCURRENCE |
| EXAMPLE | 36 | 0.83 | 893 | −93 | 33.7 | NONE |
| EXAMPLE | 37 | 0.91 | 893 | −90 | 37.7 | SLIGHT OCCURRENCE |
| EXAMPLE | 38 | 0.94 | 893 | −92 | 38.8 | NONE |

In Steel numbers 35 to 38, the requirements of the present invention were satisfied. Therefore, the tensile strength was 780 MPa or more, the average λave of the bore expansion ratio was 80% or more, the standard deviation σ of the bore expansion ratio was 15% or less, the n value was 0.08 or more, the crack occurrence resistance value Jc was 0.75 MJ/m$^2$ or more, the crack propagation resistance value T. M. was 600 MJ/m$^3$ or more, the fracture appearance transition temperature was −40° C. or lower, and the Charpy absorbed energy was 30 J or more. That is, the desired characteristic values were able to be obtained. Further, in Steel number 36 in which the grain boundary number density of solid solution C and solid solution B was 4.5/nm$^2$ or more and the size of cementite in the grain boundaries was 2 μm or less, the peeling did not occur.

Industrial Applicability

The present invention can be utilized in industries related to a steel sheet that requires high strength, high formability, and a high fracture property, for example.

The invention claimed is:

1. A high-strength hot-rolled steel sheet containing:

in mass %,

C: 0.02% to 0.1%;

Si: 0.001% to 3.0%;

Mn: 0.5% to 3.0%;

P: 0.1% or less;

S: 0.01% or less;

Al: 0.001% to 2.0%;

N: 0.02% or less;

Ti: 0.03% to 0.3%; and

Nb: 0.001% to 0.06%, the steel sheet further containing at least one element selected from the group consisting of:

Cu: 0.001 to 1.0%;

Cr: 0.001 to 1.0%;

Mo: 0.001 to 1.0%;

Ni: 0.001 to 1.0%; and

V: 0.01 to 0.2%, the balance being composed of Fe and inevitable impurities, a parameter Q expressed by Mathematical expression 1 below being 30.0 or more, a microstructure being made of a ferrite structure, a bainite structure, or a structure mixed with the ferrite structure and the bainite structure, an average grain size of grains included in the microstructure being 6 μm or less, an X-ray random intensity ratio of {211} plane on a rolled surface being 2.4 or less, and on a cross section with a sheet width direction set as a normal line, with regard to inclusions having a major diameter of 3.0 μm or more, a maximum of a major diameter/minor diameter ratio expressed by (a major diameter of the inclusion)/(a minor diameter of the inclusion) being 8.0 or less, a sum total of a rolling direction length per 1 $mm^2$ cross section of an inclusion group composed of plural inclusions each having a major diameter of 3. 0 μm or more and an extended inclusion having a length in a rolling direction of 30 μm or more being 0.25 mm or less, the plural inclusions composing the inclusion group congregating in both the rolling direction and a direction perpendicular to the rolling direction 50 μm or less apart from each other, and the extended inclusion being spaced over 50 μm apart from all the inclusions each having a major diameter of 3.0 μm or more in at least either the rolling direction or the direction perpendicular to the rolling direction, $$Q = \frac{[Ti]}{48} \Big/ \frac{[S]}{32} \qquad \text{(Mathematical expression 1)}$$

wherein [Ti] indicates the Ti content (mass %) and [S] indicates the S content (mass %).

2. A high-strength hot-rolled steel sheet containing:

in mass %,

C: 0.02% to 0.1%;

Si: 0.001% to 3.0%;

Mn: 0.5% to 3.0%;

P: 0.1% or less;

S: 0.01% or less;

Al: 0.001% to 2.0%;

N: 0.02% or less;

Ti: 0.03% to 0.3%;

Nb: 0.001% to 0.06%;

REM: 0.0001% to 0.02%; and

Ca: 0.0001% to 0.02%, the steel sheet further containing at least one element selected from the group consisting of:

Cu: 0.001 to 1.0%;

Cr: 0.001 to 1.0%;

Mo: 0.001 to 1.0%;

Ni: 0.001 to 1.0%; and

V: 0.01 to 0.2%, and the balance being composed of Fe and inevitable impurities, a parameter Q' expressed by Mathematical expression 1' below being 30.0 or more, a microstructure being made of a ferrite structure, a bainite structure, or a structure mixed with the ferrite structure and the bainite structure, an average grain size of grains included in the microstructure being 6 μm or less, an X-ray random intensity ratio of {211} plane on a rolled surface being 2.4 or less, and on a cross section with a sheet width direction set as a normal line, with regard to an inclusion having a major diameter of 3.0 μm or more, a maximum of a major diameter/minor diameter ratio expressed by (a major diameter of the inclusion)/(a minor diameter of the inclusion) being 8.0 or less, a sum total of a rolling direction length per 1 $mm^2$ cross section of an inclusion group composed of plural inclusions each having a major diameter of 3.0 μm or more and an extended inclusion having a length in a rolling direction of 30 μm or more being 0.25 mm or less, the plural inclusions composing the inclusion group congregating in both the rolling direction and a direction perpendicular to the rolling direction 50 μm or less apart from each other, and the extended inclusion being spaced over 50 μm apart from all the inclusions each having a major diameter of 3.0 μm or more in at least either the rolling direction or the direction perpendicular to the rolling direction, $$Q' = \frac{[Ti]}{48} \Big/ \frac{[S]}{32} + \left\{ \frac{[Ca]}{40} \Big/ \frac{[S]}{32} + \frac{[REM]}{140} \Big/ \frac{[S]}{32} \right\} \times 15.0 \qquad \text{(Mathematical expression 1')}$$

wherein [Ti] indicates the Ti content (mass %), [S] indicates the S content (mass %), [Ca] indicates the Ca content (mass %), and [REM] indicates the REM content (mass %).

3. The high-strength hot-rolled steel sheet according to claim 2, wherein Mathematical expression 2 below is satisfied, and the maximum of the major diameter/minor diameter ratio is 3.0 or less, $$0.3 \leq ([REM]/140)/([Ca]/40) \qquad \text{(Mathematical expression 2).}$$

4. The high-strength hot-rolled steel sheet according to claim 1, further containing, in mass %, B: 0.0001% to 0.005%.

5. The high-strength hot-rolled steel sheet according to claim 2, further containing, in mass %, B: 0.0001% to 0.005%.

6. The high-strength hot-rolled steel sheet according to claim 3, further containing, in mass %, B: 0.0001% to 0.005%.

7. The high-strength hot-rolled steel sheet according to claim 4, wherein a total grain boundary number density of solid solution C and solid solution B exceeds 4.5/$nm^2$ and is 12/$nm^2$ or less, and a size of cementite precipitated in grain boundaries is 2 μm or less.

8. The high-strength hot-rolled steel sheet according to claim 5, wherein a total grain boundary number density of solid solution C and solid solution B exceeds 4.5/nm$^2$ and is 12/nm$^2$ or less, and a size of cementite precipitated in grain boundaries is 2 μm or less.

9. The high-strength hot-rolled steel sheet according to claim 6, wherein a total grain boundary number density of solid solution C and solid solution B exceeds 4.5/nm$^2$ and is 12/nm$^2$ or less, and a size of cementite precipitated in grain boundaries is 2 μm or less.

10. A method of manufacturing a high-strength hot-rolled steel sheet comprising:

rough-rolling a steel slab after heating the steel slab, the steel slab containing:

in mass %,

C: 0.02% to 0.1%;

Si: 0.001% to 3.0%;

Mn: 0.5% to 3.0%;

P: 0.1% or less;

S: 0.01% or less;

Al: 0.001% to 2.0%;

N: 0.02% or less;

Ti: 0.03% to 0.3%; and

Nb: 0.001% to 0.06%, the steel slab further containing at least one element selected from the group consisting of:

Cu: 0.001 to 1.0%;

Cr: 0.001 to 1.0%;

Mo: 0.001 to 1.0%;

Ni: 0.001 to 1.0%; and

V: 0.01 to 0.2%, the balance being composed of Fe and inevitable impurities, a parameter Q expressed by Mathematical expression 1 being 30.0 or more, and the rough-rolling being performed under a condition in which an accumulated reduction ratio in a temperature zone exceeding 1150° C. becomes 70% or less and an accumulated reduction ratio in a temperature zone of 1150° C. or lower becomes not less than 10% nor more than 25%;

subsequently, finish-rolling the steel slab under a condition in which a beginning temperature is 1050° C. or higher and a finishing temperature is not lower than Ar3+130° C. nor higher than Ar3+230° C.;

subsequently, cooling the steel slab at a cooling rate of 15° C./sec or more; and subsequently, coiling the steel slab at 640° C. or lower, $$Q = \frac{[\mathrm{Ti}]}{48} \Big/ \frac{[\mathrm{S}]}{32} \qquad \text{(Mathematical expression 1)}$$

wherein [Ti] indicates the Ti content (mass %) and [S] indicates the S content (mass %).

11. A method of manufacturing a high-strength hot-rolled steel sheet comprising:

rough-rolling a steel slab after heating the steel slab, the steel slab containing:

in mass %,

C: 0.02% to 0.1%;

Si: 0.001% to 3.0%;

Mn: 0.5% to 3.0%;

P: 0.1% or less;

S: 0.01% or less;

Al: 0.001% to 2.0%;

N: 0.02% or less;

Ti: 0.03% to 0.3%;

Nb: 0.001% to 0.06%;

REM: 0.0001% to 0.02%; and

Ca: 0.0001% to 0.02%, and further the steel slab further containing at least one element selected from the group consisting of:

Cu: 0.001 to 1.0%;

Cr: 0.001 to 1.0%;

Mo: 0.001 to 1.0%;

Ni: 0.001 to 1.0%, and

V: 0.01 to 0.2%; and the balance being composed of Fe and inevitable impurities, a parameter Q' expressed by Mathematical expression 1' being 30.0 or more, and the rough-rolling being performed under a condition in which an accumulated reduction ratio in a temperature zone exceeding 1150° C. becomes 70% or less and an accumulated reduction ratio in a temperature zone of 1150° C. or lower becomes not less than 10% nor more than 25%;

subsequently, finish-rolling the steel slab under a condition in which a beginning temperature is 1050° C. or higher and a finishing temperature is not lower than Ar3+130° C. nor higher than Ar3+230° C.;

subsequently, cooling the steel slab at a cooling rate of 15° C./sec or more; and subsequently, coiling the steel slab at 640° C. or lower, $$Q' = \frac{[\mathrm{Ti}]}{48} \Big/ \frac{[\mathrm{S}]}{32} + \left\{ \frac{[\mathrm{Ca}]}{40} \Big/ \frac{[\mathrm{S}]}{32} + \frac{[REM]}{140} \Big/ \frac{[\mathrm{S}]}{32} \right\} \times 15.0 \qquad \text{(Mathematical expression 1')}$$

wherein [Ti] indicates the Ti content (mass %), [S] indicates the S content (mass %), [Ca] indicates the Ca content (mass %), and [REM] indicates the REM content (mass %).

12. The method of manufacturing a high-strength hot-rolled steel sheet according to claim 11, wherein the steel slab satisfies Mathematical expression 2 below, $$0.3 \leq ([\mathrm{REM}]/140)/([\mathrm{Ca}]/40) \qquad \text{(Mathematical expression 2).}$$

13. The method of manufacturing a high-strength hot-rolled steel sheet according to claim 10, wherein the steel slab further contains, in mass %, B: 0.0001% to 0.005%.

14. The method of manufacturing a high-strength hot-rolled steel sheet according to claim 11, wherein the steel slab further contains, in mass %, B: 0.0001% to 0.005%.

15. The method of manufacturing a high-strength hot-rolled steel sheet according to claim 12, wherein the steel slab further contains, in mass %, B: 0.0001% to 0.005%.

* * * * *

UNITED STATES PATENT AND TRADEMARK OFFICE

CERTIFICATE OF CORRECTION

PATENT NO. : 9,121,079 B2
APPLICATION NO. : 13/583537
DATED : September 1, 2015
INVENTOR(S) : Yuzo Takahashi et al.

It is certified that error appears in the above-identified patent and that said Letters Patent is hereby corrected as shown below:

IN THE SPECIFICATION:

Columns 37-38, in Table 4-continued, in the column entitled "*1", for Steel Composition 1N, change "39.25" to --38.25--.

Columns 37-38, in Table 4-continued, in the column entitled "*1", for Steel Composition 1T, change "20.49" to --20.49--.

Columns 37-38, in Table 4-continued, in the column entitled "*1", for Steel Composition 1U, change "11.94" to --11.94--.

Columns 37-38, in Table 4-continued, in the column entitled "S", for Steel Composition 1U2, change "0.0021" to --0.0021--.

Columns 37-38, in Table 4-continued, in the column entitled "C", for Steel Composition 3C2, change "0.120" to --0.120--; and in the column entitled "S", change "0.0023" to --0.0029--.

Columns 37-38, in Table 4-continued, in the column entitled "Nb", for Steel Composition 3C11, change "0.070" to --0.070--.

Columns 37-38, in Table 5, in the column entitled "Ar3 TRANSFORMATION TEMPERATURE", in the Example for Steel No. 1-1-2, change "805" to --803--.

Columns 37-38, in Table 5, in the column entitled "Ar3 TRANSFORMATION TEMPERATURE", in the Example for Steel No. 1-1-8, change "726" to --728--.

Columns 37-38, in Table 5, in the column entitled "Ar3 TRANSFORMATION TEMPERATURE", in the Example for Steel No. 1-2, change "753" to --793--.

Columns 37-38, in Table 5, in the column entitled "Ar3 TRANSFORMATION TEMPERATURE", in the Example for Steel No. 1-5, change "753" to --793--.

Columns 39-40, in Table 5-continued, in the column entitled "COILING TEMPERATURE (° C.)", in the Example for Steel No. 1-1-1, change "463" to --483--.

Signed and Sealed this
Twenty-third Day of February, 2016

Michelle K. Lee

Michelle K. Lee
*Director of the United States Patent and Trademark Office*

IN THE SPECIFICATION (cont.):

Columns 39-40, in Table 5-continued, in the column entitled "COILING TEMPERATURE (° C.)", in the Example for Steel No. 1-1-5, change "461" to --481--.

Columns 39-40, in Table 5-continued, in the column entitled "COILING TEMPERATURE (° C.)", in the Example for Steel No. 1-1-6, change "463" to --483--.

Columns 39-40, in Table 5-continued, in the column entitled "COILING TEMPERATURE (° C.)", in the Example for Steel No. 1-1-7, change "460" to --480--.

Columns 39-40, in Table 5-continued, in the column entitled "COILING TEMPERATURE (° C.)", in the Example for Steel No. 1-1-8, change "463" to --483--.

Columns 39-40, in Table 5-continued, in the column entitled "COILING TEMPERATURE (° C.)", in the Example for Steel No. 1-2, change "461" to --481--.

Columns 39-40, in Table 5-continued, in the column entitled "COILING TEMPERATURE (° C.)", in the Example for Steel No. 1-6, change "464" to --484--.

Columns 39-40, in Table 5-continued, in the column entitled "COILING TEMPERATURE (° C.)", in the Example for Steel No. 1-7, change "463" to --483--.

Columns 39-40, in Table 5-continued, in the column entitled "COILING TEMPERATURE (° C.)", in the Example for Steel No. 1-8, change "461" to --481--.

Columns 39-40, in Table 5-continued, in the column entitled "COILING TEMPERATURE (° C.)", in the Example for Steel No. 1-9, change "460" to --480--.

Columns 39-40, in Table 5-continued, in the column entitled "COILING TEMPERATURE (° C.)", in the Example for Steel No. 1-12, change "465" to --485--.

Columns 41-42, in Table 5-continued, in the 5$^{th}$ column from the left, in the Example for Steel No. 1-18, change "35" to --28--.

Columns 41-42, in Table 5-continued, in the 5$^{th}$ column from the left, in the Example for Steel No. 1-19, change "35" to --33--.

Columns 41-42, in Table 5-continued, in the last column (8$^{th}$ column from the left), in the Comparative Example for Steel No. 1-30, change "463" to --483--.

Columns 41-42, in Table 5-continued, in the 3$^{rd}$ column from the left, in the Comparative Example for Steel No. 3-7, change "1065" to --1085--.

Columns 41-42, in Table 6, change the column heading for the 4$^{th}$ column from the left from "MAINLY OBSERBED PHASE" to --MAINLY OBSERVED PHASE--.

Columns 43-44, in Table 6-continued, in the 6$^{th}$ column from the left, in the Example for Steel No. 1-6, change "3.19" to --3.18--.

Columns 43-44, in Table 6-continued, in the 6$^{th}$ column from the left, in the Comparative Example for Steel No. 3-6, change "3.30" to --3.20--.

IN THE SPECIFICATION (cont.):

Columns 45-46, in Table 6-continued, change the column heading for the last column (6th column from the left) from "MAINLY OBSERBED EXTENDED INCLUSION" to --MAINLY OBSERVED EXTENDED INCLUSION--.

Columns 45-46, in Table 6-continued, in the column entitled "RANDOM INTENSITY RATIO OF (211) PLANE", in the Example for Steel No. 1-1-7, change "2.08" to --2.00--.

Columns 45-46, in Table 6-continued, in the column entitled "SUM TOTAL M OF ROLLING DIRECTION LENGTH ($mm/mm^2$)", in the Example for Steel No. 1-4, change "0.15" to --0.18--.

Columns 45-46, in Table 6-continued, in the column entitled "RANDOM INTENSITY RATIO OF (211) PLANE", in the Comparative Example for Steel No. 1-22, change "2.29" to --2.20--.

Columns 45-46, in Table 6-continued, in the column entitled "RANDOM INTENSITY RATIO OF (211) PLANE", in the Comparative Example for Steel No. 1-28-0, change "2.39" to --2.30--.

Columns 45-46, in Table 6-continued, in the column entitled "RANDOM INTENSITY RATIO OF (211) PLANE", in the Example for Steel No. 1-28-1, change "2.39" to --2.30--.

Columns 45-46, in Table 6-continued, in the column entitled "RANDOM INTENSITY RATIO OF (211) PLANE", in the Example for Steel No. 1-28-3, change "2.49" to --2.40--.

Columns 45-46, in Table 6-continued, in the column entitled "RANDOM INTENSITY RATIO OF (211) PLANE", in the Comparative Example for Steel No. 1-33, change "2.33" to --2.38--.

Columns 45-46, in Table 6-continued, in the column entitled "RANDOM INTENSITY RATIO OF (211) PLANE", in the Comparative Example for Steel No. 1-34, change "2.35" to --2.38--.

Columns 47-48, in Table 6-continued, in the 3rd column from the left, in the Comparative Example for Steel No. 3-10, change "2.09" to --2.00--.

Columns 47-48, in Table 7, in the column entitled "TENSILE STRENGTH (MPa)", in the Example for Steel No. 1-1-7, change "750" to --790--.

Columns 47-48, in Table 7, in the column entitled "TENSILE STRENGTH (MPa)", in the Example for Steel No. 1-4, change "765" to --785--.

Columns 47-48, in Table 7, in the column entitled "TENSILE STRENGTH (MPa)", in the Example for Steel No. 1-9, change "750" to --790--.

Columns 47-48, in Table 7, in the column entitled "TENSILE STRENGTH (MPa)", in the Example for Steel No. 1-11, change "750" to --790--.

IN THE SPECIFICATION (cont.):

Columns 47-48, in Table 7, in the column entitled "AVERAGE λave (%)", in the Comparative Example for Steel No. 1-22, change "73" to --78--.

Columns 47-48, in Table 7, in the column entitled "TENSILE STRENGTH (MPa)", in the Comparative Example for Steel No. 1-28-0, change "765" to --785--.

Columns 49-50, in Table 7-continued, in the 4th column from the left, in the Comparative Example for Steel No. 3-11, change "305" to --805--; and in the 5th column from the left, in the Comparative Example for Steel No. 3-11, change "63" to --68--.

Columns 49-50, in Table 7-continued, under the heading "CHARPY IMPACT TEST", change the column heading for the 5th column from the left from "FRACTURE PPEARANCE TRANSITION TEMPERATURE (° C.)" to --FRACTURE APPEARANCE TRANSITION TEMPERATURE (° C.)--.

Columns 49-50, in Table 7-continued, under the heading "THREE-POINT BENDING TEST", change the column heading for the 4th column from the left from "T.M. ($MJ/m^2$)" to --T.M. ($MJ/m^3$)--.

Columns 49-50, in Table 7-continued, in the column entitled "CHARPY ABSORBED ENERGY (J)", in the Example for Steel No. 1-1-2, change "36.8" to --38.8--.

Columns 49-50, in Table 7-continued, in the column entitled "CHARPY ABSORBED ENERGY (J)", in the Example for Steel No. 1-1-3, change "38.6" to --38.8--.

Columns 49-50, in Table 7-continued, in the column entitled "Jc ($MJ/m^2$)", in the Example for Steel No. 1-1-8, change "1.19" to --1.13--.

Columns 49-50, in Table 7-continued, in the column entitled "CHARPY ABSORBED ENERGY (J)", in the Example for Steel No. 1-5, change "32.9" to --32.0--.

Columns 49-50, in Table 7-continued, in the column entitled "CHARPY ABSORBED ENERGY (J)", in the Example for Steel No. 1-12, change "30.9" to --30.3--.

Columns 51-52, in Table 7-continued, in the 4th column from the left, in the Example for Steel No. 1-23-2, change "526" to --626--.

Columns 51-52, in Table 7-continued, in the 3rd column from the left, in the Comparative Example for Steel No. 3-1, change "0.86" to --0.88--.

Columns 51-52, in Table 7-continued, in the 5th column from the left, in the Comparative Example for Steel No. 3-3, change "-68" to -- -87--.

Columns 51-52, in Table 7-continued, in the 6th column from the left, in the Comparative Example for Steel No. 3-10, change "35" to --35--.

IN THE SPECIFICATION (cont.):

Columns 51-52, in Table 7-continued, in the 4th column from the left, in the Comparative Example for Steel No. 3-11, change "833" to --893--; and in the 5th column from the left, in the Comparative Example for Steel No. 3-11, change "-116" to -- -118--.

Columns 55-56, in Table 8, change the heading from "CHEMICAL COMONENT (UNIT: MASS %)" to --CHEMICAL COMPONENT (UNIT: MASS %)--.

Columns 57-58, in Table 8-continued, change the heading from "CHEMICAL COMONENT (UNIT: MASS %)" to --CHEMICAL COMPONENT (UNIT: MASS %)--.

Columns 57-58, in Table 8-continued, in the column entitled "*1", for Steel Composition 2T, change "20.45" to --20.49--.

Columns 57-58, in Table 8-continued, in the column entitled "*1", for Steel Composition 2U, change "11.94" to --11.94--.

Columns 57-58, in Table 9, in the column entitled "Ar3 TRANSFORMATION TEMPERATURE", in the Example for Steel No. 2-16, change "731" to --791--.

Columns 59-60, in Table 9-continued, in the columns entitled "THREE-STAGE COOLING" and "CONDITION FOR SECOND COOLING", change "WITOUT" to --WITHOUT--, wherever it may appear.

Columns 59-60, in Table 9-continued, in the column entitled "CONDITION FOR SECOND COOLING", in the Example for Steel No. 2-1-4, change "COOLING RAGE: 10° C./SEC, 580~550° C." to --COOLING RATE: 10° C./SEC, 580~550° C.--.

Columns 59-60, in Table 9-continued, in the column entitled "COILING TEMPERATURE (° C.)", in the Example for Steel No. 2-1-6, change "463" to --483--.

Columns 59-60, in Table 9-continued, in the column entitled "COOLING RATE (° C./SEC)", in the Example for Steel No. 2-9, change "23" to --28--.

Columns 61-62, in Table 9-continued, change "WITOUT" to --WITHOUT--, wherever it may appear.

Columns 61-62, in Table 10, change the heading "MICROSTCTURE" to --MICROSTRUCTURE--.

Columns 61-62, in Table 10, change the column heading "MAINLY OBSERBED PHASE" to --MAINLY OBSERVED PHASE--.

Columns 63-64, in Table 10-continued, change the column heading "MAINLY OBSERBED EXTENDED INCLUSION" to --MAINLY OBSERVED EXTENDED INCLUSION--.

Columns 65-66, in Table 11, in the column under "BORE EXPANSION TEST" entitled "AVERAGE λave (%)", in the Example for Steel No. 2-2, change "90" to --80--.

IN THE SPECIFICATION (cont.):

Columns 65-66, in Table 11, in the column under "BORE EXPANSION TEST" entitled "AVERAGE λave (%)", in the Example for Steel No. 2-19, change "50" to --90--.

Columns 65-66, in Table 11, under the heading "CHARPY IMPACT TEST", change the column heading for the 5th column from the left from "FRACTURE PPEARANCE TRANSITION TEMPERATURE (° C.)" to --FRACTURE APPEARANCE TRANSITION TEMPERATURE (° C.)--.

Columns 65-66, in Table 11, under the heading "THREE-POINT", change the column heading for the 4th column from the left from "T.M. ($MJ/m^2$)" to --T.M. ($MJ/m^3$)--.

Columns 67-68, in Table 11-continued, in the 4th column from the left, in the Example for Steel No. 2-8, change "533" to --933--.

Columns 71-72, in Table 12, under the heading "STEEL COMPOSITION", change the Example identifiers in the 2nd column from the left from "23" and "24" to --Z3-- and --Z4--, respectively.

Columns 73-74, in Table 14, under the heading "MICROSTRUCTURE", change the column heading for the 4th column from the left from "MAINLY OBSERBED PHASE" to --MAINLY OBSERVED PHASE--.

Columns 73-74, in Table 14, under the heading "INCLUSION", change the column heading for the 5th column from the left from "MAINLY OBSERBED EXTENDED INCLUSION" to --MAINLY OBSERVED EXTENDED INCLUSION--.

Columns 73-74, in Table 15, under the heading "CHARPY IMPACT TEST", change the column heading for the 5th column from the left from "FRACTURE PPEARANCE TRANSITION TEMPERATURE (° C.)" to --FRACTURE APPEARANCE TRANSITION TEMPERATURE (° C.)--.

Columns 73-74, in Table 15, under the heading "THREE-POINT", change the column heading for the 4th column from the left from "T.M. ($MJ/m^2$)" to --T.M. ($MJ/m^3$)--.